US010477332B2

(12) United States Patent
Gustafsson et al.

(10) Patent No.: US 10,477,332 B2
(45) Date of Patent: Nov. 12, 2019

(54) INTEGRITY MANAGEMENT OF AN IMPLANTABLE DEVICE

(71) Applicant: Cochlear Limited, Macquarie University, NSW OT (AU)

(72) Inventors: Johan Gustafsson, Mölnlycke (SE); Dan Nyströem, Mölnlycke (SE); Marcus Andersson, Mölnlycke (SE); Kenneth Oplinger, Macquarie University (AU); Martin Evert Gustaf Hillbratt, Mölnlycke (SE)

(73) Assignee: Cochlear Limited, Macquarie University, NSW (AU)

( * ) Notice: Subject to any disclaimer, the term of this patent is extended or adjusted under 35 U.S.C. 154(b) by 244 days.

(21) Appl. No.: 15/212,450

(22) Filed: Jul. 18, 2016

(65) Prior Publication Data

US 2018/0020301 A1 Jan. 18, 2018

(51) Int. Cl.
*H04R 25/00* (2006.01)

(52) U.S. Cl.
CPC ..... *H04R 25/65* (2013.01); *H04R 25/606* (2013.01); *H04R 2225/61* (2013.01); *H04R 2460/13* (2013.01)

(58) Field of Classification Search
CPC .. H04R 25/65; H04R 25/606; H04R 2225/61; H04R 2460/13
USPC ..... 381/326
See application file for complete search history.

(56) References Cited

U.S. PATENT DOCUMENTS 2,808,522 A 10/1957 Dranetz
4,498,461 A 2/1985 Hakansson
5,176,620 A 1/1993 Gilman
5,702,342 A 12/1997 Metzler et al.
5,757,935 A * 5/1998 Kang ..... H04R 25/00 381/151
5,772,575 A 6/1998 Lesinski et al.
5,800,336 A 9/1998 Ball et al.
5,815,872 A 10/1998 Meginniss, III et al.
6,005,955 A 12/1999 Kroll et al.
6,390,970 B1 5/2002 Müller
6,438,243 B1 8/2002 Ikeuchi et al.
6,447,295 B1 9/2002 Kumar et al.
6,473,651 B1 10/2002 Kuzma et al.
6,726,618 B2 4/2004 Miller
6,759,790 B1 7/2004 Bugel et al.
7,065,223 B2 6/2006 Westerkull
(Continued)

FOREIGN PATENT DOCUMENTS

EP 1501074 A2 1/2005
WO 98/055049 A1 12/1998

OTHER PUBLICATIONS

Nusil Technology, "MED-4901 Liquid Silicone Rubber," Life Sciences, May 16, 2014.

*Primary Examiner* — Sean H Nguyen

(74) *Attorney, Agent, or Firm* — Pilloff Passino & Cosenza LLP; Martin J. Cosenza

(57) ABSTRACT

An implantable component, such as that utilized for a bone conduction device, the implantable component including a housing and a piezoelectric transducer, wherein the implantable component is configured to prevent the piezoelectric transducer from moving inside the housing. The implantable component can be configured to temporarily prevent the piezoelectric transducer from moving inside the housing.

15 Claims, 45 Drawing Sheets

(56) References Cited

U.S. PATENT DOCUMENTS

| | | | | |
|---|---|---|---|---|
| 7,180,225 | B2 * | 2/2007 | Sashida | B06B 1/0611 310/330 |
| 7,242,786 | B2 | 7/2007 | Åsnes | |
| 7,247,976 | B2 | 7/2007 | Sashida et al. | |
| 7,840,020 | B1 | 11/2010 | Miller et al. | |
| 8,761,416 | B2 | 6/2014 | Hakansson | |
| 9,271,092 | B2 | 2/2016 | Bjorn et al. | |
| 9,554,222 | B2 | 1/2017 | Miller et al. | |
| 2003/0012390 | A1 | 1/2003 | Franks | |
| 2003/0055311 | A1 | 3/2003 | Neukermans et al. | |
| 2003/0124491 | A1 | 7/2003 | Honkura et al. | |
| 2004/0097785 | A1 | 5/2004 | Schmid et al. | |
| 2004/0148025 | A1 | 7/2004 | Schneider et al. | |
| 2005/0014108 | A1 | 1/2005 | Wohrle et al. | |
| 2005/0215852 | A1 | 9/2005 | Hatami | |
| 2005/0281432 | A1 | 12/2005 | Horigome | |
| 2006/0045298 | A1 | 3/2006 | Westerkull | |
| 2006/0058573 | A1 | 3/2006 | Neisz et al. | |
| 2006/0165246 | A1 * | 7/2006 | Lee | H04B 1/385 381/151 |
| 2006/0262954 | A1 * | 11/2006 | Lee | H04M 1/03 381/380 |
| 2006/0281963 | A1 | 12/2006 | Easter et al. | |
| 2007/0041595 | A1 | 2/2007 | Carazo et al. | |
| 2007/0104344 | A1 | 5/2007 | Goldberg | |
| 2008/0075319 | A1 | 3/2008 | Kantor et al. | |
| 2008/0112584 | A1 | 5/2008 | Karamuk | |
| 2008/0188707 | A1 | 8/2008 | Bernard et al. | |
| 2009/0082817 | A1 | 3/2009 | Jinton et al. | |
| 2009/0115294 | A1 | 5/2009 | Kikushima | |
| 2009/0124849 | A1 | 5/2009 | Pergola | |
| 2010/0298626 | A1 | 11/2010 | Andersson et al. | |
| 2012/0108887 | A1 | 5/2012 | Vermeiren | |
| 2013/0096366 | A1 * | 4/2013 | Bervoets | A61N 1/36036 600/25 |
| 2013/0184629 | A1 | 7/2013 | Gurtner | |
| 2013/0197298 | A1 | 8/2013 | Miller et al. | |
| 2014/0112503 | A1 | 4/2014 | Hebenstreit | |
| 2014/0163308 | A1 | 6/2014 | Miller et al. | |
| 2014/0303688 | A1 | 10/2014 | Kulah et al. | |
| 2015/0141740 | A1 | 5/2015 | Miller | |
| 2015/0156594 | A1 | 6/2015 | Bervoets | |

* cited by examiner

INTEGRITY MANAGEMENT OF AN IMPLANTABLE DEVICE

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. For example, cochlear implants use an electrode array implanted in the cochlea of a recipient to bypass the mechanisms of the ear. More specifically, an electrical stimulus is provided via the electrode array to the auditory nerve, thereby causing a hearing percept.

Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from conductive hearing loss typically receive an acoustic hearing aid. Hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve.

In contrast to hearing aids, which rely primarily on the principles of air conduction, certain types of hearing prostheses commonly referred to as bone conduction devices, convert a received sound into vibrations. The vibrations are transferred through the skull to the cochlea causing generation of nerve impulses, which result in the perception of the received sound. Bone conduction devices are suitable to treat a variety of types of hearing loss and may be suitable for individuals who cannot derive sufficient benefit from acoustic hearing aids, cochlear implants, etc., or for individuals who suffer from stuttering problems.

SUMMARY

In accordance with one aspect, there is an implantable component, comprising a housing and a piezoelectric transducer, wherein the implantable component is configured to prevent the piezoelectric transducer from moving inside the housing.

In accordance with another aspect, there is a component of a bone conduction device, comprising a housing and a transducer-seismic mass assembly, wherein the component is configured to temporarily shock-proof the assembly.

In accordance with another aspect, there is a method, comprising obtaining an implantable component of an active transcutaneous bone conduction device including a transducer hermetically sealed within a housing, wherein the transducer is restrained from movement within the housing unrestraining the transducer while the transducer is hermetically sealed within the housing so that the transducer can move.

BRIEF DESCRIPTION OF THE DRAWINGS

Some embodiments are described below with reference to the attached drawings, in which.

DETAILED DESCRIPTION

Figure 1:
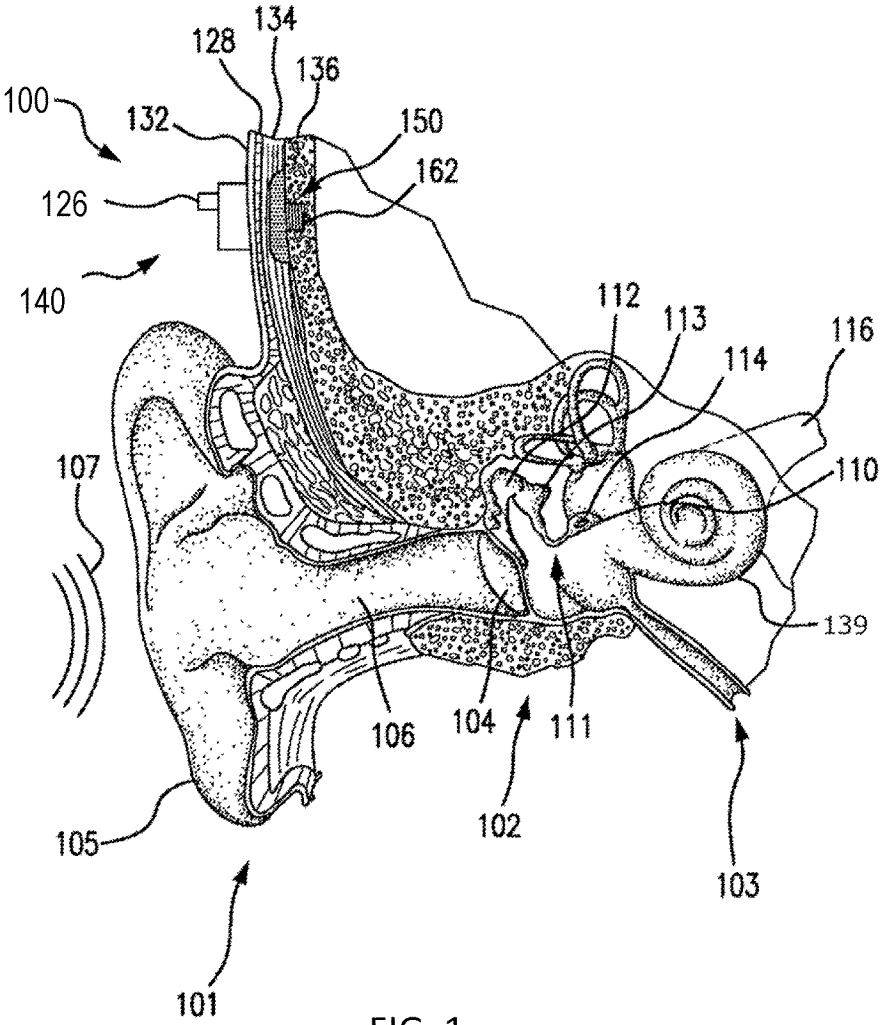
FIG. 1 is a perspective view of an exemplary bone conduction device in which at least some embodiments can be implemented.

Embodiments herein are described primarily in terms of a bone conduction device, such as an active transcutaneous bone conduction device. However, it is noted that the teachings detailed herein and/or variations thereof are also applicable to a cochlear implant and/or a middle ear implant. Accordingly, any disclosure herein of teachings utilized with an active transcutaneous bone conduction device also corresponds to a disclosure of utilizing those teachings with respect to a cochlear implant and utilizing those teachings with respect to a middle ear implant. Moreover, at least some exemplary embodiments of the teachings detailed herein are also applicable to a passive transcutaneous bone conduction device. It is further noted that the teachings detailed herein can be applicable to other types of prostheses, such as by way of example only and not by way of limitation, a retinal implant. Indeed, the teachings detailed herein can be applicable to any component that is held against the body that utilizes an RF coil and/or an inductance coil or any type of communicative coil to communicate with a component implanted in the body. That said, the teachings detailed herein will be directed by way of example only and not by way of limitation towards a component that is held against the head of a recipient for purposes of the establishment of an external component of the hearing prosthesis. In view of this, FIG. 1 is a perspective view of a bone conduction device 100 in which embodiments may be implemented. As shown, the recipient has an outer ear 101, a middle ear 102, and an inner ear 103. Elements of outer ear 101, middle ear 102, and inner ear 103 are described below, followed by a description of bone conduction device 100.

In a fully functional human hearing anatomy, outer ear 101 comprises an auricle 105 and an ear canal 106. A sound wave or acoustic pressure 107 is collected by auricle 105 and channeled into and through ear canal 106. Disposed across the distal end of ear canal 106 is a tympanic membrane 104 which vibrates in response to acoustic wave 107. This vibration is coupled to oval window or fenestra ovalis 210 through three bones of middle ear 102, collectively referred to as the ossicles 111 and comprising the malleus 112, the incus 113 and the stapes 114. The ossicles 111 of middle ear 102 serve to filter and amplify acoustic wave 107, causing oval window 210 to vibrate. Such vibration sets up waves of fluid motion within cochlea 139. Such fluid motion, in turn, activates hair cells (not shown) that line the inside of cochlea 139. Activation of the hair cells causes appropriate nerve impulses to be transferred through the spiral ganglion cells and auditory nerve 116 to the brain (not shown), where they are perceived as sound.

FIG. 1 also illustrates the positioning of bone conduction device 100 relative to outer ear 101, middle ear 102 and inner ear 103 of a recipient of device 100. Bone conduction device 100 comprises an external component 140 and implantable component 150. As shown, bone conduction device 100 is positioned behind outer ear 101 of the recipient and comprises a sound input element 126 to receive sound signals. Sound input element 126 may comprise, for example, a microphone. In an exemplary embodiment, sound input element 126 may be located, for example, on or in bone conduction device 100, or on a cable extending from bone conduction device 100.

More particularly, sound input device 126 (e.g., a microphone) converts received sound signals into electrical signals. These electrical signals are processed by the sound processor. The sound processor generates control signals which cause the actuator to vibrate. In other words, the actuator converts the electrical signals into mechanical motion to impart vibrations to the recipient's skull.

Alternatively, sound input element 126 may be subcutaneously implanted in the recipient, or positioned in the recipient's ear. Sound input element 126 may also be a component that receives an electronic signal indicative of sound, such as, for example, from an external audio device. For example, sound input element 126 may receive a sound signal in the form of an electrical signal from an MP3 player electronically connected to sound input element 126.

Bone conduction device 100 comprises a sound processor (not shown), an actuator (also not shown), and/or various other operational components. In operation, the sound processor converts received sounds into electrical signals. These electrical signals are utilized by the sound processor to generate control signals that cause the actuator to vibrate. In other words, the actuator converts the electrical signals into mechanical vibrations for delivery to the recipient's skull.

In accordance with some embodiments, a fixation system 162 may be used to secure implantable component 150 to skull 136. As described below, fixation system 162 may be a bone screw fixed to skull 136, and also attached to implantable component 150.

In one arrangement of FIG. 1, bone conduction device 100 can be a passive transcutaneous bone conduction device. That is, no active components, such as the actuator, are implanted beneath the recipient's skin 132. In such an arrangement, the active actuator is located in external component 140, and implantable component 150 includes a magnetic plate, as will be discussed in greater detail below. The magnetic plate of the implantable component 150 vibrates in response to vibration transmitted through the skin, mechanically and/or via a magnetic field, that is generated by an external magnetic plate.

In another arrangement of FIG. 1, bone conduction device 100 can be an active transcutaneous bone conduction device where at least one active component, such as the actuator, is implanted beneath the recipient's skin 132 and is thus part of the implantable component 150. As described below, in such an arrangement, external component 140 may comprise a sound processor and transmitter, while implantable component 150 may comprise a signal receiver and/or various other electronic circuits/devices.

Figure 2:
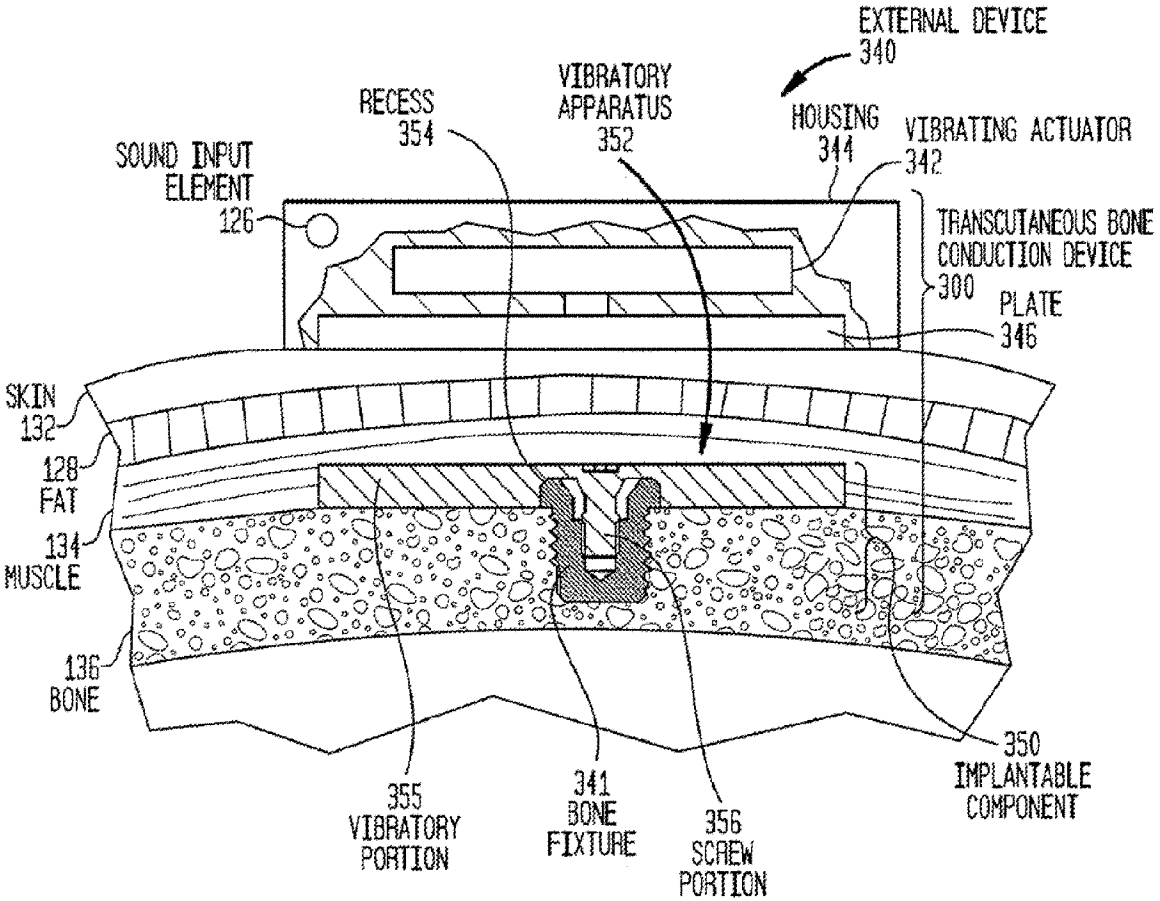
FIG. 2 is a schematic diagram conceptually illustrating a passive transcutaneous bone conduction device.

FIG. 2 depicts an exemplary transcutaneous bone conduction device 300 that includes an external device 340 (corresponding to, for example, element 140 of FIG. 1) and an implantable component 350 (corresponding to, for example, element 150 of FIG. 1). The transcutaneous bone conduction device 300 of FIG. 2 is a passive transcutaneous bone conduction device in that a vibrating electromagnetic actuator 342 is located in the external device 340. Vibrating electromagnetic actuator 342 is located in housing 344 of the external component, and is coupled to plate 346. Plate 346 may be in the form of a permanent magnet and/or in another form that generates and/or is reactive to a magnetic field, or otherwise permits the establishment of magnetic attraction between the external device 340 and the implantable component 350 sufficient to hold the external device 340 against the skin of the recipient.

In an exemplary embodiment, the vibrating electromagnetic actuator 342 is a device that converts electrical signals into vibration. In operation, sound input element 126 converts sound into electrical signals. Specifically, the transcutaneous bone conduction device 300 provides these electrical signals to vibrating electromagnetic actuator 342, or to a sound processor (not shown) that processes the electrical signals, and then provides those processed signals to vibrating electromagnetic actuator 342. The vibrating electromagnetic actuator 342 converts the electrical signals (processed or unprocessed) into vibrations. Because vibrating electromagnetic actuator 342 is mechanically coupled to plate 346, the vibrations are transferred from the vibrating electromagnetic actuator 342 to plate 346. Implanted plate assembly 352 is part of the implantable component 350, and is made of a ferromagnetic material that may be in the form of a permanent magnet, that generates and/or is reactive to a magnetic field, or otherwise permits the establishment of a magnetic attraction between the external device 340 and the implantable component 350 sufficient to hold the external device 340 against the skin of the recipient. Accordingly, vibrations produced by the vibrating electromagnetic actuator 342 of the external device 340 are transferred from plate 346 across the skin to plate 355 of plate assembly 352. This can be accomplished as a result of mechanical conduction of the vibrations through the skin, resulting from the external device 340 being in direct contact with the skin and/or from the magnetic field between the two plates. These vibrations are transferred without penetrating the skin with a solid object, such as an abutment, with respect to a percutaneous bone conduction device.

As may be seen, the implanted plate assembly 352 is substantially rigidly attached to a bone fixture 341 in this embodiment. Plate screw 356 is used to secure plate assembly 352 to bone fixture 341. The portions of plate screw 356 that interface with the bone fixture 341 substantially correspond to an abutment screw discussed in some additional detail below, thus permitting plate screw 356 to readily fit into an existing bone fixture used in a percutaneous bone conduction device. In an exemplary embodiment, plate screw 356 is configured so that the same tools and procedures that are used to install and/or remove an abutment screw (described below) from bone fixture 341 can be used to install and/or remove plate screw 356 from the bone fixture 341 (and thus the plate assembly 352).

Figure 3:
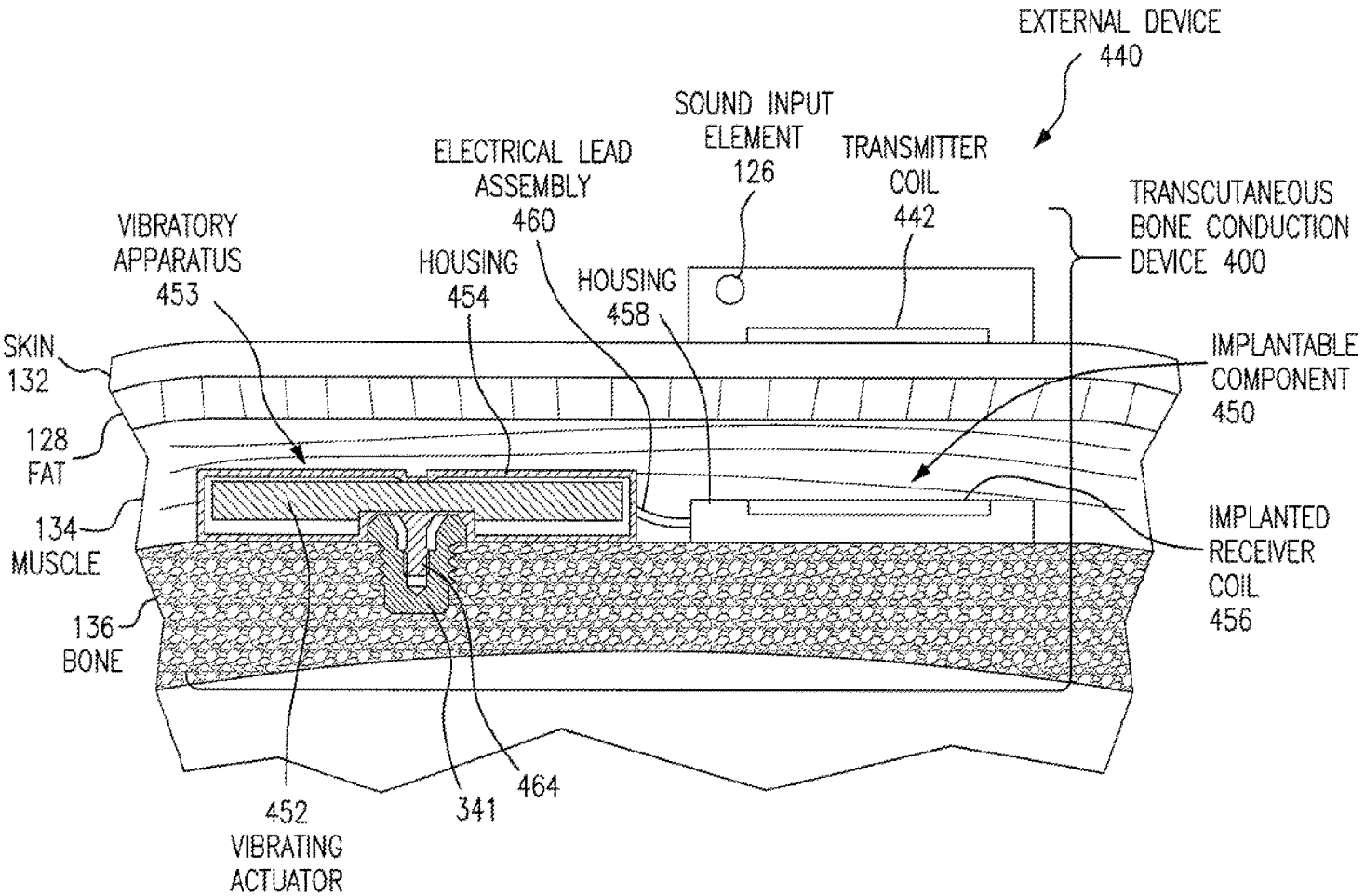
FIG. 3 is a schematic diagram conceptually illustrating an active transcutaneous bone conduction device in accordance with at least some exemplary embodiments.

FIG. 3 depicts an exemplary embodiment of a transcutaneous bone conduction device 400 according to another embodiment that includes an external device 440 (corresponding to, for example, element 140B of FIG. 1) and an implantable component 450 (corresponding to, for example, element 150 of FIG. 1). The transcutaneous bone conduction device 400 of FIG. 3 is an active transcutaneous bone conduction device in that the vibrating electromagnetic actuator 452 is located in the implantable component 450. Specifically, a vibratory element in the form of vibrating electromagnetic actuator 452 is located in housing 454 of the implantable component 450. In an exemplary embodiment, much like the vibrating electromagnetic actuator 342 described above with respect to transcutaneous bone conduction device 300, the vibrating electromagnetic actuator 452 is a device that converts electrical signals into vibration.

External component 440 includes a sound input element 126 that converts sound into electrical signals. Specifically, the transcutaneous bone conduction device 400 provides these electrical signals to vibrating electromagnetic actuator 452, or to a sound processor (not shown) that processes the electrical signals, and then provides those processed signals to the implantable component 450 through the skin of the recipient via a magnetic inductance link. In this regard, a transmitter coil 442 of the external component 440 transmits these signals to implanted receiver coil 456 located in housing 458 of the implantable component 450. Components (not shown) in the housing 458, such as, for example, a signal generator or an implanted sound processor, then generate electrical signals to be delivered to vibrating electromagnetic actuator 452 via electrical lead assembly 460. The vibrating electromagnetic actuator 452 converts the electrical signals into vibrations.

The vibrating electromagnetic actuator 452 is mechanically coupled to the housing 454. Housing 454 and vibrating electromagnetic actuator 452 collectively form a vibratory apparatus 453. The housing 454 is substantially rigidly attached to bone fixture 341.

Figure 4:
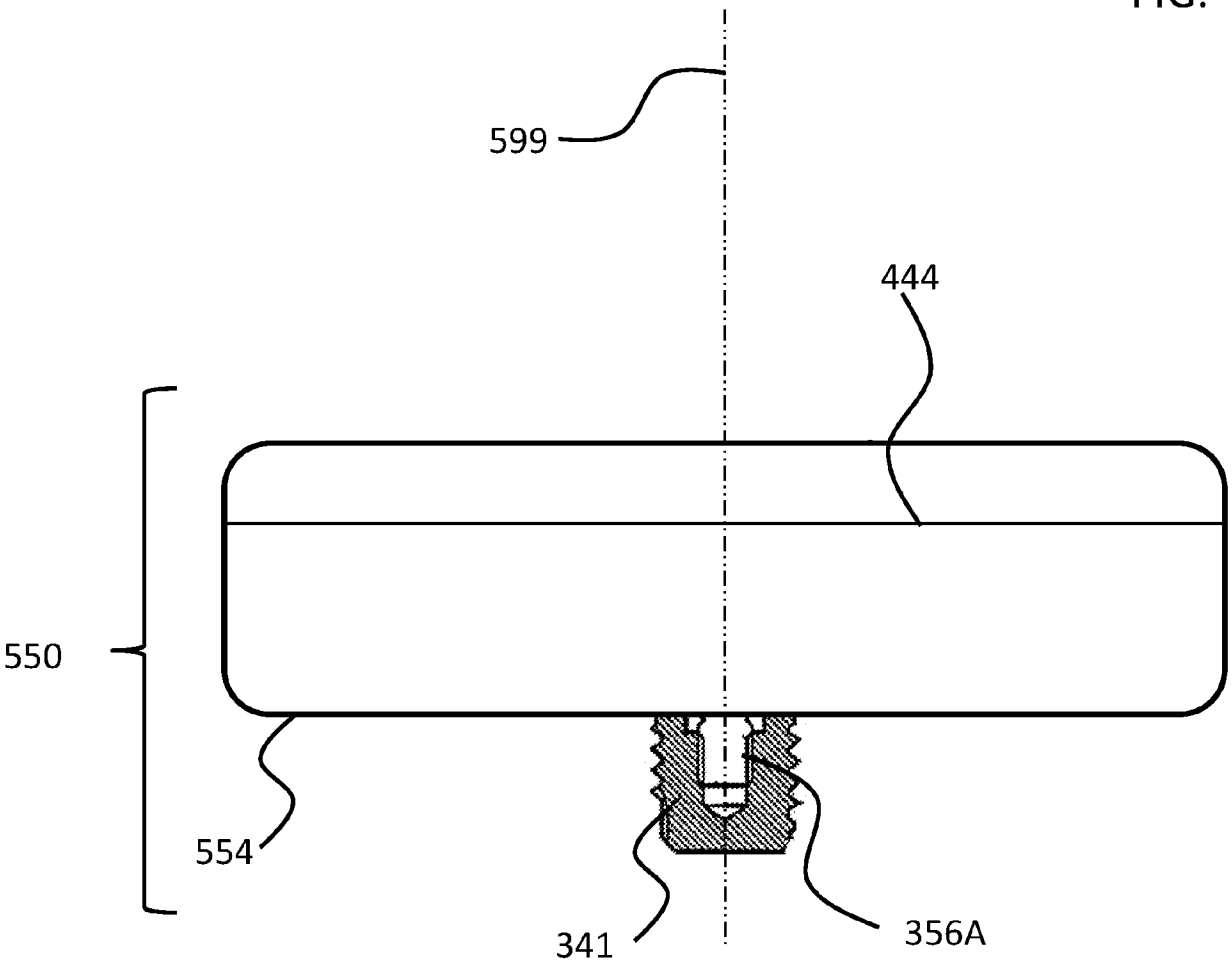
FIG. 4 is a schematic diagram of an outer portion of an implantable component of a bone conduction device.
Figure 5:
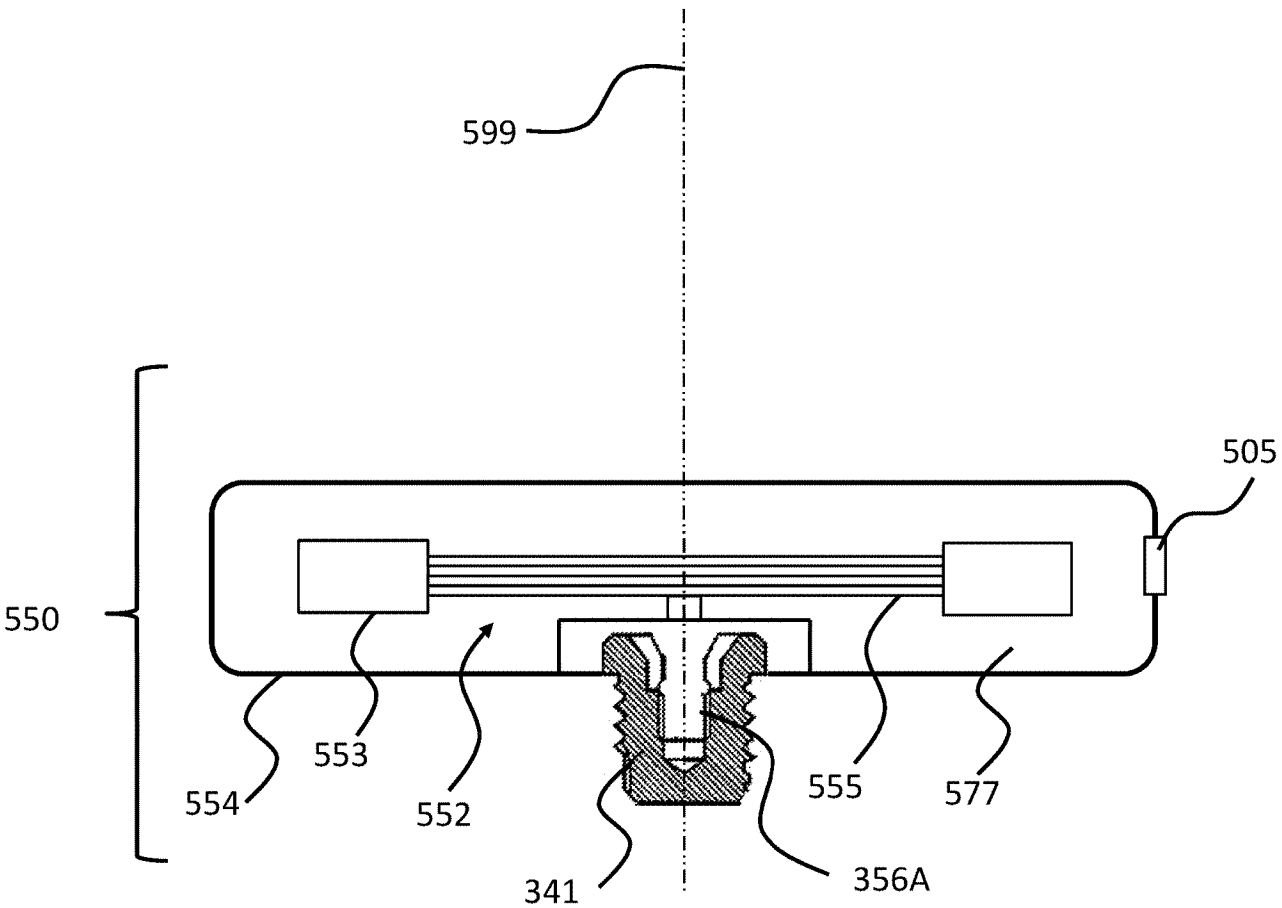
FIG. 5 is a schematic diagram of a cross-section of an exemplary implantable component of a bone conduction device.

FIGS. 4 and 5 depict another exemplary embodiment of an implantable component usable in an active transcutaneous bone conduction device, here, implantable component 550. FIG. 4 depicts a side view of the implantable component 550 which includes housing 554 which entails two housing bodies made of titanium in an exemplary embodiment, welded together at seam 444 to form a hermetically sealed housing. FIG. 5 depicts a cross-sectional view of the implantable component 550.

In an exemplary embodiment, the implantable component 550 is used in the embodiment of FIG. 3 in place of implantable component 450. As can be seen, implantable component 550 combines an actuator 552 (corresponding with respect to functionality to actuator 452 detailed above). Briefly, it is noted that the vibrating actuator 552 includes a so-called counterweight/mass 553 that is supported by piezoelectric components 555. In the exemplary embodiment of FIG. 5, the piezoelectric components 555 flex upon the exposure of an electrical current thereto, thus moving the counterweight 553. In an exemplary embodiment, this movement creates vibrations that are ultimately transferred to the recipient to evoke a hearing percept.

As can be understood from the schematic of FIG. 5, in an exemplary embodiment, the housing 554 entirely and completely encompasses the vibratory apparatus 552, but includes feedthrough 505, so as to permit the electrical lead assembly 460 to communicate with the vibrating actuator 452 therein. It is briefly noted at this time that some and/or all of the components of the embodiment of FIG. 5 are at least generally rotationally symmetric about the longitudinal axis 559. In this regard, the screw 356A is circular about the longitudinal axis 559. Back lines have been omitted for purposes of clarity in some instances.

Figure 6:
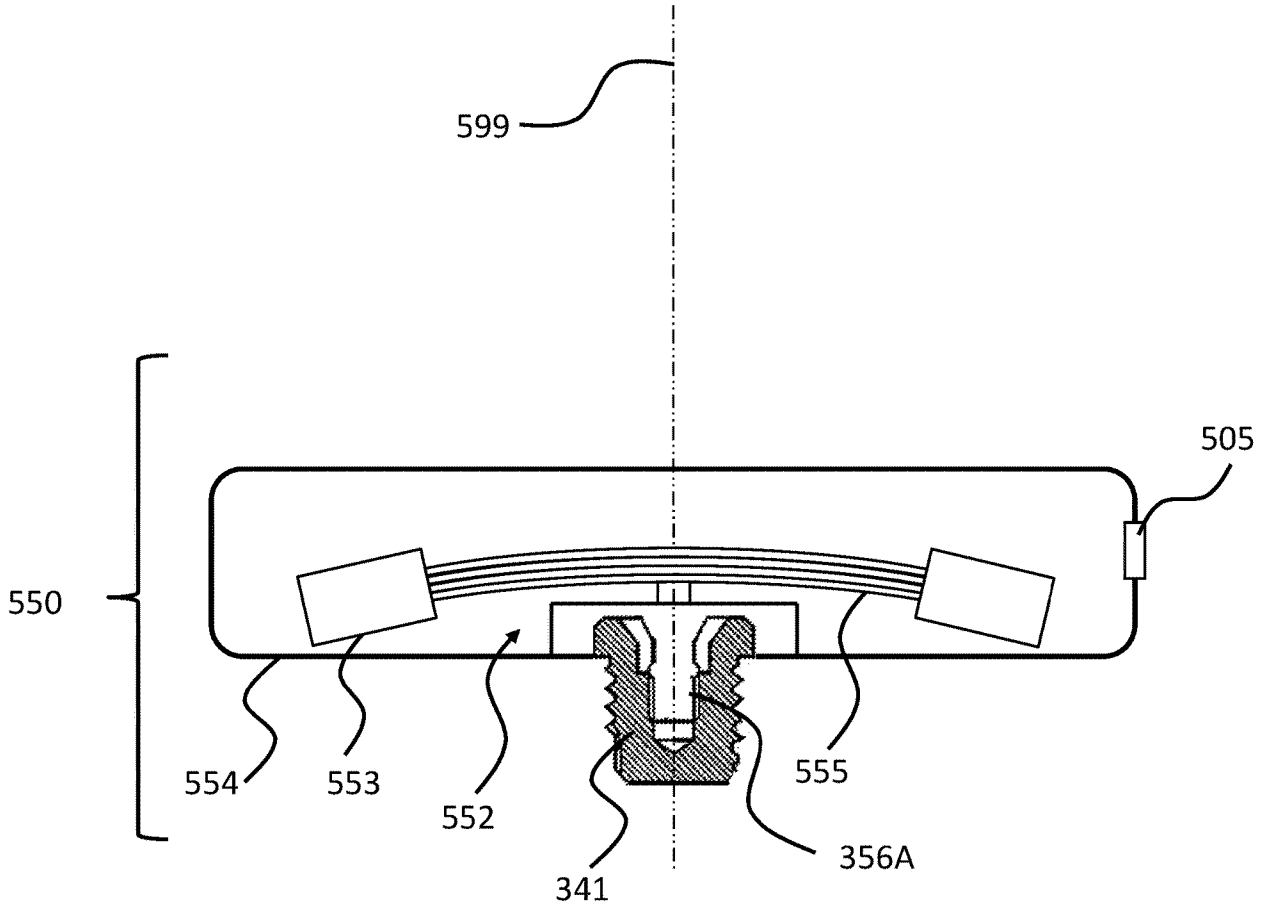
FIG. 6 is a schematic diagram of a cross-section of the exemplary implantable component of FIG. 5 in operation.

Still with reference to FIG. 5, as can be seen, there is a space 577 located between the housing 554 in general, and the inside wall thereof in particular, and the counterweight 553. This space has utilitarian value with respect to enabling the implantable component 550 to function as a transducer in that, in a scenario where the implantable component is an actuator, the piezoelectric material 555 can flex, which can enable the counterweight 553 to move within the housing 554 so as to generate vibrations to evoke a hearing percept. FIG. 6 depicts an exemplary scenario of movement of the piezoelectric material 555 when subjected to an electrical current along with the movement of the counterweight 553. As can be seen, space 577 provides for the movement of the actuator 552 within housing 554 so that the counterweight 553 does not come into contact with the inside wall of the housing 554. However, the inventors of the present application have identified a failure mode associated with such an implantable component 550. Specifically, in a scenario where prior to the attachment of the housing 554 and the components therein to the bone fixture 341, the housing and the components therein are subjected to an acceleration above certain amounts and/or a deceleration above certain amounts, the piezoelectric material 555 will be bent or otherwise deformed beyond its operational limits, which can, in some instances, have a deleterious effect on the piezoelectric material.

Figure 7:
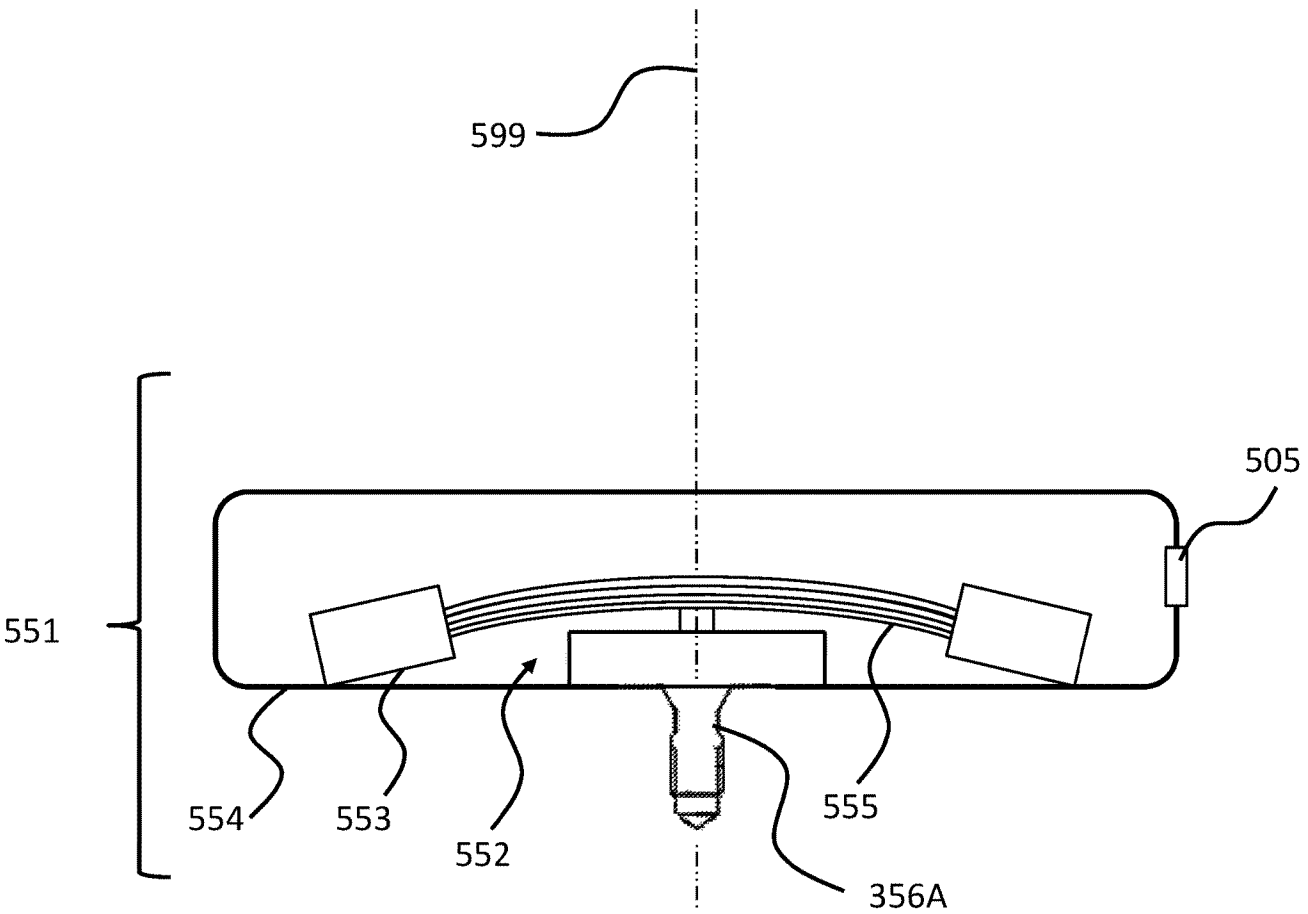
FIG. 7 is a schematic diagram of a cross-section of the exemplary implantable component of FIG. 5 in a failure mode.

FIG. 7 depicts an exemplary failure mode, where implantable sub component 551 (without bone fixture 541) prior to implantation into a recipient (and thus prior to attachment to the bone fixture 541) is dropped from a height of 1.25 m onto a standard operating room floor or the like. The resulting deceleration causes the piezoelectric material 555, which is connected to the counterweight 553, to deform as seen in FIG. 7. This can break or otherwise plastically deform the piezoelectric material 555 (irrespective of whether the counterweight 553 contacts the housing walls, in some embodiments—in deed, in many embodiments, the piezoelectric material 555 will fail prior to the counterweights contacting the walls—thus, FIG. 7 is presented for purposes of conceptual illustration). The teachings detailed herein are directed towards avoiding such a scenario when associated with such decelerations and/or accelerations.

Figure 8:
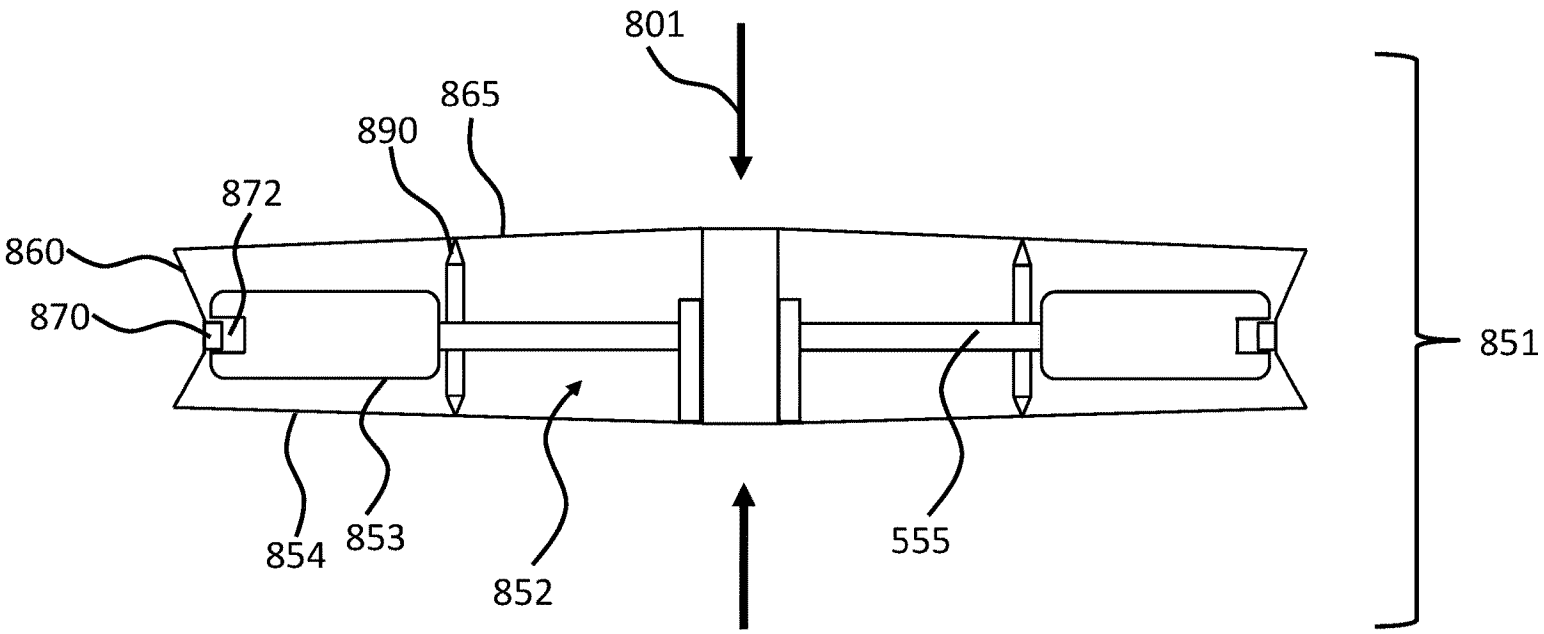
FIG. 8 is a schematic diagram of a cross-section of an exemplary embodiment that prevents the failure mode conceptually represented in FIG. 7.

FIG. 8 depicts an exemplary embodiment of an exemplary implantable sub component 851 having utilitarian value in that such can reduce or otherwise eliminate the failure mode associated with that depicted in FIG. 7. FIG. 8 depicts a cross-section through the geometric center of the subcomponent 851. Implantable subcomponent 851 includes a housing 854 that encases an actuator 852, which actuator includes a piezoelectric material 555 corresponding to that of FIG. 7, and a counterweight 853 that corresponds to the counterweight 553 of FIG. 7, except that there is an indentation 872 at the ends thereof as can be seen. In an exemplary embodiment, the indentations 872 interact with prongs 870 which are connected to the sidewalls 860 of the housing 854. As can be seen, the prongs 870 are located inside the indentations 872. With respect to this embodiment, because the prongs 870 are located in the indentations 872, if the subcomponent 851 was subjected to a deceleration and/or acceleration corresponding to that which results in the scenario depicted in FIG. 7, the counter mass 853 in general, and the top surface of the indentations 872 in particular, will contact the top surface of the prong 870, thus preventing the counter mass 853 from moving a large amount/an amount that would cause the piezoelectric material 555 to break or otherwise plastically deform. Hereinafter, the configuration utilizing apparatuses to prevent the counterweights and/or the piezoelectric material from moving when subjected to an acceleration and/or deceleration is sometimes referred to herein for purposes of linguistic economy as a shock-proof assembly.

In an exemplary embodiment, the configuration depicted in FIG. 8 prevents the piezoelectric material 555 from bending more than that which would be the case during the most extreme operation of the subcomponent to evoke a hearing percept that the subcomponent 851 was designed to accommodate. In an exemplary embodiment, with respect to angular movement of the counterweight 553 relative to that which is the case at rest, the arrangement of FIG. 8 prevents the counterweights 853 from moving, if any amount (some embodiments do not allow the counterweights to move at all) more than 1500%, 1250%, 1000%, 750%, 500%, 250%, 225%, 200%, 175%, 150%, 140%, 130%, 125%, 120%, 115%, 110%, 105%, 100%, 95%, 90%, 85%, 80%, 75%, 70%, 65%, 60%, 55%, 50%, 45%, 40%, 35%, 30%, 25%, 20%, 15%, 10%, 9%, 8%, 7%, 6%, 5%, 4%, 3%, 2%, 1%, 0.5%, 0.25%, 0.125%, 0.1%, 0.05%, 0.025%, 0.01%, or any value or range of values therebetween in 0.01% increments (e.g., 75.33% to 33.31%, 003%, etc.) than that which results from the subassembly 851 vibrating in response to a pure sine wave at 1000 Hz at 80 dB (as measured at the microphone of the external component when used therewith).

Figure 9:
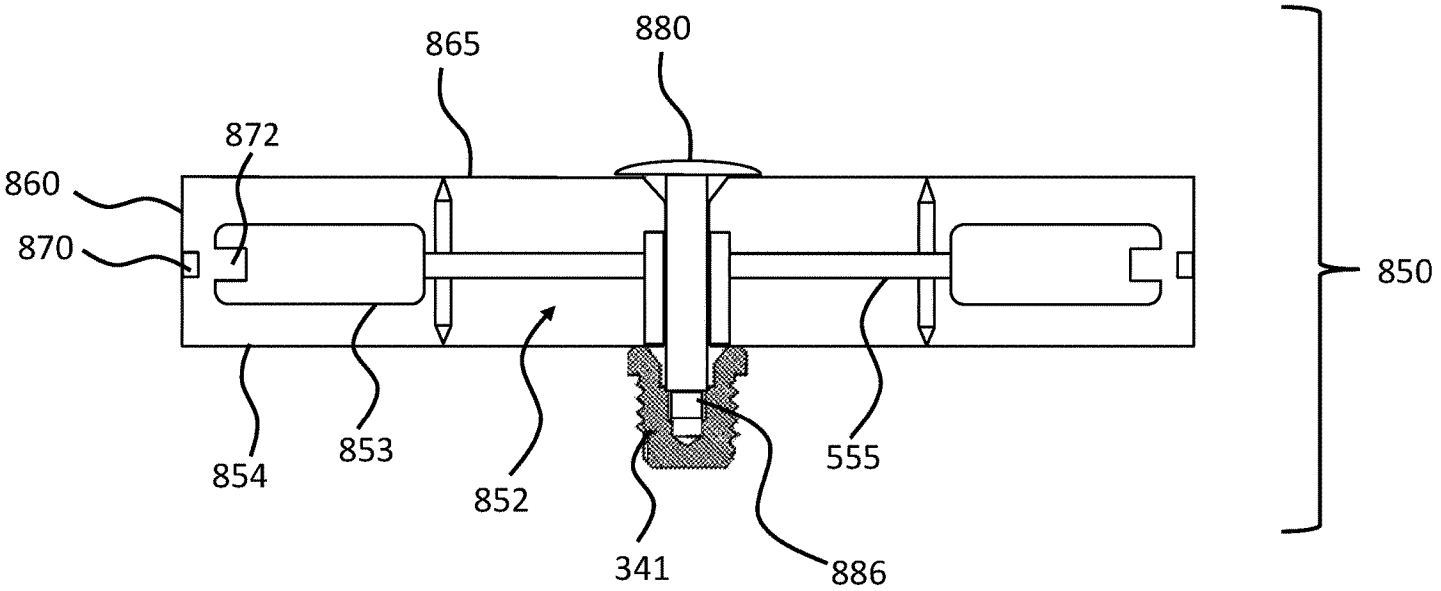
FIG. 9 is a schematic diagram of a cross-section of the exemplary embodiment depicted in FIG. 8 where the component has been adjusted so as to take the component out of the shock-proof configuration.

In the exemplary embodiment depicted in FIG. 8, the subcomponent 851 in general, and the housing 854 in particular, is configured so as to flex or otherwise deform or otherwise reform itself so as to move the prongs 870 out of the indentations 872, as seen in FIG. 9. (It is noted that for the purposes of description, components located in the configuration of FIG. 8 will be referred to herein as the locked state of the shock-proof apparatus, while components located in the configuration of FIG. 9 will be referred to herein as the unlock state of the shock-proof apparatus.) In an exemplary embodiment, the application of a force as conceptually represented by arrows 801 as seen in FIG. 8 at the center of the housing 844 of sufficient magnitude causes the upper and lower walls 865 of the housing 854 to function as a lever, where the fulcrum thereof is established by structure 890 (which is a frame that extends about the piezoelectric material 555 so as to not interfere with the movement thereof and the movement of the counterweight 553) so as to "pull" sidewall 860 to a more straight configuration (as a result of the ends of the walls 865 moving away from the prongs 870 due to the lever action of the walls 865), which moves the prongs 870 out of the indentations 872, the results of which can be seen in FIG. 9.

In an exemplary embodiment, the force 801 is achieved via the tightening of a bolt 880 to the bone fixture 341 during attachment of the subcomponent 851 to the already implanted bone fixture 341 so as to establish the implantable component 850. In this regard, bolt 880 includes a male threaded end 886 that threads into female threads located within bone fixture 341. This operates as an effective jack-screw to pull the head of the bolt 880 downward towards the bone fixture 341, thus compressing the walls 865 between the head of the bolt 880 on the one hand, and the top of the bone fixture 341 on the other hand, thereby forcing those ends of the wall 865 towards each other, and thus forcing the other ends of the walls 865 away from each other owing to the fulcrum 890 located inside the housing.

Because the prongs 870 are no longer in the indentations 872, the counterweight 853 is free to move when the piezoelectric material 555 is subjected to a current or the like (or when the implantable component 850 is subjected to vibrations in the scenario where the implantable component 850 in general, and the transducer 552 in particular, is used as a vibration sensor as opposed to an actuator).

Accordingly, in view of the above, in an exemplary embodiment, there can be seen that there is an implantable component, such as implantable component 850, which includes a housing, such as housing 854, and a piezoelectric transducer, such as piezoelectric transducer 852. In this exemplary embodiment, the implantable component 850 is configured to prevent the piezoelectric transducer from moving inside the housing. In this regard, such an embodiment corresponds to the implantable component 850 being in the configuration depicted in FIG. 8. Corollary to this is that in this exemplary embodiment, the implantable component is configured to temporarily prevent the piezoelectric transducer from moving inside the housing.

Still further, as can be seen from the above, it is to be understood that in an exemplary embodiment, there is an implantable component where the housing is configured to be bolted to a bone fixture, such as bone fixture 341, via the application of a torque to a bolt, such as bolt 880, extending from a top side of the housing 854 to a bottom side of the housing 854 (the bottom being the side of the housing where the bone fixture 341 is located). It is noted that in this exemplary embodiment, the housing 854 is configured to be bolted to a bone fixture while that bone fixture is implanted in bone of the recipient. Continuing with the description of this exemplary embodiment, the housing is configured to be driven inward from a relaxed state upon the application of the torque during bolting to the bone fixture (where, in this embodiment, the relaxed state is that corresponding to FIG. 8). Also, the implantable component is configured such that when the housing is driven inward from the relaxed state, a force is relieved from the transducer to enable the transducer to subsequently move. Still further, in at least some exemplary embodiments, the implantable component is configured such that when the housing is in the relaxed state, the housing applies a force onto the transducer to prevent the transducer from moving inside the housing.

Briefly, it is noted that at least some of these embodiments have utilitarian value in that it can provide a component of an implantable prosthesis with a shock-proof apparatus that can at least temporarily shock-proof a fragile assembly therein. In this regard, the teachings detailed herein can provide a modicum of integrity production of the actuator until the actuator is ready for use, whether that be just before implantation into the recipient, during implantation into the recipient, or after implantation into the recipient. Because some failure mode scenarios exist where subsequent to removing the implantable component from its packaging (or, in some instances, while the implantable component is still in its packaging), a healthcare professional or the like drops the implantable component onto the floor, thus causing the piezoelectric material to break, because the shock causes the piezoelectric material to deform beyond its operating range, the teachings detailed herein can be provided to temporarily shock-proof the piezoelectric actuator. Accordingly, in an exemplary embodiment, there is a component of a bone conduction device, which includes a housing and a transducer—seismic mass assembly (the combination of the piezoelectric material 550 and the counterweight 553, for example). In this exemplary embodiment, the component of the bone conduction device is configured to temporarily shock-proof this transducer—seismic mass assembly. This temporary shock-proofing can be achieved via the teachings detailed herein (e.g., whether it be by the flexible/movable housing wall, or via the movable locking apparatus 1270, etc.).

Figure 12:
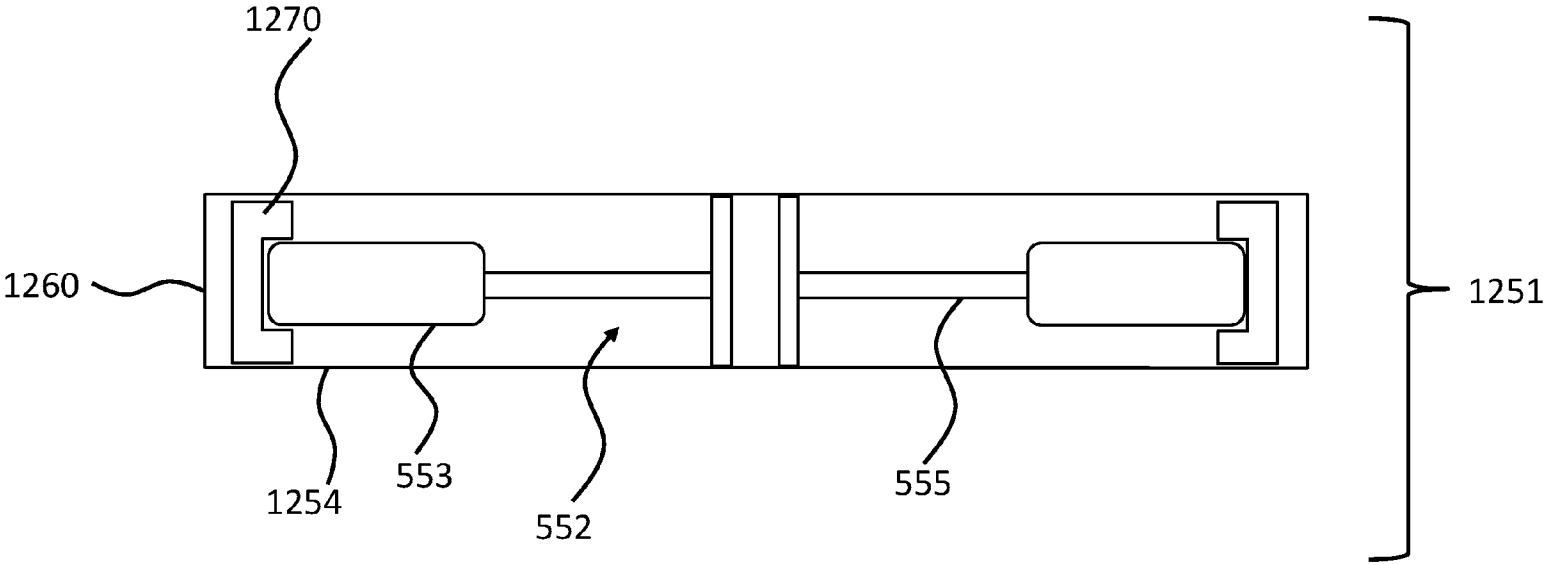
FIG. 12 is a schematic diagram of a cross-section of an exemplary embodiment that prevents the failure mode conceptually represented in FIG. 7.
Figure 13:
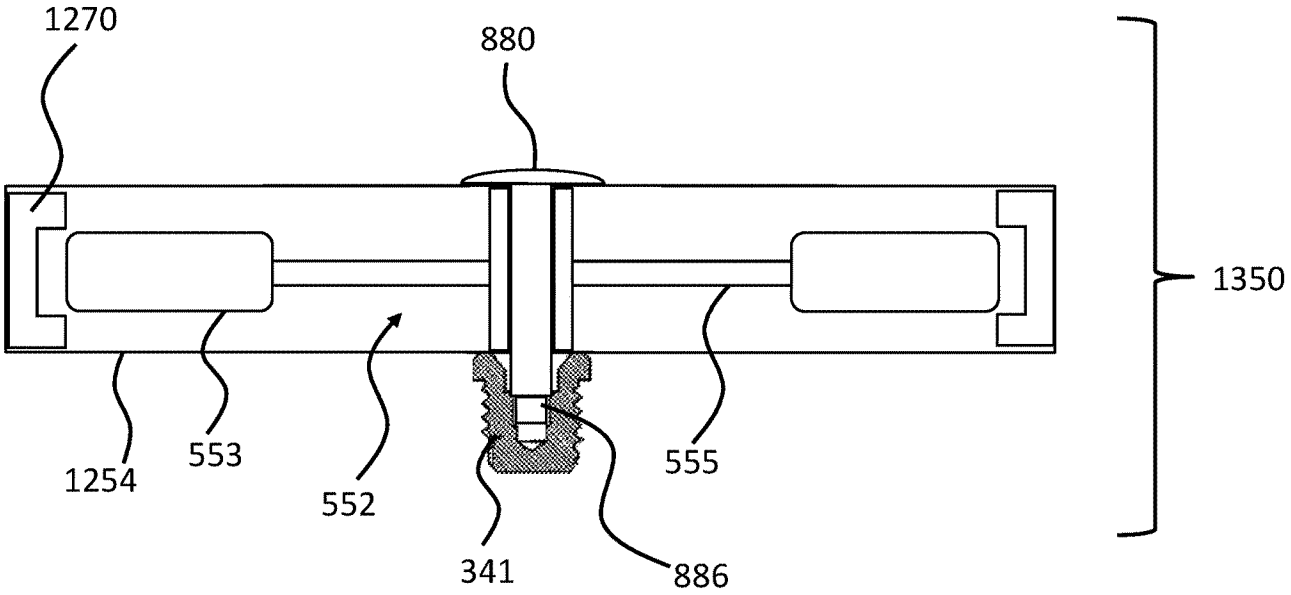
FIG. 13 is a schematic diagram of a cross-section of the exemplary embodiment depicted in FIG. 12 where the component has been adjusted so as to take the component out of the shock-proof configuration.

Still further, the component of the bone conduction device can include a movable component (e.g., locking apparatus 1270) that is movable relative to the assembly that prevents the assembly from moving inside the housing when at a first position (e.g., that of FIG. 12) and enables the assembly to move inside the housing when at the second position (e.g., that of FIG. 13). This first position being a position in which the assembly is shock-proofed, the second position being a position in which the assembly is no longer shock-proofed (hence the temporary shock-proofing).

Also, the implantable component 850 includes at least one housing wall section that moves relative to another housing wall section. In this exemplary embodiment, the housing wall section 865 moves relative to housing wall section 860, and vice versa. In this exemplary embodiment, when the at least one housing wall section (e.g., housing wall section 860) is in a first position relative to another housing wall section (e.g. housing wall section 865), the at least one housing wall section applies a force directly or indirectly to the transducer 852 so as to prevent the transducer 852 from moving inside the housing 854. Here, the force that is applied is applied indirectly via the prong 870. Still, in some embodiments, it can be the housing wall itself that directly applies the force so as to prevent the transducer 852 from moving inside the housing 854.

It is noted that by "prevent the transducer from moving inside the housing," it is meant movement corresponding to the movable components thereof that moved during normal operation of the transducer. This as distinguished from, for example, the mere attachment of the transducer to the housing to secure the transducer to the housing, which is present in the prior art, and is also present in the embodiment of FIG. 5, which does not include the utilitarian features associated with the shock-proofing apparatus detailed herein.

Figure 10:
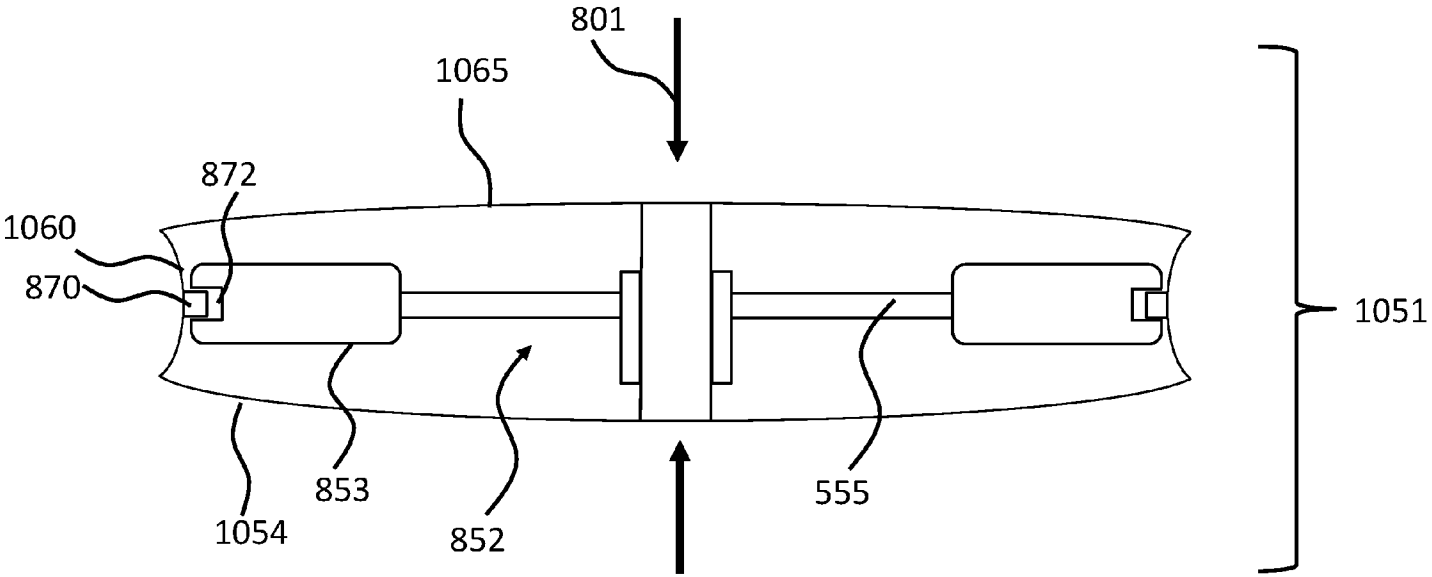
FIG. 10 is a schematic diagram of a cross-section of an exemplary embodiment that prevents the failure mode conceptually represented in FIG. 7.

While the embodiments of FIGS. 8 and 9 utilize a fulcrum approach with articulating walls of the housing 854 to move the prongs 870 out of the indentations 872, in an alternate embodiment, an oil canning approach can be utilized. In this regard, FIG. 10 depicts an exemplary implantable subcomponent 1051 having a housing 1054. The housing has top and bottom walls 1065 and sidewalls 1060 that are respectively bowed outward and inward, as can be seen. In an exemplary embodiment, the application of the force 801 compresses the upper and bottom walls 1065 inward, negating at least a portion of the oil canning (or, from another frame of reference, oil canning the walls 1065 inward), which causes the portions of the housing at the locations where the upper and bottom walls 1065 meet the sidewalls 10602 extend outward away from the longitudinal axis of the implantable subcomponent 1051. This causes a negation in at least a portion of the oil canning of the sidewalls 1060 (or, from another frame of reference, oil canning those walls 1060 outward). Because the prongs 870 are attached to the sidewalls 1060, the prongs are pulled away from the counterweights 853, and thus away from/out of the indentations 872. This enables the counterweights 853 to move freely when the implantable subcomponent 1051 is utilized as a transducer implanted in a recipient. The negation of at least a portion of an oil canning of the sidewalls corresponds to reverse oil canning.

It is noted that while in some embodiments, force 801 is applied via the application a compressive force from the head of the bolt 880 and the top of the bone fixture 341 in a manner concomitant with that of the embodiments of FIGS. 8 and 9 detailed above, however, in another exemplary embodiment, there is a male threaded located at the bottom of the housing 1054, as can be seen in FIG. 11, and thus when the implantable subcomponent 1151 is attached to the implanted bone fixture, there is no bolt that extends from one side of the housing 1054 to the other side of the housing. It is noted that in an exemplary embodiment, the forces 801 can still be applied by pressing at the center of the housing 1054 after the subcomponent 1151 is completely or partially screwed into the bone fixture, thus oil canning/relieving the oil canning with respect to the top and bottom walls, and thus oil canning/relieving the oil canning of the sidewalls. That said, in an alternative embodiment, just prior to insertion/implantation, a surgeon or other healthcare professional can squeeze the implantable subcomponent 1151 again by applying a compressive force to locations at or about the center of the housing 1054. That said, as can be seen with respect to FIG. 11A, in an exemplary embodiment, the implantable subcomponent can include tangs 1166 that can be gripped by a forceps or tweezers or the like so as to apply an outward force 1101 so as to cause the sidewalls 1062 to move outward, thus moving the prongs 870 out of the indentations 872. It is noted that in at least some exemplary embodiments of the embodiments of FIGS. 7, 8, 9, and 10, these methods of moving the sidewalls can also be applied even though those configurations are configured for use with the bolt 880.

Figure 11A:
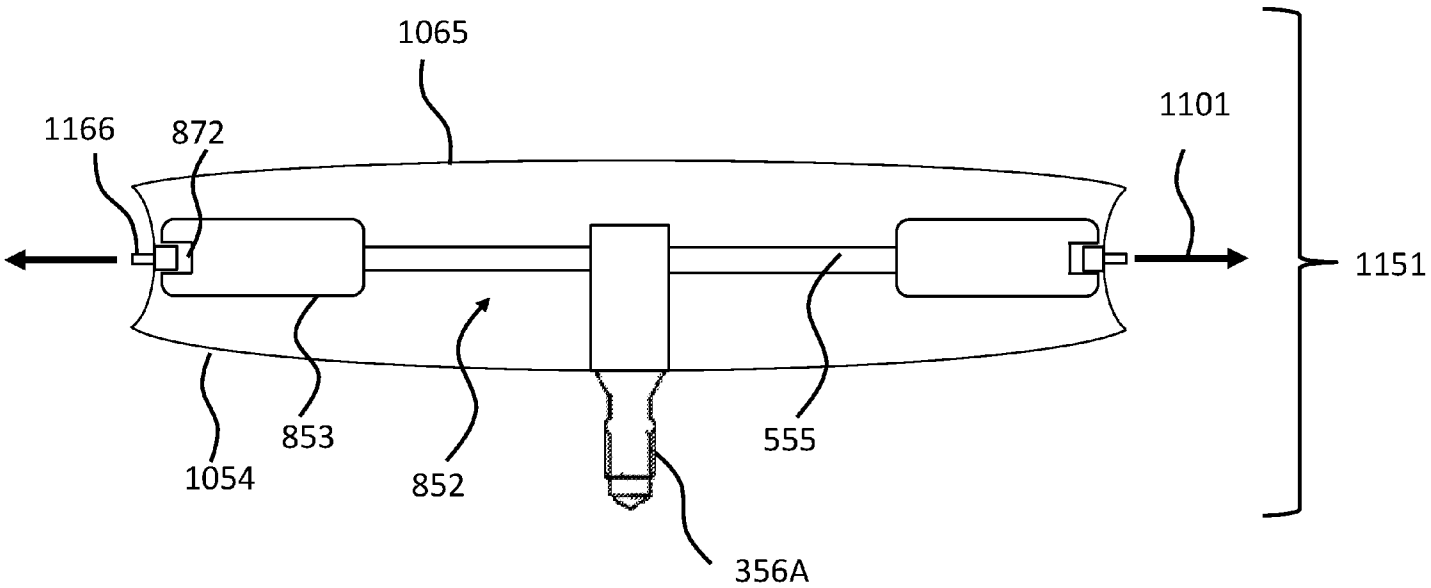
FIG. 11A is a schematic diagram of a cross-section of an exemplary embodiment that prevents the failure mode conceptually represented in FIG. 7.
Figure 11B:
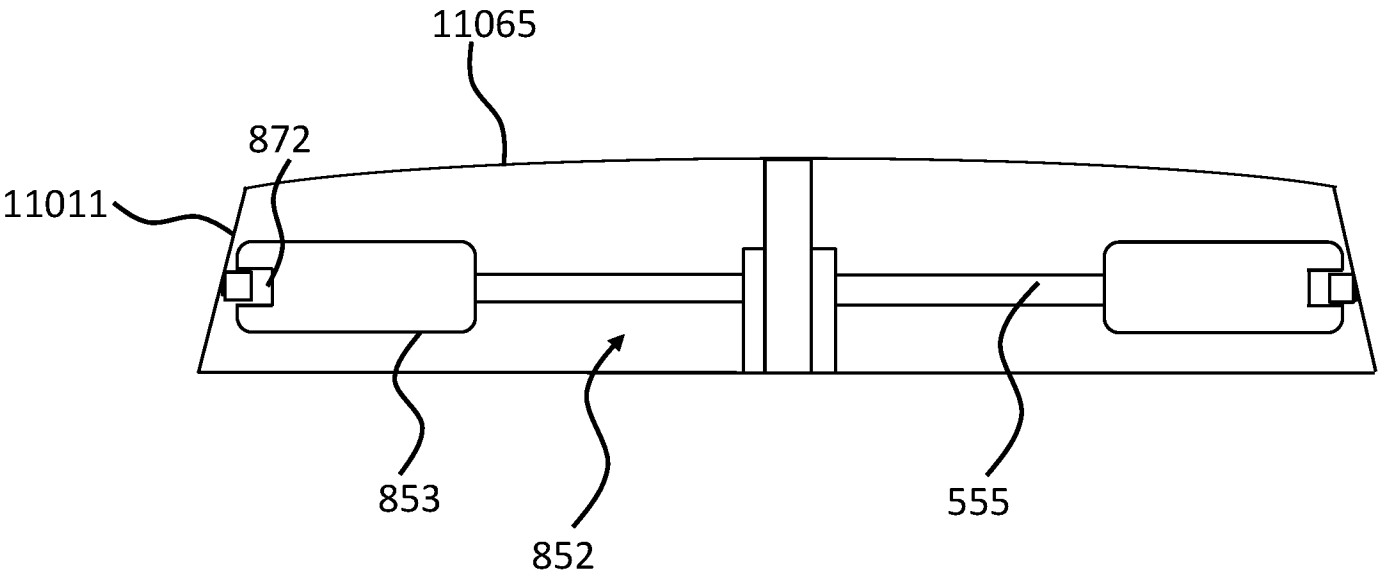
FIG. 11B is a schematic diagram of a cross-section of an exemplary embodiment that prevents the failure mode conceptually represented in FIG. 7.
Figure 11C:
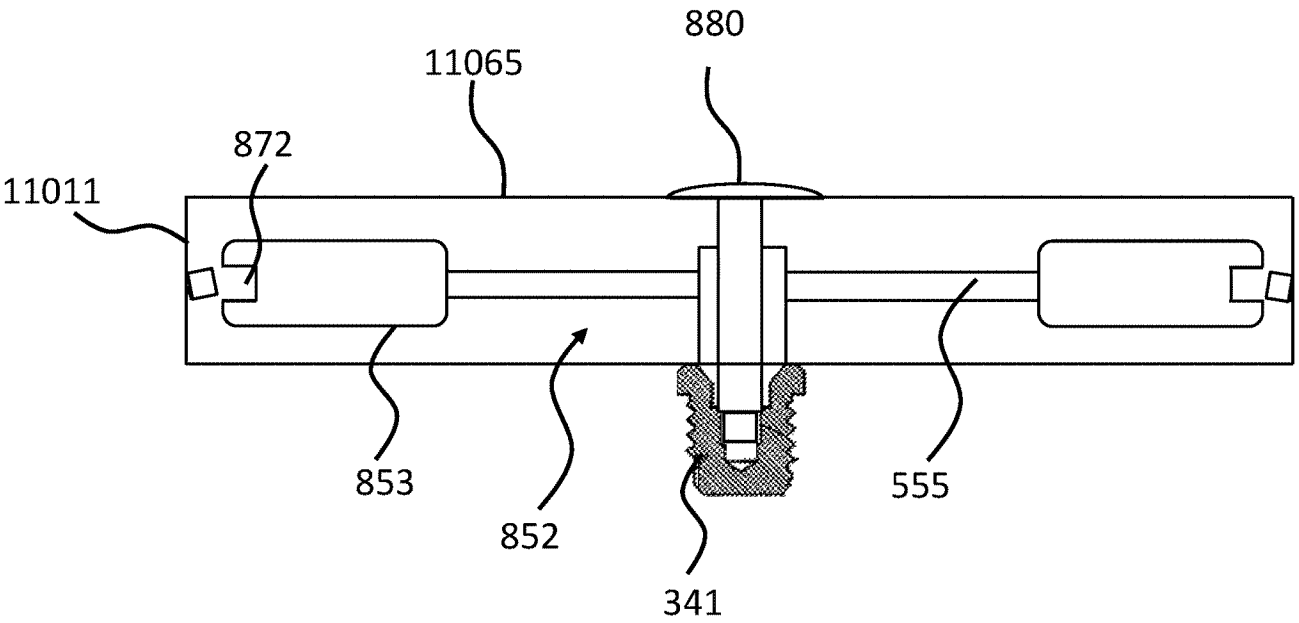
FIG. 11C is a schematic diagram of a cross-section of the exemplary embodiment of FIG. 11B where the shock-proofing has been disabled.

FIG. 11B depicts another exemplary embodiment where the top wall 11065 is curved, and the sidewalls 11011 are canted inward. As can be seen, the prongs are supported by the canted sidewalls 11011. In an exemplary embodiment, as the bolt is tightened on to the bone fixture, and the head provides a compressive force on to the top of the housing, the housing wall 11065, which is originally in the curved configuration, becomes straightened, and thus the ends thereof are extended in the outward direction. This results in an outward force that pushes the tops of the canted walls 11011 in the upward direction, thus moving the prongs out of the indentations 872, as can be seen in FIG. 11C.

Figure 11D:
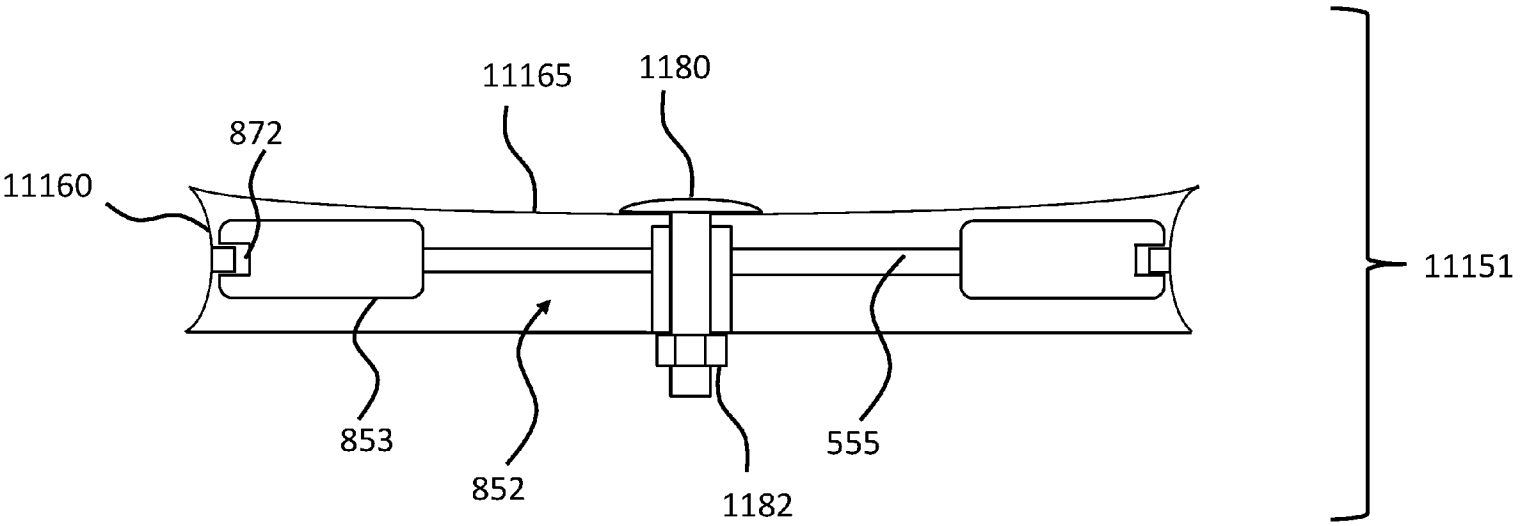
FIG. 11D is a schematic diagram of a cross-section of an exemplary embodiment that prevents the failure mode conceptually represented in FIG. 7.
Figure 11E:
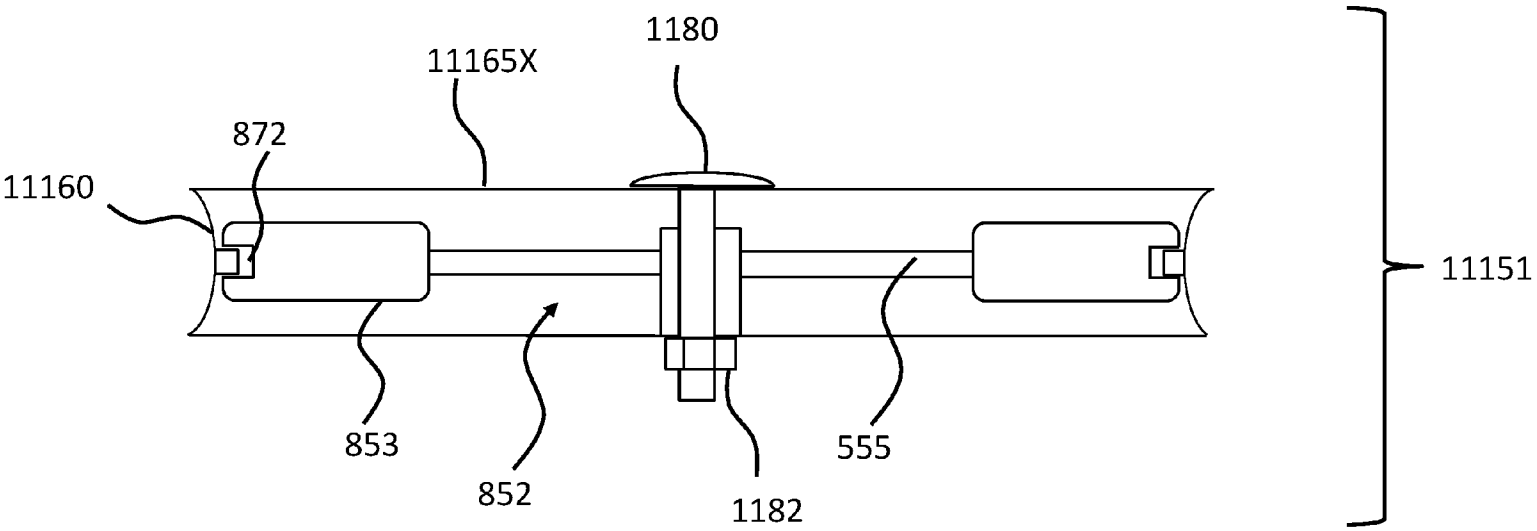
FIG. 11E is a schematic diagram of a cross-section of an exemplary embodiment that prevents the failure mode conceptually represented in FIG. 7.

FIG. 11D depicts another exemplary embodiment where, instead of applying a force so as to oil can/relieve oil canning of the housing so as to move a housing wall to move the prongs out of the indentations 872, in an alternate embodiment, the subcomponent already has a compressive force applied thereto which oil cans the housing to hold the prongs in the indentations 872. Upon release of the compressive force, the housing expands outward, thus permitting the prongs to be moved away from the indentations 872. More particularly, as can be seen, there is a subcomponent 11151, through which a bolt 1180 extends, which bolt is held in place by nut 1182. The nut is tightened a sufficient amount such that the head of the bolt 1180 pulls the top wall 11165 of the housing downward, which holds the sidewalls 11160 in the manner shown in FIG. 11D such that the prongs are located inside the indentations 872. In an exemplary embodiment, the subcomponent 11151 is obtained in this configuration prior to surgery. Just before surgery, a surgeon or other healthcare professional unscrews nut 1182, and removes bolt 1180, so that the housing wall 11165 can oil can, thus permitting sidewalls 11160 to also oil can outward, which removes the prongs from the indentations. Alternatively, in another principle of operation, such simply allows the entire top wall 11165 to move upwards, as is depicted in FIG. 11E where the top wall 1116X5 is not oil canning—i.e., the top wall 11165X is rigid, and the bolt 1180 pulls the entire wall downward, where the release of that bolt allows the wall 11165X top move upward in a uniform manner, and thus permit the side walls 11160 to bow outward. It is noted that the principles of operation of FIGS. 11D and 11E can be combined.

While the embodiments detailed above focus on utilizing a housing having housing walls that move or otherwise deform or otherwise are reconfigurable so as to move the locking components from a locked state to an unlocked state, some alternate embodiments are such that the walls of the housing remain in a static configuration with respect to the actions of unlocking the shock-proof apparatus. One such exemplary embodiment is depicted in FIG. 12, which depicts an exemplary implantable subcomponent 1251, which includes a housing 1254 in which is located and actuator 552 consistent with the teachings of FIG. 5. As can be seen, a locking apparatus 1270 in the form of a U-shaped component straddles the outer portions of the counterweight 553. The locking apparatus 1270 prevents the counterweight 553 from moving more than but a degree or two with respect to an oscillatory movement of the actuator, with respect to some exemplary embodiments, although in other exemplary embodiments, the locking apparatus 1270 prevents the counterweight 553 from moving by an amount less than a degree while in other embodiments, the locking apparatus 1270 prevents the counterweight 553 from moving more than 3 or 4 or 5 or 6 degrees. In an exemplary embodiment, the shock-proof apparatuses detailed herein, when engaged/when in the locked configuration, prevent tips of the counterweight 553 (the portions furthest from the longitudinal axis of the implantable subcomponent) from moving more than 0.001 degrees, 0.002, 0.003, 0.004, 0.005, 0.006, 0.007, 0.008. 0.009, 0.01, 0.011, 0.012, 0.013, 0.014, 0.015, 0.016, 0.017, 0.018, 0.019, 0.20, 0.021, 0.022, 0.023, 0.024, 0.025, 0.026, 0.027, 0.028, 0.029, 0.030, 0.035, 0.04, 0.045, 0.05, 0.055, 0.06, 0.065, 0.07, 0.08, 0.09, 0.1, 0.11, 0.12, 0.13, 0.14, 0.15, 0.175, 0.2, 0.25, 0.3, 0.35, 0.4, 0.45 or 0.5 degrees or any value or range of values therebetween in 0.001° increments. In an exemplary embodiment, the locking apparatus 1270 prevents the counterweights 553 from moving entirely, or at least the tips thereof from moving entirely. In an exemplary embodiment, during normal operation (or, in some alternate embodiments, during operation with the sine wave detailed herein), the counterweight 553 moves at most 1, 2, 3, 4, 5, 6 or 7 micrometers, with a 2 cm arm distance. In an exemplary embodiment, the movements are scaled linearly with increasing arm distance, and thus the above and below noted movement prevention values are scaled linearly as well.

In some embodiments, the locking apparatus 1270 prevents the counterweight 553 from moving more than but 10 micrometers with respect to an oscillatory movement of the actuator, although in other exemplary embodiments, the locking apparatus 1270 prevents the counterweight 553 from moving by an amount less 5 micrometers while in other embodiments, the locking apparatus 1270 prevents the counterweight 553 from moving more than 1 or 2 or 3 or 4 micrometers. In an exemplary embodiment, the shock-proof apparatuses detailed herein, when engaged/when in the locked configuration, prevent tips of the counterweight 553 (the portions furthest from the longitudinal axis of the implantable subcomponent) from moving more than 50 nm, 60 nm, 70 nm, 80 nm, 90 nm, 100 nm, 110 nm, 120 nm, 130 nm, 150 nm, 200 nm, 250 nm, 300 nm, 350 nm, 400 nm, 450 nm, 500 nm, 550 nm, 600 nm, 650 nm, 700 nm, 750 nm, 800 nm, 850 nm, 900 nm, 950 nm, 1 micrometer, 1.2, 1.3, 1.4, 1.5, 1.6, 1.7, 1.8, 1.9 2, 3, 4, 5, 6, 7, 8, 9, 10, 11, 12, 13, 14, 15, 16, 17, 18, 19, 20, 25, 30, 35, 40, 45, 50, 55, 60, 65, 70, 75, 80, 85, 90 or 100 micrometers from the static at rest position or any value or range of values therebetween in 10 nm increments. In an exemplary embodiment, the locking apparatus 1270 prevents the counterweights 553 from moving entirely, or at least the tips thereof from moving entirely.

In order to enable the implantable subcomponent 1251 to function as a transducer when implanted in a recipient, the locking apparatus 1270 is moved radially away from the longitudinal axis of the implantable subcomponent 1251, the results of which can be seen in FIG. 13. FIG. 13 represents the implantable subcomponent 1251 attached to a bone fixture 341 in a configuration such that it is an implantable component 1350 which includes the bone fixture 341 and the bolt 880 and is fully operational because the locking apparatus 1270 is located away from the counterweights 553.

In view of the above, it can be seen that in an exemplary embodiment, there is an implantable component, such as implantable component 1350, that includes a movable brace, such as the locking apparatus 1270, that prevents the transducer 552 from moving inside the housing 1254. In at least some of these exemplary embodiments, the movable brace 1270 is movable from outside the housing when the housing is completely sealed with the transducer 552 and the brace 1270 therein to enable the transducer 552 move relative to the housing. In this regard, it is noted that in at least some exemplary embodiments, the housing 1254 establishes a hermetic seal with respect to the outside environment of the housing 1254. Accordingly, there can be utilitarian value with respect to the embodiments detailed herein that enable the shock-proof apparatus to be unlocked without breaching or otherwise disrupting the hermetic seal of the housing 1254. In this regard, it is noted that in at least some exemplary embodiments, any or all of the method actions detailed herein are practiced with a hermetically sealed housing containing the actuator 552. Thus, with respect to the embodiments that are utilized to temporarily shock-proof the transducer—seismic mass assembly, the teachings detailed herein, with respect to some embodiments, enable the assembly to be taken out of the shock-proofing while the assembly is hermetically sealed within the housing to enable the assembly to vibrate (e.g., such as when a current is applied to the piezoelectric material so as to cause the assembly to vibrate and thus evoke a hearing percept via bone conduction).

Figure 14A:
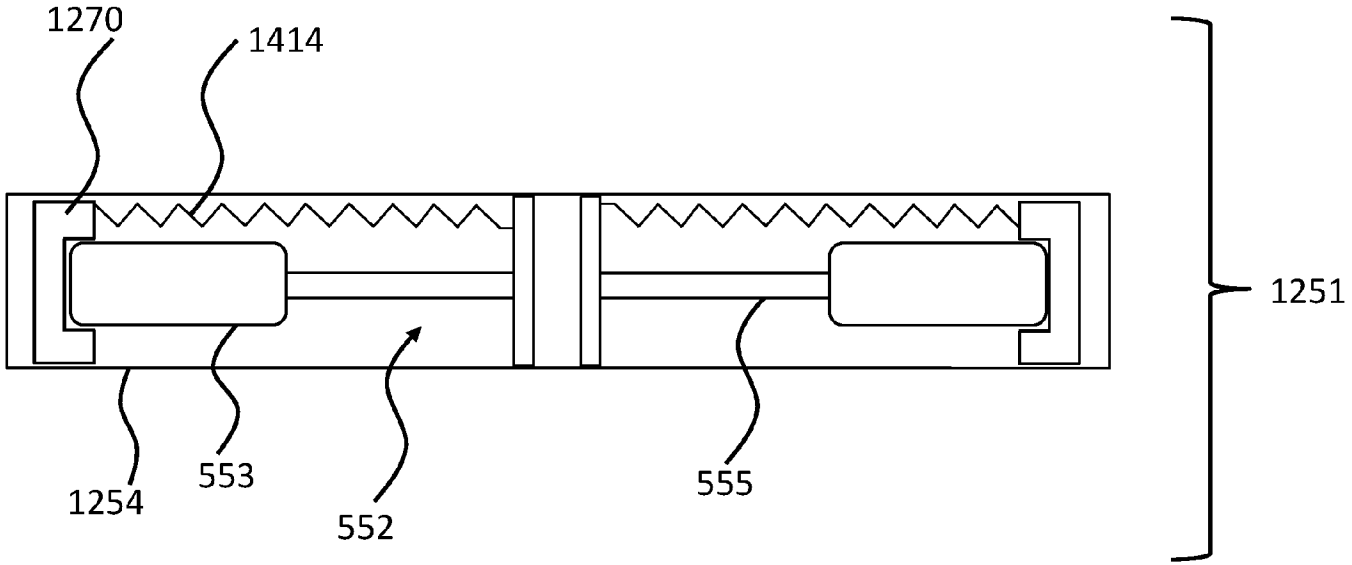
FIG. 14A is a schematic diagram of a cross-section of an exemplary embodiment that prevents the failure mode conceptually represented in FIG. 7.

In an exemplary embodiment, the locking apparatus 1270 can be spring loaded the like, as can be seen in the embodiment of FIG. 14A. In an exemplary embodiment, detents can be present on the inside of the housing 1254 such that upon a relatively minor acceleration to the implantable subcomponent 1251, such as can be provided by hand by the surgeon or other healthcare professional just prior to attachment of the subcomponent 1251 to the bone fixture, the interference fit established by the detents can be overcome, and the spring 1414 can push the locking apparatus 1270 away from the counterweight 553, thereby unlocking the shock-proof apparatus. Thus, it is to be understood that in some exemplary embodiments, there is an implantable component that includes a spring-loaded component (e.g., 1270) that prevents the transducer from moving inside the housing when at a first position (a first position of the spring loaded component—the position of FIG. 14), and enable the transducer to move relative to the housing when at the second position (a second position of the spring loaded component—a position where the components 1270 are located at an outboard position relative to that which is seen in FIG. 14A).

Figure 14B:
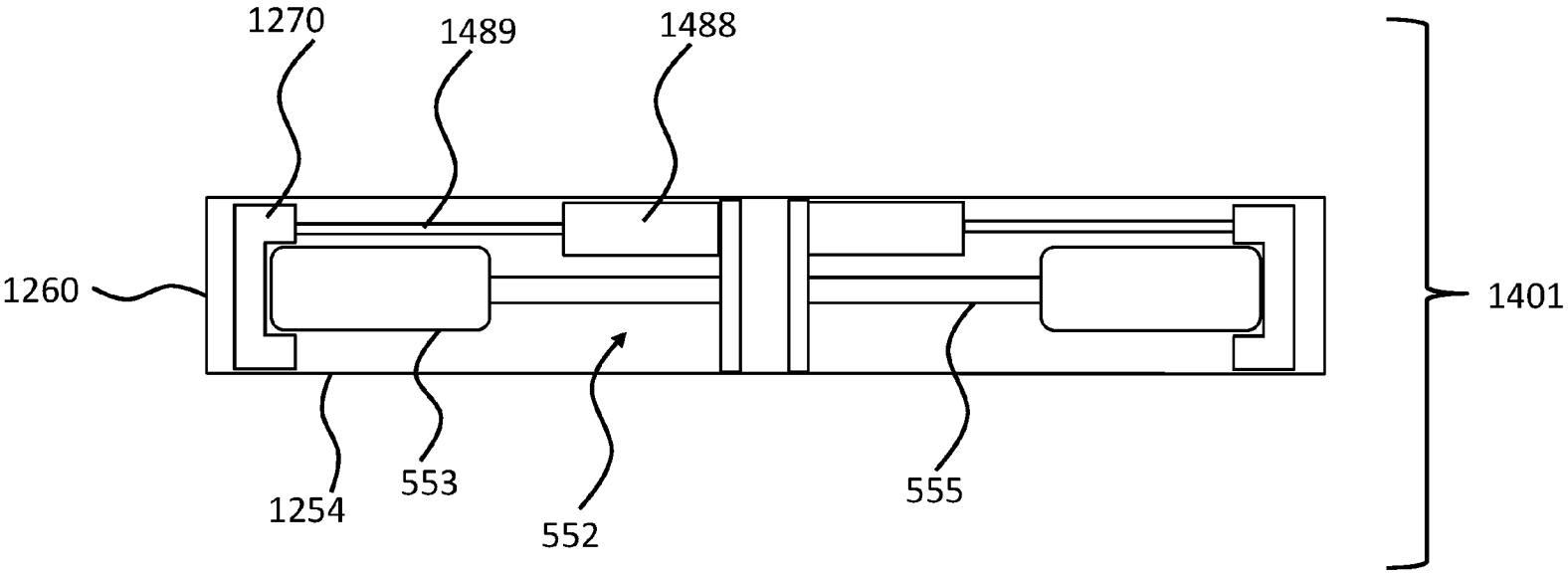
FIG. 14B is a schematic diagram of a cross-section of an exemplary embodiment that prevents the failure mode conceptually represented in FIG. 7.

FIG. 14B presents another exemplary embodiment that utilizes an electrically powered actuator 1488 to move the locking apparatus 1270 from the inboard position to the outboard position. In this regard, the feedthroughs that are utilized to provide an electrical signal to the piezoelectric material 555 can also be utilized to provide an electrical signal to the actuator 1488, although in other embodiments, another feature can be utilized. The application of an electrical signal to the actuators 1488 causes the piston 1489 to extend outward, thus pushing the locking apparatus 1270 towards the outboard position so as to provide clearance for the counterweight 553 to move. The embodiment of FIG. 14B can have utilitarian value with respect to enabling the "re-shock-proofing" of the implantable component 1401 at a later date, such as weeks and/or months after implantation/after the shock-proofing has been disengaged. In this regard, in an exemplary embodiment, the external device 440 can provide a signal to the implanted receiver, which can provide a signal to the implantable component 1401 to actuate the electromechanical actuators 1488 after implantation. (Additional details of this are provided below.)

In at least some exemplary embodiments, the actuators 1488 are EM actuators, while in other embodiments, the actuators are piezoelectric actuators. Any type of actuator that can enable the teachings detailed herein, whether such be present for utilization in a one instance scenario (e.g., only to take the device out of the shock-proofing configuration, never to place the device back into shock-proofing configuration), or such be present for utilization a plurality of times and be utilized in at least some exemplary embodiments.

Note that while the embodiments detailed herein have focused on the utilization of an electrical signal from outside the housing 1254 (e.g., by way of a feedthrough) to power the actuators 1488, in an alternative embodiment, a capacitor or battery or the like can be located inside the housing 1254. This capacitor or battery can have charge sufficient for only one or two actuations of the actuator 1488 sufficient to actuate the actuator 1488 (e.g., at the time of implantation and/or proximate thereto). In an exemplary embodiment, prior to implantation, an electrical current can be applied to the feedthrough to energize the capacitor or battery. That said, in an alternate embodiment, prior to implementation, an electrical current can be applied to the feedthrough to actuate the actuator 1488. By way of example, the same feedthrough that is utilized to actuate the piezoelectric material 555 can be utilized to actuate the actuator 1488. In an exemplary embodiment, the electrical current can be applied at a frequency that does not affect the piezoelectric material (e.g., owing to some form of switch or the like or other circuitry located inside the housing 1254 that diverts the current at a given frequency to the actuator 1488 instead of the piezoelectric material 555). In an exemplary embodiment, the electrical current can be applied to both the piezoelectric material and the actuator 1488 at the same time, wherein the piezoelectric material 555 will deform according to operation of the transducer 552 while at the same time the actuators 1488 will actuate to push the locking apparatus 1270 towards the outboard position. In an exemplary embodiment, the actuators can be designed so that upon full extension, a switch is tripped that stops electricity from being provided to the actuators 1488 thereafter, so that all future current applied to the feedthrough is directed towards the piezoelectric material 555 (instead of being shared during the period of time where the shock-proofing is disabled).

Note also that in another embodiment, the actuator 1488 and/or circuitry thereof can be configured so as to react to only current at a certain frequency. For example, the bone conduction device will generally not have utilitarian value with respect to frequencies above 20,000 Hz (e.g., the upper range of human hearing). Accordingly, in an exemplary embodiment, an electrical current can be provided via the feedthrough at a frequency that operates the piezoelectric material 555 so that the actuator 552 vibrates at, for example, 22,000 Hz or 25,000 Hz or 30,000 Hz, etc. (e.g., a meaningless vibration with respect to evoking a hearing percept). However, that current can be shared by the actuators 1488, which only react to electrical current at those frequencies. That is, at frequencies of the electrical current applied to the piezoelectric material that will cause the transducer 552 to vibrate at frequencies below 20,000 Hz, the actuators would not operate/would not respond to such current. Note also that in an exemplary embodiment, the current applied to the feedthroughs could have a digital and/or an analog code embedded therein, such that the presence of a certain code enables circuitry inside the housing 1254 to activate the actuators.

It is noted that the various embodiments that utilize an electrical current supplied by a feedthrough in the housing 1254 can be utilized in some embodiments such that the shock-proofing can be engaged and/or disengaged after implantation of the implantable component and the recipient, including scenarios where the shock-proofing is engaged for a period of time after it has been disengaged in a scenario where the recipient is going to be subjecting himself to a scenario of potential shock to the implanted component (e.g., playing basketball, where a ball could hit the side of the recipient's head, and thus cause a failure mode with respect to the piezoelectric material 555), and then subsequently re-disengaged. Some additional details of this are described below. However, it is noted that in an exemplary embodiment, a signal can be provided from the external device 440 to the implanted receiver coil 456 which in turn can provide the current to the feedthrough into the housing that contains the actuator 1488, etc.

Note also that in at least some exemplary embodiments, a separate EM coil can be located in the housing 1254 that is dedicated to powering or otherwise energizing the actuators 1488. In this regard, an exemplary configuration can be such that upon the application of a transcutaneous electromagnetic field to this separate EM coil in the housing 1254, a current is induced in that separate EM coil which is sufficient to power the actuators. In an exemplary embodiment, this separate EM coil can react to a completely different frequency than that which is generated by the external device so as to avoid a scenario where the external device accidentally triggers the shock-proofing apparatus to disengage or engage. That said, in an alternate embodiment, such as a scenario where the shock-proofing apparatus is a one-off use, the separate EM coil in the housing 1254 can be configured such that when the external device 440 is placed in proximity to that coil for a given period of time (e.g., 5 minutes), sufficient current will be generated to actuate the actuators 1488. The shock-proof apparatus can be arranged such that additional current that is applied thereto has no effect on the actuators. It is further noted that such techniques can be utilized to charge an implanted capacitor and/or battery so as to enable and/or disable the shock-proofing apparatus via actuation of the actuators utilizing the charge in the capacitor and/or battery.

Embodiments have focused on utilizing an electrical current to actuate the actuator 1488/to provide power to move the locking apparatus 1270. However, in an alternate embodiment, the electrical current can be applied to a component that unlocks a component that holds the locking apparatuses in place. For example, in a scenario where the locking apparatuses 1270 are spring-loaded, electricity can be applied to an actuator that releases its hold on the locking apparatuses 1270, allowing them to spring outwards and thus disengage the shock-proofing. In this regard, the teachings detailed herein with respect to providing power to the internal actuators to move the locking apparatuses 1270, etc. can also be applied to such embodiments to unlock or otherwise release a component that holds the locking apparatuses 1270 in place.

Figure 15:
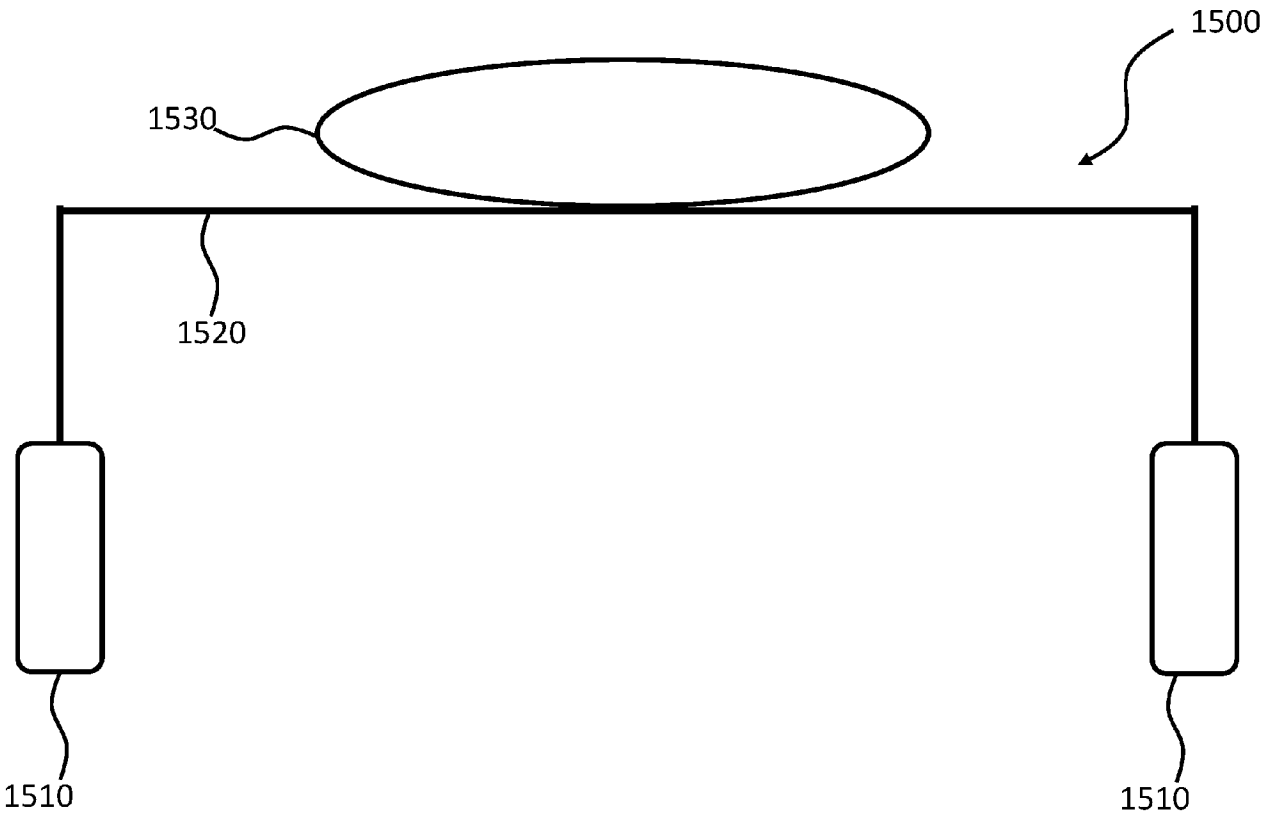
FIG. 15 is a schematic diagram of a tool that can be utilized to control a shock-proofing apparatus according to an exemplary embodiment.
Figure 16A:
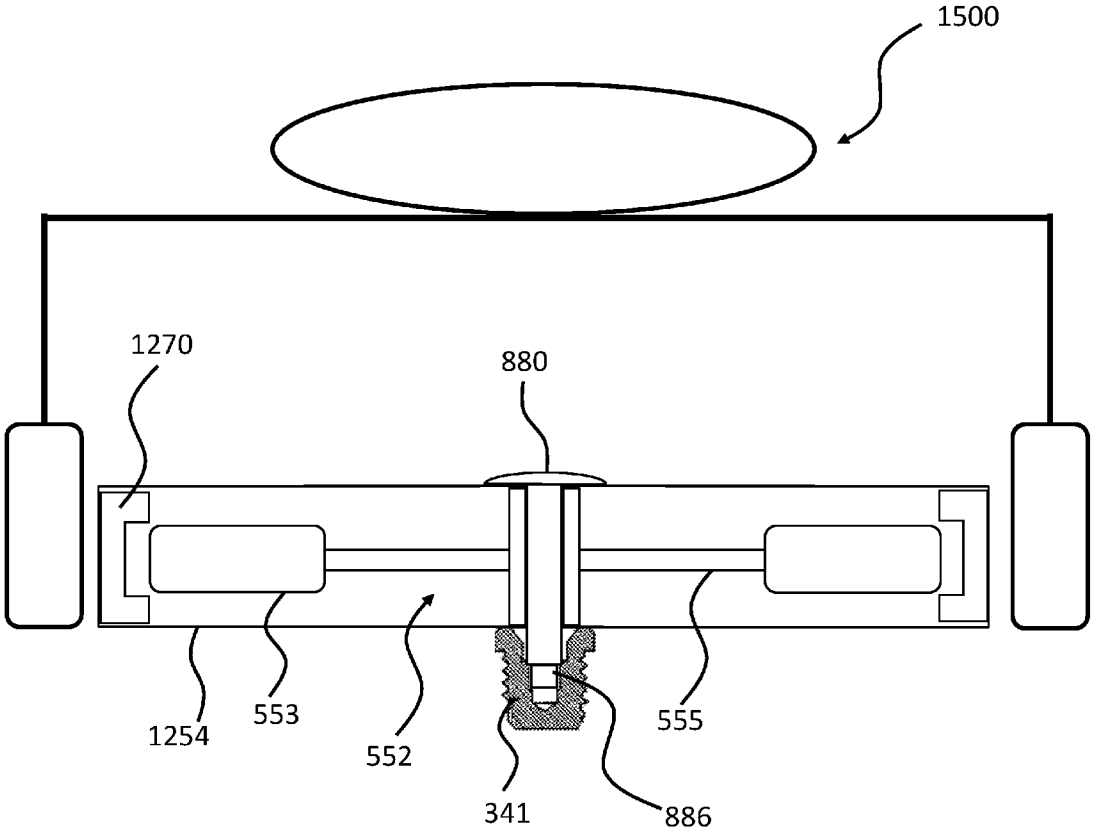
FIG. 16A depicts the tool of FIG. 15 in use.

In an alternative embodiment, a magnetic field or the like can be utilized to move a sub-component made at least in part of a ferromagnetic material that reacts to a magnetic field of the locking apparatus 1270 out of the way of another subcomponent of the locking apparatus 1270, thereby releasing the locking apparatus 1270 to move outward away from the longitudinal axis of the subcomponent 1251 as a result of a force applied by spring 1414. To this end, FIG. 15 depicts an exemplary tool 1500 that is configured so as to impart a magnetic field on to the implanted subcomponent so as to pull or otherwise move the locking apparatus 1270 from the locked position to the unlocked position. Particularly, tool 1500 includes two magnets 1510 (although in other embodiments, only a single ring magnet 1510 is utilized) connected to each other by a support structure 1522 which handle 1530 is attached. After the implantable subcomponent is attached to the bone fixture that is implanted in the recipient, the tool 1500 is placed as shown in FIG. 16A, where the magnets 1510 apply a magnetic force to the locking apparatus 1270, thereby pulling the locking apparatus 1270 to the outboard positions. It is noted that the utilization of a magnetic field can be utilized with the embodiment utilizing a spring 1414 or the like or with embodiments that permit the locks 1272 be located depending on the presence or absence of a magnetic field. In this regard, in an exemplary embodiment, a very slight interference fit can be present between the locking apparatus 1270 and the counterweight 553 when the locking apparatus 1270 is in the locking position. Upon the application of the magnetic field, a sufficient force is applied to the locking apparatus 1270 so as to overcome the slight interference fit, and thus pull the locking apparatuses away to the outboard locations. As will be detailed in greater detail below, in an exemplary embodiment, the subcomponent can include an apparatus located inside the housing 1254 that will lock the locking components 1270 in the unlocked position.

In view of the embodiment of FIG. 16A, it is to be understood that in an exemplary embodiment, there is an implantable component, which implantable component includes a ferromagnetic material that at least indirectly prevents the transducer from moving inside the housing, wherein the implantable component is configured such that exposure of the ferromagnetic material to a magnetic field moves the ferromagnetic material to enable the transducer to move relative to the housing.

Figure 17:
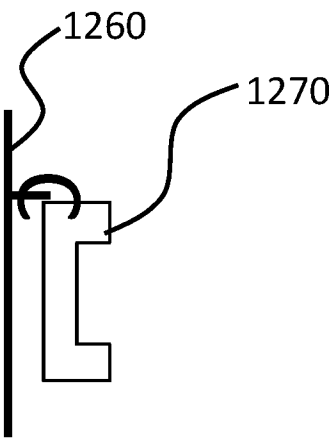
FIGS. 16B and 17 depict an exemplary use of a lock that locks the locking apparatus in place.
Figure 16B:
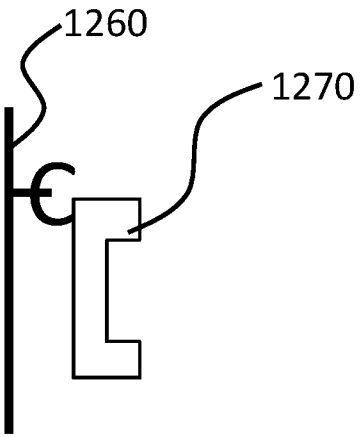

Still further, in an exemplary embodiment, instead of the spring 1414 being in compression with respect to the embodiment seen in FIG. 14A, the spring 1414 is in tension. Thus, magnets can be placed on the outside of the housing 1254 to move or otherwise pull the locking apparatus 1270 against the force of the spring 1414 two locations outboard of the locations depicted in FIG. 14A. An internal component inside the housing 1254, such as an adhesive and/or a ball detent system, or another type of detent system, can lock the locking apparatus 1270 in place at the outboard locations. A spring loaded trap can be located in the housing that snaps down on the locking apparatus 1270 when the locking apparatus 1270 reaches the outboard location. It is noted that the spring loaded trap can utilize a compressive force and/or can utilize a positive interference to trap or otherwise hold the locking apparatus 1270 and the outboard locations. An exemplary positive retention device can be a C hook that rotates 90° upon movement of the locking apparatus 1270 towards the side wall 1260, such as depicted in FIG. 16B and FIG. 17, where one of the ends of the C fits into a hole at the top of the locking apparatus 1270, thus positively retaining the locking apparatus at the unlocked position.

Figure 18:
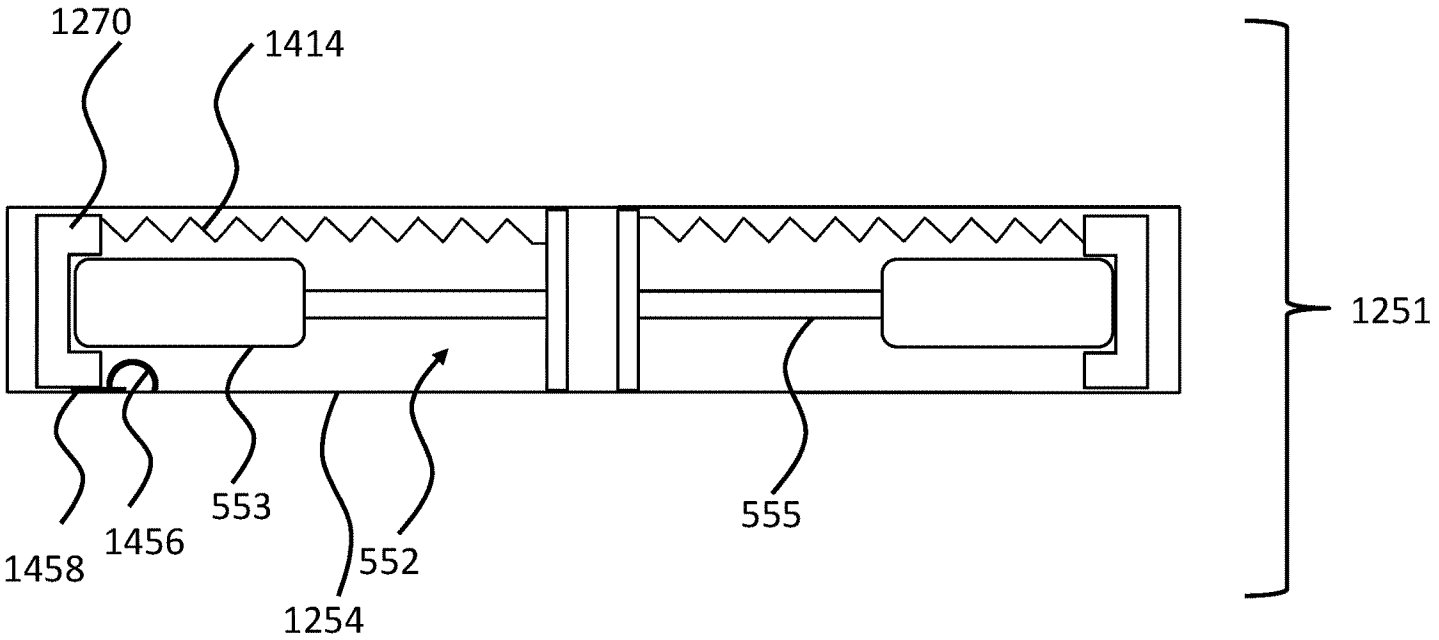
FIGS. 18 and 19 depict an exemplary embodiment of the locking apparatus prior to locking the locking component and after locking the locking components, respectively
Figure 19:
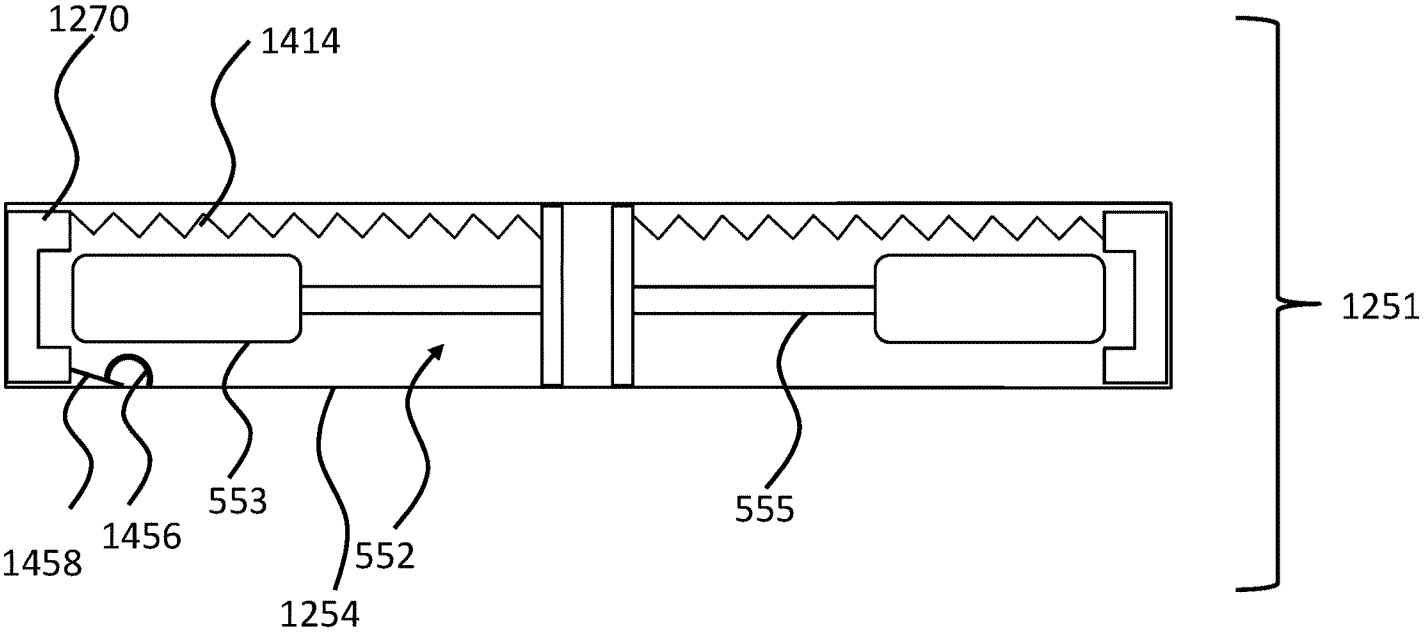

FIG. 18 depicts another exemplary embodiment of a positive retention device, which includes spring 1456 and lock arm 1458. FIG. 18 depicts the locking apparatus 1270 and the locked position. Locking apparatus 1270 "traps" the lock arm 1458 in the downward position, where spring 1456 is in the extended state. Upon the application of the magnetic force to the outside of the subcomponent 1251, the locking apparatus 1270 is pulled to the outboard positions. This moves the locking apparatus 1270 away from the lock arm 1458, allowing the spring 1456 to contract, and thus raise lock arm 1458 upwards, as can be seen in FIG. 19, where one end of the lock arm is hingedly fixed to the bottom of the housing 1254. The lock arm thus prevents the locking apparatus 1270 from moving in board after the magnetic field is removed.

Still further, in an alternative embodiment, the housing 1254 can be deformable or the like. In an exemplary embodiment, while the magnetic force is applied to the subcomponent 1251, and the locking apparatus 1270 is located in the upper positions, a pressure or force can be applied to the outside of the housing 1254, deforming the housing slightly such that portions of the housing on the inside thereof or other componentry located on the inside of the housing is pushed inward, thus trapping the locking apparatus 1270 and the outboard position. This can be considered analogous to a staking method of securing a bearing or a bushing or the like inside a housing.

Figure 20:
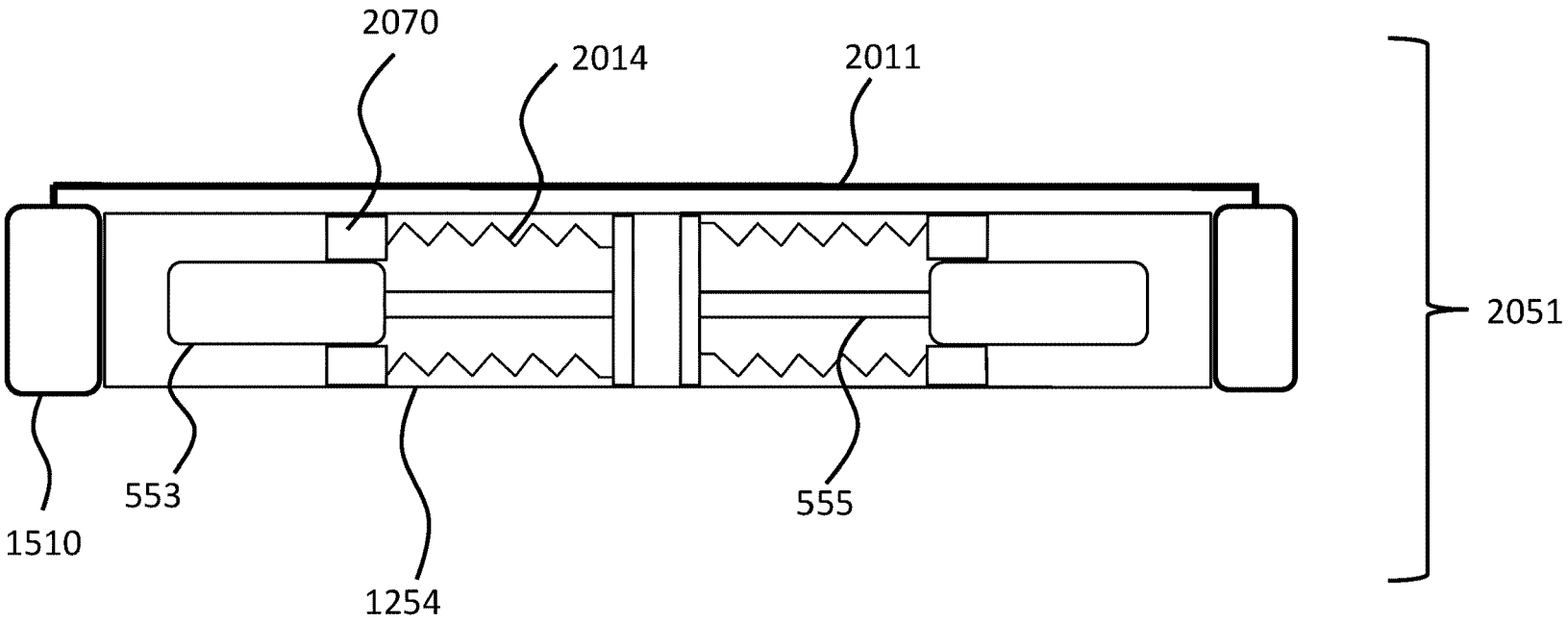
FIG. 20 depicts an exemplary magnet arrangement that is utilized to enable the shock-proofing apparatus.

While the embodiments detailed above have generally focused on utilizing a magnetic field at the point of implantation so as to move the locking apparatus to the unlocked position, in an alternate embodiment, the magnetic field is utilized to maintain the locking apparatus in the locked position, and removal of the magnetic field causes the locking apparatus to move to the unlocked position. In this regard, FIG. 20 depicts an exemplary assembly 2051, which includes an implantable subcomponent 2151 (see FIG. 21) and an external magnetic field generator 2011 that includes magnets 1510. The magnets exert a magnetic field on to the implantable subcomponent 2151, which magnetic field applies an attraction force to the locking components 2070, which can be made of or otherwise can contain, in an exemplary embodiment, a ferromagnetic material. The locking components 2070 are attached to a spring 2014, which spring is in tension as depicted in FIG. 20. Thus, the magnets 1510 stretch the spring 2014 against the force of the spring, where the spring applies a force such that the locking components 2070 are pulled inward. In this exemplary embodiment, the magnetic force generated by the magnets 1510 is such that the force of the spring is overcome at least by an amount that maintains the locking components 2070 between the housing 1254 and the counterweight 553, as can be seen. Thus, in the configuration of FIG. 20, the actuator 552 is in the locked position because the locking components 2070, which can be blocks of rubber or silicon or the like in which is embedded a ferromagnetic material) is located in between the counterweight 553 and the housing 1254. In an exemplary embodiment, upon the removal of the magnetic force generating device 2070, such as by way of example and not by way of limitation, immediately before attachment of the implantable subcomponent 2151 to the bone fixture, and/or immediately after the attachment of the implantable subcomponent 2151 to the bone fixture (e.g., in an exemplary embodiment, there can be a hole through the superstructure that holds the magnets 1510 relative to each other so that the bolt 880 and the installation tool utilized to apply torque to the bolts 880 can fit through the magnetic force generating device 2010, such that after the implantable subcomponent 2151 is secured to the bone fixture, the magnetic force generating component can be removed, thus removing the magnetic field, and allowing the springs to contract to the state that can be seen in FIG. 21, where the locking components 2070 are located away from the space between the counterweight 553 and the housing wall 1254.

In view of FIG. 20, it is to be understood that in at least some exemplary embodiments, there is a bone conduction device where a component thereof includes a ferromagnetic material that at least indirectly prevents a seismic mass-transducer assembly from moving inside a housing of that component. This component is configured such that exposure to the ferromagnetic material to a magnetic field locates the ferromagnetic material at a location where the assembly cannot move relative to the housing (thus shock-proofing the assembly, at least in some exemplary embodiments). This component is further configured such that removal of the ferromagnetic material from the magnetic field locates the ferromagnetic material at a location where the assembly can move relative to the housing.

Figure 21:
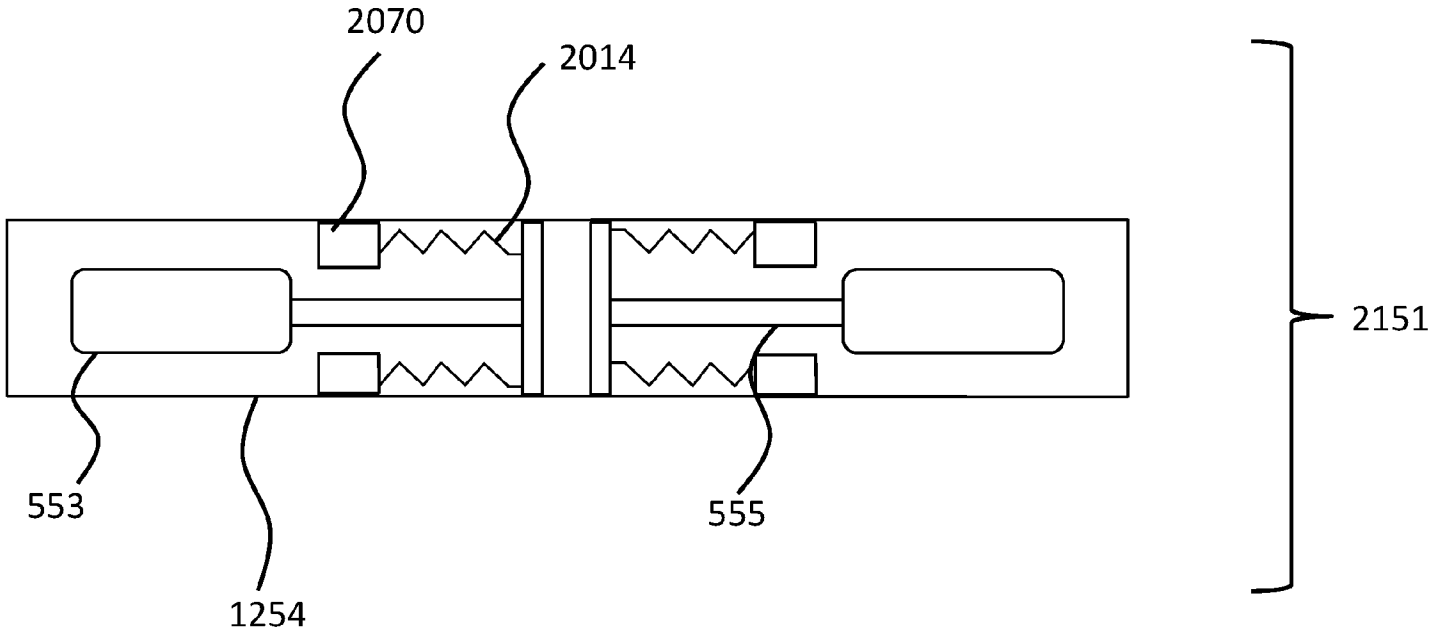
FIG. 21 depicts the results of removing the exemplary magnet arrangement of FIG. 20 from the implantable component.

While the embodiments of FIGS. 20 and 21 concentrate on the utilization of a magnetic field so as to maintain the locking components 2070 in the locked position, it is to be understood that in an alternative embodiment, other techniques can be utilized, such as by way of example only and not by way of limitation, the detent system detailed above and/or by shaking the subcomponent 1251 or otherwise applying a very limited acceleration to the subcomponent 1251, to overcome a locking device that maintains the locking components in the lock state. In an exemplary embodiment, the housing can be flexed inward or otherwise deformed so as to unlock the locking components. Indeed, by way of example only and not by way of limitation, a reverse oil canning technique can be implemented, where, with reference to FIG. 11A, instead of applying a tensile force 1101 as represented in the figure, a compression force in the opposite direction is applied to the outer side walls of the housing 1254, thereby forcing the upper and bottom walls of the housing outward (to oil can outward). In an exemplary embodiment, a tang or the like can be located inboard of the locking components 1270 and attached to the top and bottom walls, whereby upon the movement of the top and bottom walls of the housing away from the center, the tang is lifted away from an interfacing surface of the locking components 2070, thus permitting the locking components 2072 spring towards the center.

Figure 22:
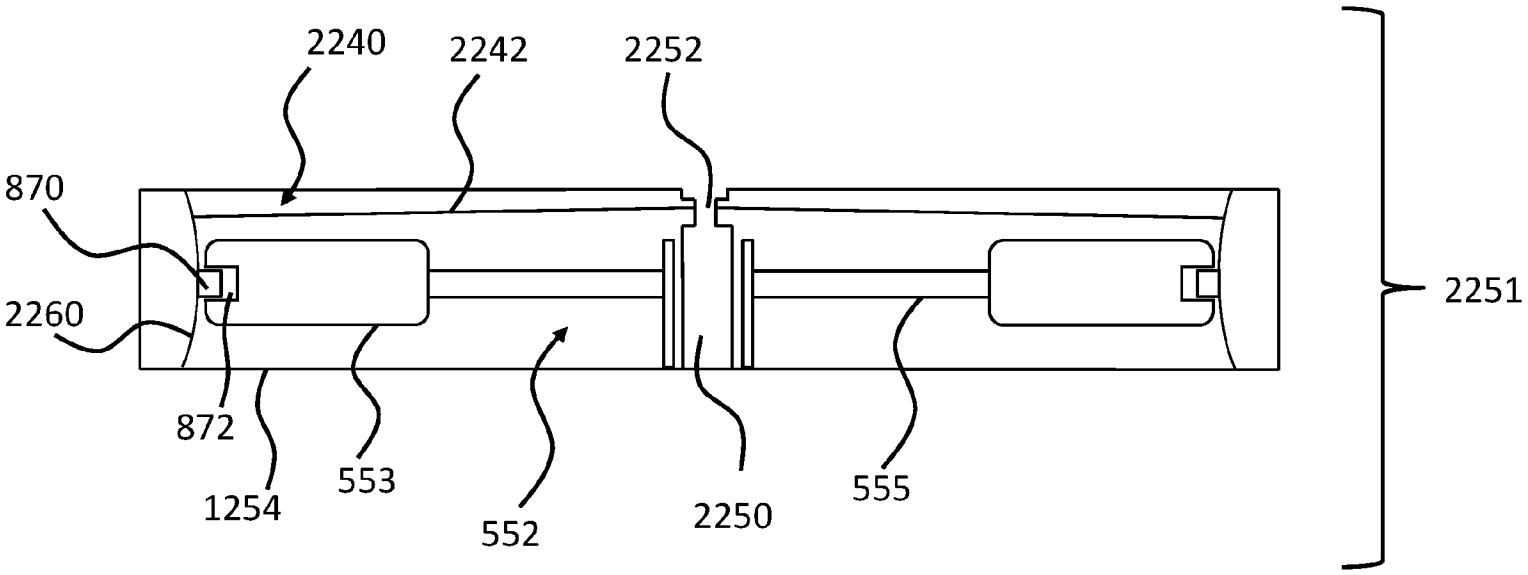
FIG. 22 is a schematic diagram of a cross-section of an exemplary embodiment that prevents the failure mode conceptually represented in FIG. 7.
Figure 23:
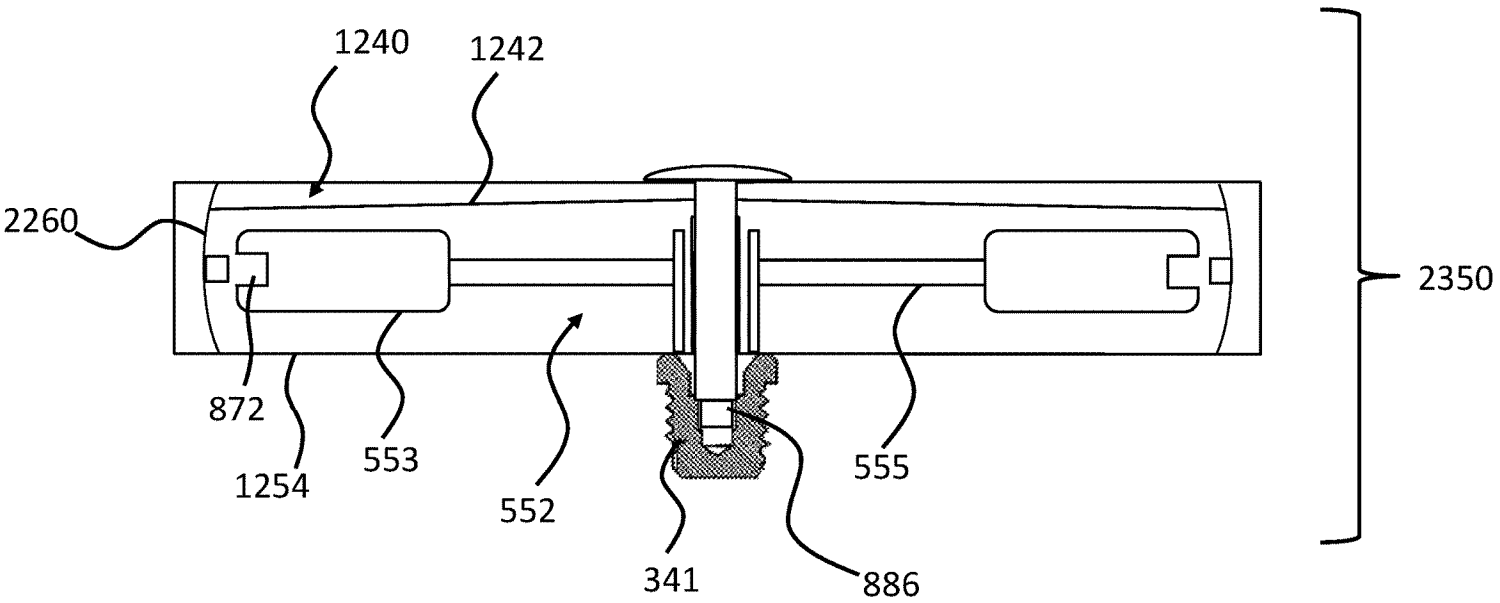
FIG. 23 depicts the embodiment of FIG. 22 in the configuration where the shock-proofing is disabled.

It is noted that various features of various embodiments detailed herein can be combined with one another. With respect to the embodiments utilizing a rigid housing/a housing that does not deform during implantation, a sub housing or an interior housing that the forms can be utilized so as to implement the features of the deformable housing. In this regard, there can be utilitarian value with respect to utilizing a rigid housing that does not deform with respect to maintaining a hermetic seal inside and/or with respect to maintaining shock-proofing with respect to temporal periods subsequent implantation where the recipient's head might be struck by an object (e.g., such as a scenario where the recipient is playing basketball the like). In this regard, FIG. 22 depicts an exterior housing 1254 that is relatively rigid, and an interior housing 2240, that includes a top wall 2242 and a side wall housing 2260, that is configured to deform upon an application of a force thereto. Still with reference to FIG. 22, the channel 2254 the bolts 880 includes a construction 2252 such that when the bolts is passed through the construction 2252, that portion of the implantable subcomponent 2251 deforms, thus applying a force onto the sidewall 2260, forcing the sidewall to bow outwards, and thus moving the prong 870 away from the indentation 872, as can be seen in FIG. 23, representing implantable component 2350 utilizing the subcomponent 2251 of FIG. 22.

Figure 24:
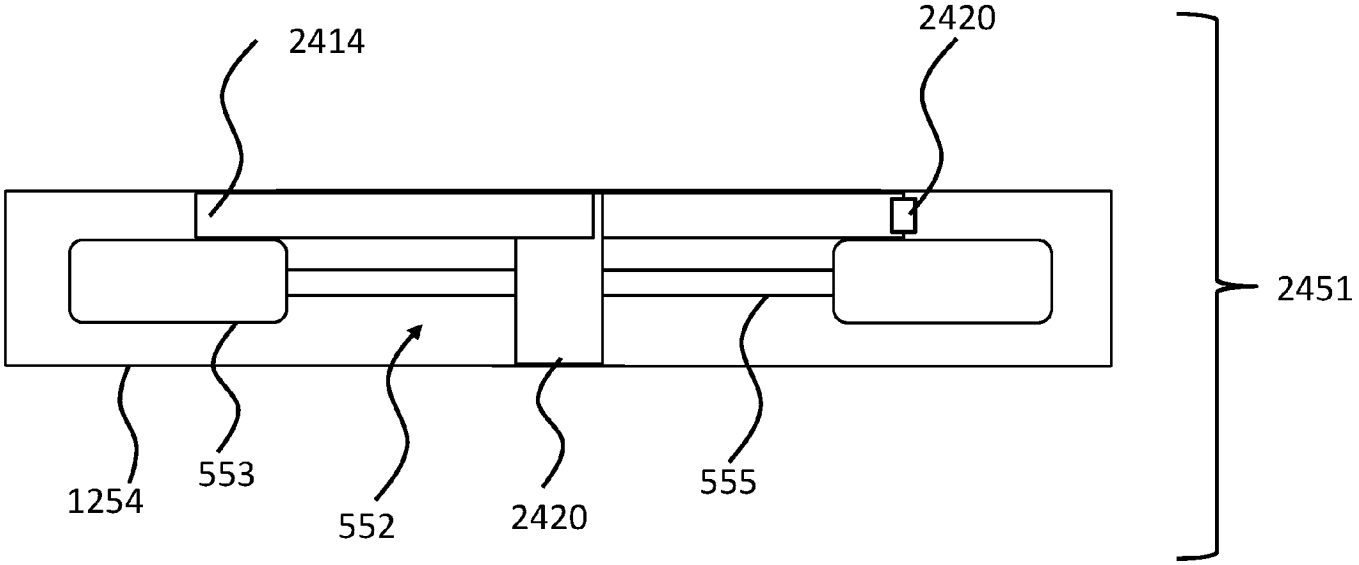
FIGS. 24 and 25 are schematic diagrams of an exemplary embodiment that prevents the failure mode conceptually represented in FIG. 7.
Figure 25:
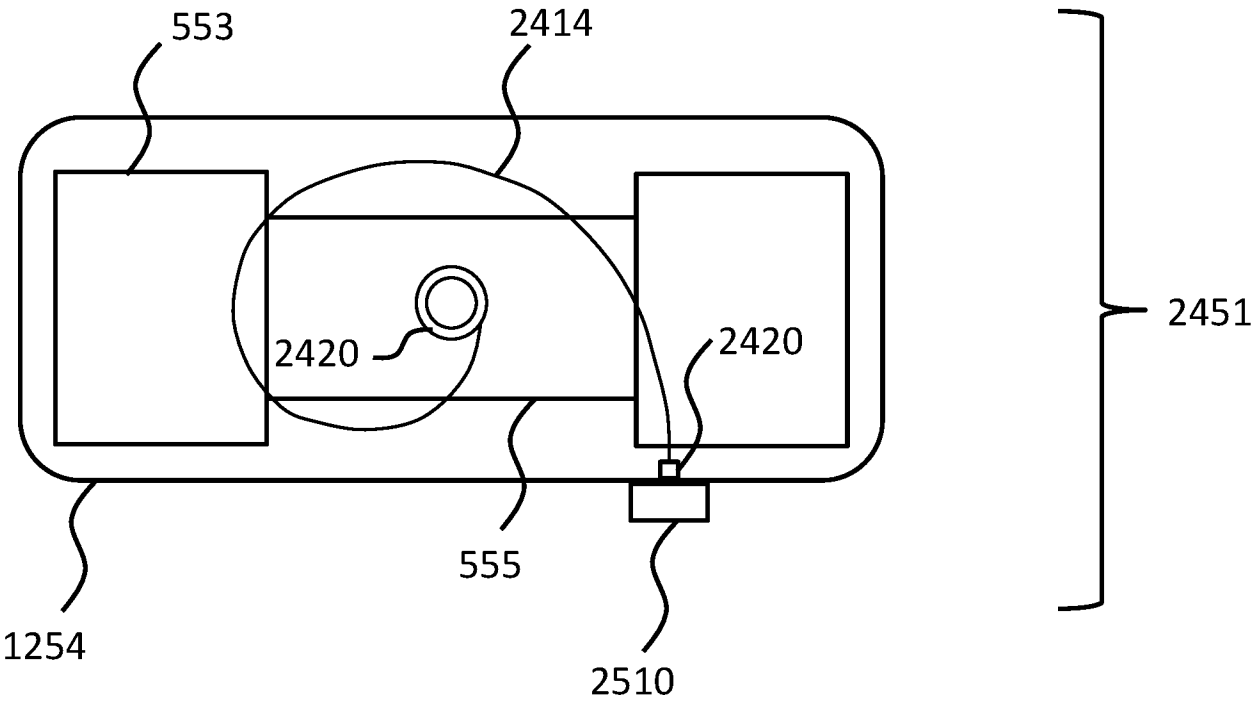
Figure 26:
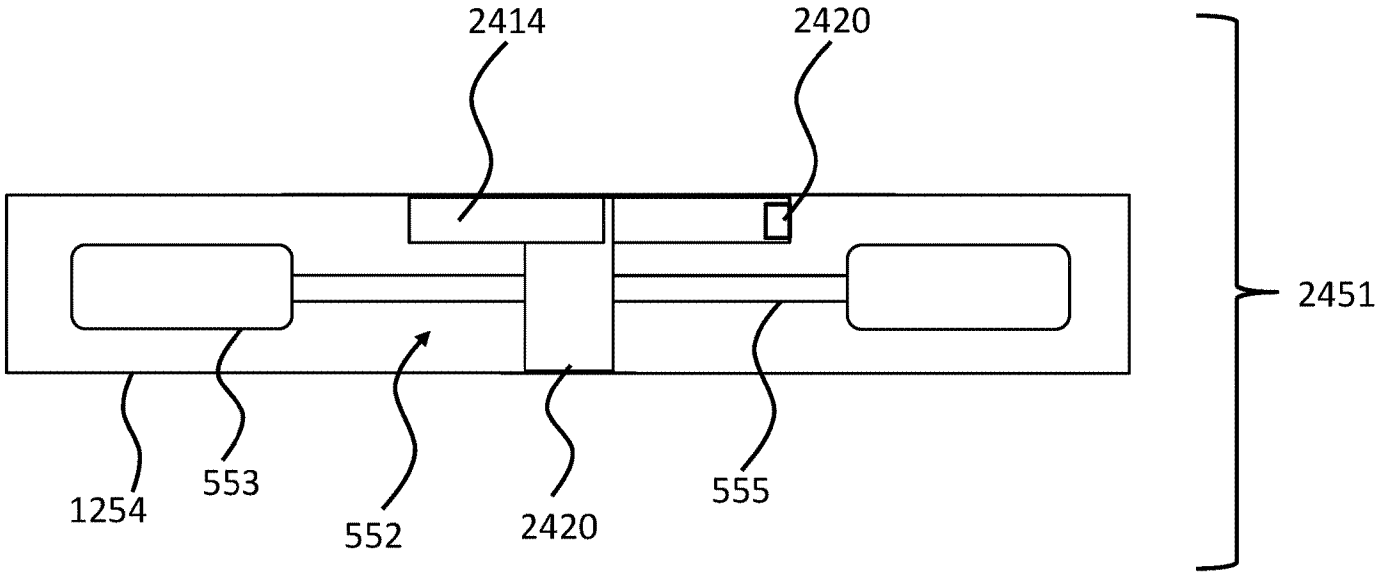
FIGS. 26 and 27 are schematic diagrams of the embodiment of FIGS. 24 and 25 where the shock-proofing has been disabled.
Figure 27:
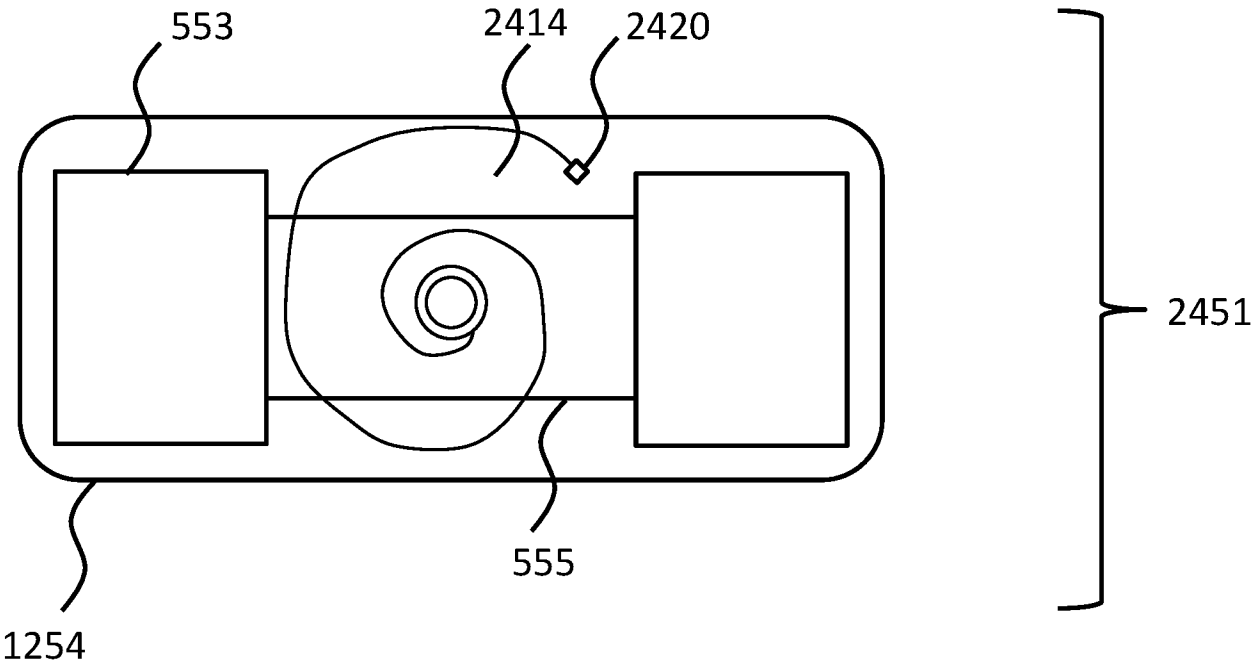

FIGS. 24 and 25 present another exemplary embodiment utilizing a combination of springs and magnets particularly, implantable subcomponent 2451 includes a spring 2472 that is coiled about the post 2420 that establishes the passageway (not shown in FIG. 24, but shown in FIG. 25) for the bolt 880 (although in other embodiments, the post 2420 can be solid, such as for embodiments utilizing the male threaded screw that is integral to the housing 1254). FIG. 24 depicts the traditional side views from the frame of reference of the various FIGs. above. FIG. 25 depicts a view looking downward (i.e., from the top of the page with reference to FIG. 24) with the top of the housing removed so that one can see inside the housing. As can be seen from the figures, spring 2414 is a leaf spring that is attached to the post 2420 at one end, and has a magnetic mass 2520 located at the other end. The nature of spring 2414 is to coil inward around post 2420 if released. To this end, exterior magnet 2510 is located on the outside of the housing 1254, which magnet holds the magnetic mass 2520 against the inside wall of the housing, and thus holds the spring in the uncoiled state (or, more accurately, in the less coiled state). In an exemplary embodiment, immediately prior to implantation or immediately after implantation, the exterior magnet 2510 is removed, thus removing the magnetic attraction between magnet 2510 and magnetic mass 2520. The result is that the spring 2414 coils about post 2420. Corollary to this is that while the leaf spring was in the uncoiled state/less coiled state, the width of the leaf spring was such that it interposed itself between the top of the counterweight 553 and the inside wall of the top wall of the housing 1254, thus preventing the counterweight 553 from moving upwards. (Note that while not shown, there is a similar spring 2414 located on the bottom, which also prevents movement of the counterweight 553 downward when the leaf spring is located between the bottom surface of the counterweight 553 and the inside surface of the bottom portion of the housing 1254.) Conversely, when the leaf spring 2414 coils itself about the post 2420, the leaf spring moves away from the counterweight 553, and thus is no longer in between the counterweight and the housing 1254. This can be seen in FIGS. 26 and 27. Because the piezoelectric material 555 is thinner than the counterweight 553 the leaf spring 2414, in its coiled state, does not interfere with the actuation of the actuator 552.

It can be seen that the magnet 2510 is a relatively de minimis component which could be accidentally removed from the housing 1254 during handling of the implantable subcomponent 2451 or during shipping thereof. Accordingly, in an exemplary embodiment, magnet 2510 is adhered to the outside of the housing 1254 utilizing a plastic strap or the like. In an exemplary embodiment, prior to surgery, the plastic strap is cut so that the magnet 2510 can be removed or otherwise taken away from housing 1254 so that the spring 2414 can coil about the post 2420. In an alternate embodiment, a frame assembly is provided that extends about the housing 1254, which frame assembly supports the magnet 2510. In some exemplary embodiments, the frame assembly only extends about the sides and across the top of the housing 1254, so that the frame assembly can be maintained on the housing 1254 until after the housing 1254 is attached to the bone fixture 341, thus permitting the shock-proof apparatus to be unlocked after the housing 1254 is secured to the bone fixture 341, while also providing a very high likelihood that the magnet 2510 will remain in place to hold magnetic mass 2420 against the inside wall the housing. It is noted that the magnetic mass 2420 can be, in an exemplary embodiment, a piece of iron or some other ferromagnetic material, and/or can be a magnet itself In an exemplary embodiment, it can be coated with silicon and/or rubber.

Figure 28:
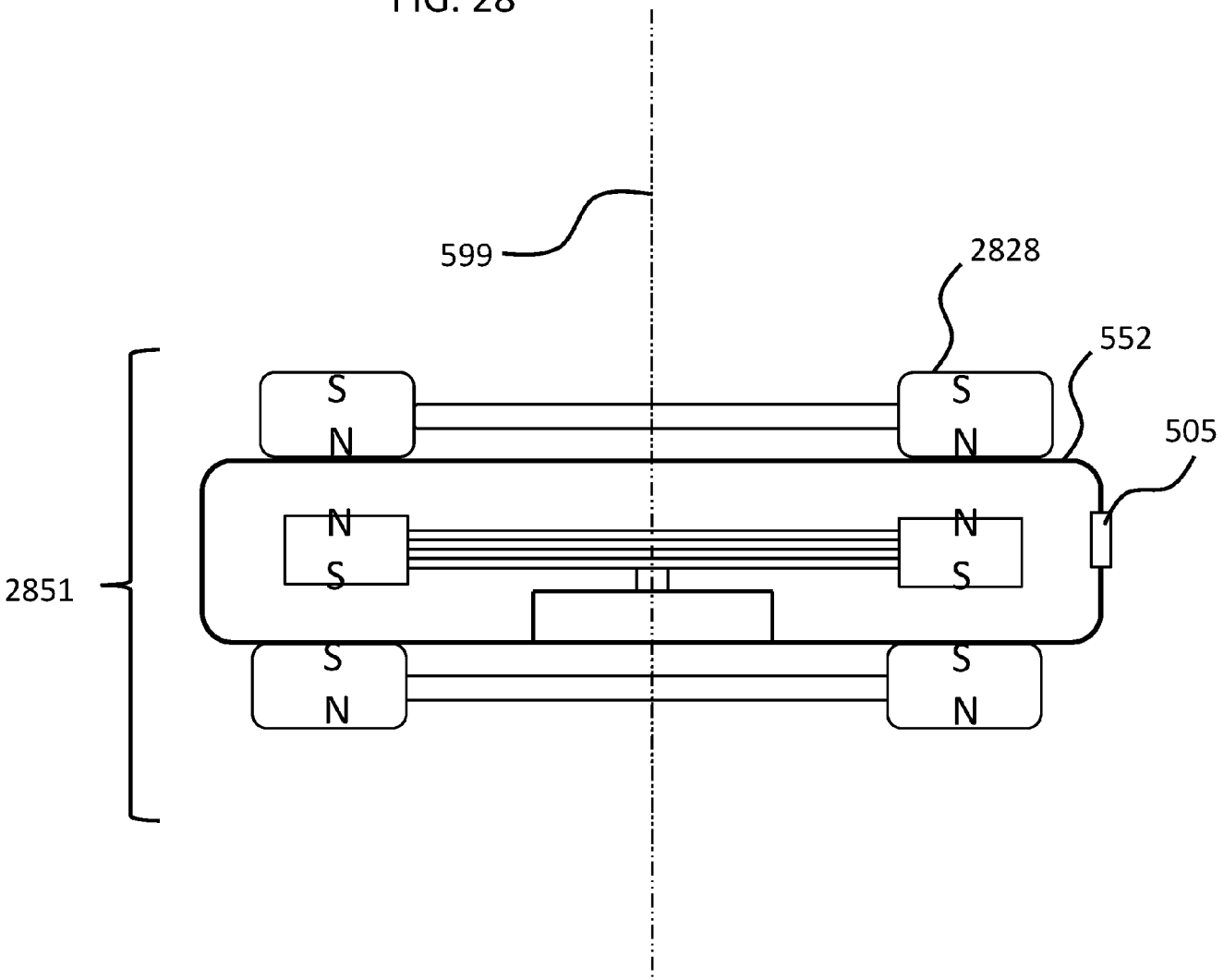
FIG. 28 is a schematic diagram of an exemplary embodiment that prevents the failure mode conceptually represented in FIG. 7.

FIG. 28 depicts another exemplary embodiment of a subcomponent 2850 that utilizes a magnetic field to shock-proof the actuator. In this regard, the counterweights are made of a magnetic material with a north-south pole as can be seen in the figure. The subcomponent 2850 also includes exterior magnets 2828 having a polarity that is opposite to that of the counterweight. Thus, the exterior magnets 2828 apply a magnetic force that pushes the counterweights away from the exterior magnets. Because the exterior magnets are located on both sides of the housing 552, and the magnets are arranged as shown, the magnetic field generated resists movement of the counterweights in either direction, thus, in some embodiments, shock-proofs the actuator 552. It is noted that in an alternate embodiment, instead of utilizing opposing poles, the poles of the external magnets are reversed so that the external magnets attract the counterweights, but because the attraction is balanced owing to the fact that there are magnets located on both sides of the housing, the end result is that the counterweights resists movement. In an exemplary embodiment, prior to implanting the housing 552, the external magnets 2828 are removed so that the counterweights are free to move.

Figure 29:
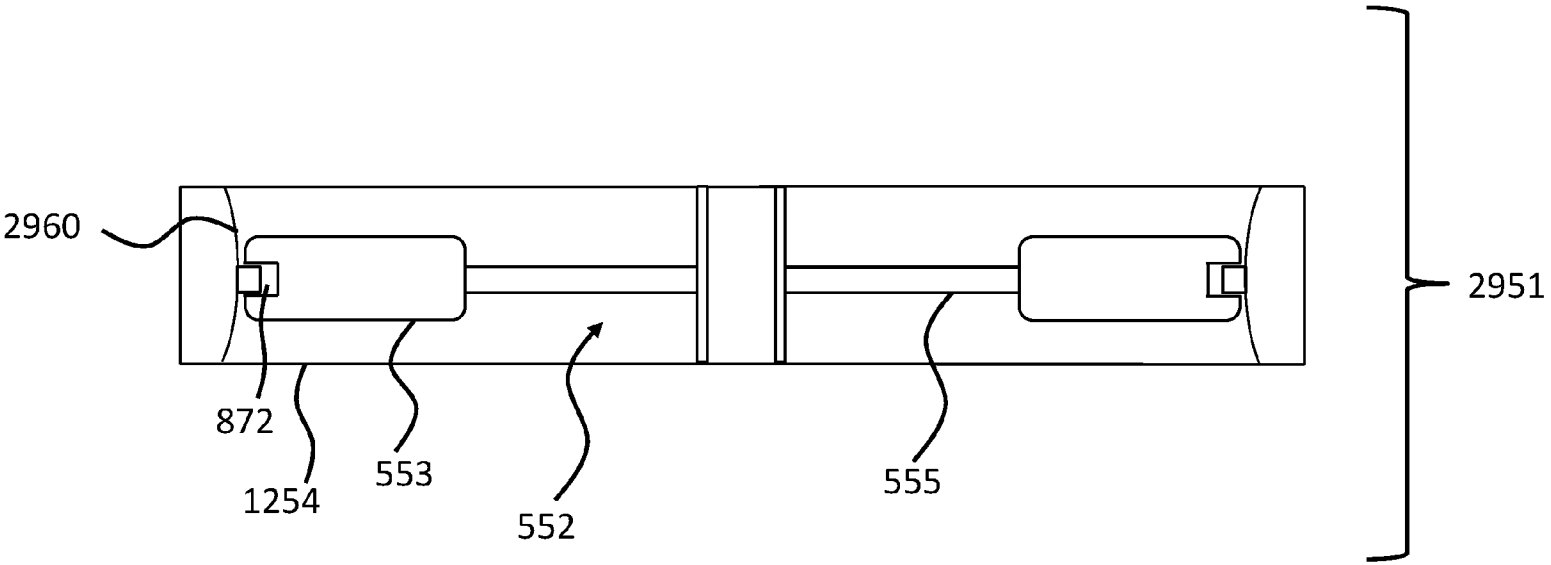
FIG. 29 is a schematic diagram of an exemplary embodiment that prevents the failure mode conceptually represented in FIG. 7.
Figure 30:
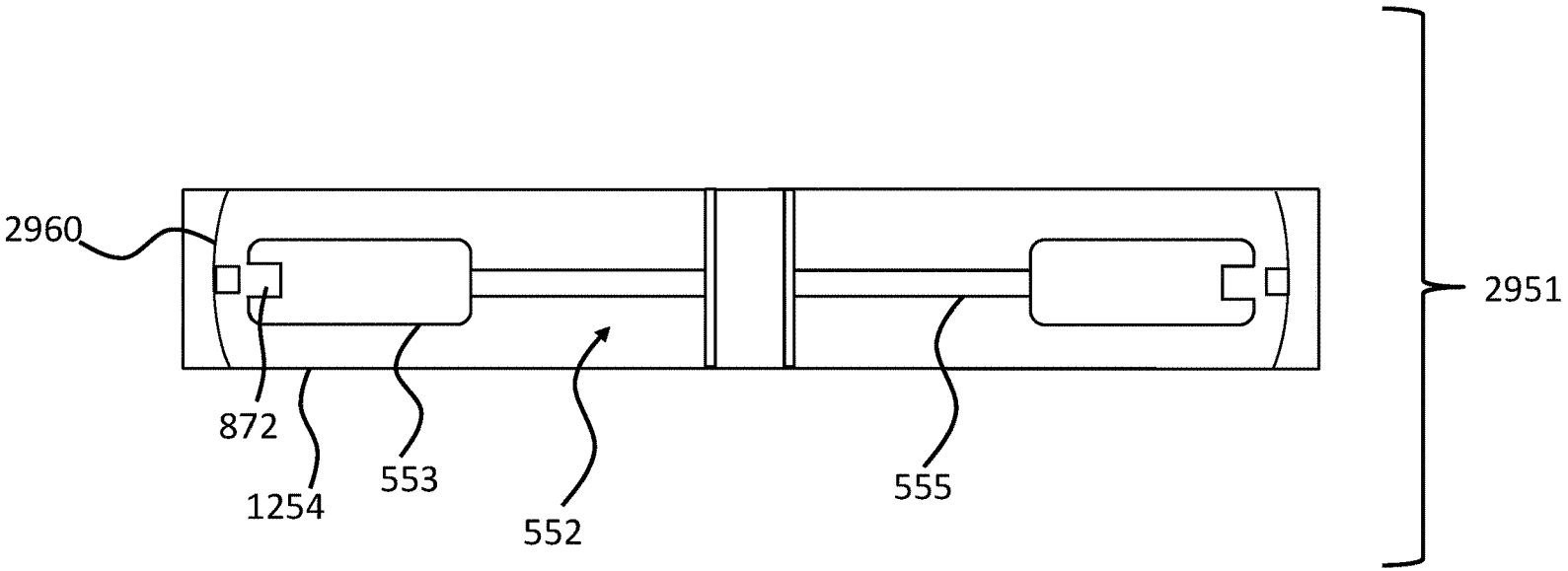
FIG. 30 is a schematic diagram of the embodiment of FIG. 29 where the shock-proofing has been disabled.

Many of the embodiments detailed above utilize some form of mechanical force and/or a magnetic force so as to move the components to unlock the shock-proof apparatus. In some embodiments, a shape-memory alloy or the like can be utilized so as to move the various components of the shop proving apparatus. For example, FIG. 29 depicts an exemplary subcomponent 2951 that includes a shape-memory beam 2960 that supports a prong that interfaces with the indentation 872. In an exemplary embodiment, the subcomponent is heated above the transition temperature of the beam 2960, thus causing beam 2960 to move from the position seen in FIG. 29 to the position seen in FIG. 30. In an exemplary embodiment, the activation temperature can be just below a body temperature (30-35 degrees C., for example). Still further, in an exemplary embodiment, an ultrasonic vibration can be utilized to vibrate the beam 2960 from the position seen in FIG. 29 to the position seen in FIG. 30, where such an embodiment may not necessarily be a shape-memory beam 2960, but instead just a beam that is movable due to a vibration. In an exemplary embodiment, ultraviolet light can be utilized to activate the shape-memory features of beam 2960. Any arrangement that can enable the shape-memory features to be utilized or otherwise activated can be utilized in at least some exemplary embodiments.

Thus, in view of the above, it can be understood that in at least some exemplary embodiments, there is an implantable component that includes a shape memory material that prevents the piezoelectric transducer from moving inside the housing when at a first state, and releases the piezoelectric transducer to move when in a second state.

Figure 31:
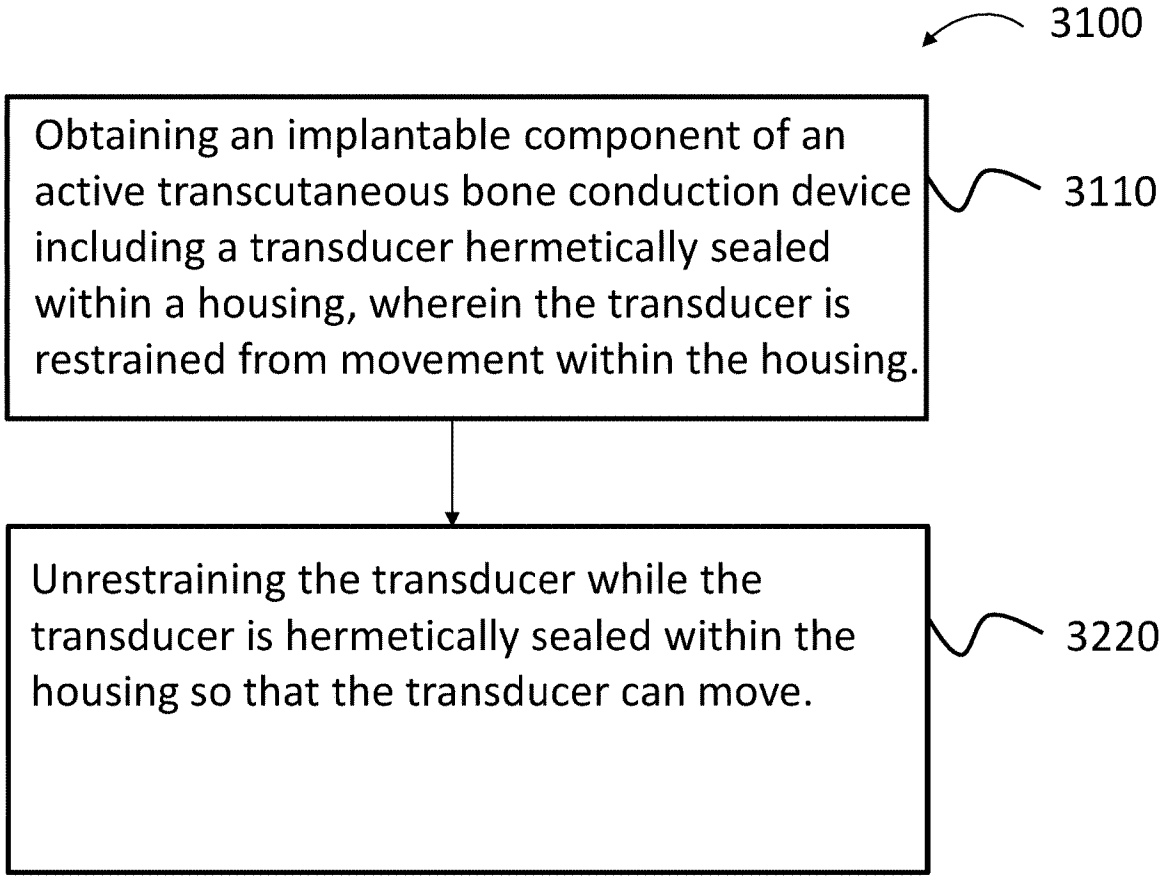
FIG. 31 is an exemplary flowchart according to an exemplary method.

FIG. 31 presents an exemplary flowchart for an exemplary method, method 3100, according to an exemplary embodiment. As detailed above, there is utilitarian value with respect to having an implantable component shock-proofed during the period of time at least before implantation of the recipient. As seen above, the teachings detailed herein are directed toward shock-proofing the piezoelectric transducer such that the piezoelectric material will not be deformed beyond a point where the piezoelectric material breaks or otherwise is plastically deformed. This is distinguished from a situation where, for example, an implantable component is packaged in bubble wrap or the like from the outside. In such a scenario, it is still possible that if the implantable component is subjected to sufficient acceleration and/or deceleration, irrespective of the bubble wrapping, forces imparted on the counterweight as a result of $F=M\times A$ will cause the piezoelectric material to deform. The teachings detailed herein are directed towards preventing that deformation, at least relative to the housing, which will not result from exterior packaging. Still, returning back to FIG. 31, method 3100 includes method action 3110, which entails obtaining an implantable component of an active transcutaneous bone conduction device including a transducer hermetically sealed within a housing, wherein the transducer is restrained from movement within the housing. In an exemplary embodiment, method action 3110 is executed by receiving the implantable component via standard delivery services, where the implantable component has the transducer hermetically sealed in the housing and the transducer is restrained from movement within the housing (hereinafter, the restrained and hermetically sealed conditions). In an exemplary embodiment, method action 3110 is executed by obtaining the implantable component from storage or the like with the restrained and hermetically sealed conditions. In an exemplary embodiment, method action 3110 is executed by removing the external component having the restrained and hermetically sealed conditions into an operating room just before implantation of the implantable component. (That said, without jumping ahead, in an alternate embodiment, method action 3110 is executed by obtaining the implantable component from storage or the like with the restrained and hermetically sealed conditions, but executing method action 3220 prior to bringing the implantable component into the operating room.)

Method 3100 further includes method action 3220, which entails on restraining the transducer while the transducer is hermetically sealed within the housing so that the transducer can move. In an exemplary embodiment, method action 3220 is executed after the implantable component is brought into the operating room and prior to implantation or otherwise attachment to the recipient. In an exemplary embodiment, method action 3220 is executed prior to bringing the implantable component into the operating room. In yet some other exemplary embodiments, method action 3220 is executed after implanting the implantable component to the recipient. Still further, in at least some exemplary embodiments, method action 3220 is executed after the recipient leaves the operating room with the implantable component implanted in the recipient (some additional details will be described below).

Consistent with the teachings detailed above, where in exemplary embodiments, the application of torque to the bolt 880 causes the housing to deform (whether that be an external housing or an internal housing or other external or internal structure not classified as a housing), and, where in other exemplary embodiments, the magnetic field is applied to the implantable component to unlock the shock-proof apparatus and/or a magnetic field is removed from the implantable component to unlock the shock-proof apparatus, method 3100 further includes the action of attaching the implantable component to a skull of the recipient, wherein the action of on restraining the transducer (method action 3220) is executed during or after the action of attaching the implantable component to the skull. Also, consistent with the teachings just mentioned utilizing torque applied to the bolt 880 to cause a component of the external component to deform or otherwise move, an exemplary embodiment entails attaching the implantable component to a skull of a recipient, wherein the action of unrestraining the transducer is executed automatically by the component during the action of attaching the implantable component to the skull. In view of the above teachings associated with the utilization of the torque from the bolt to so as to take the component out of the shock-proofing configuration, it is to be understood that method 3100 can be executed by adding the action of imparting a force onto the housing of the implantable component while the transducer is restrained from movement within the housing, wherein the action of imparting the force results in the action of on restraining the transducer. As noted above, other types of force can be applied on to the housing, such as shaking the housing, etc.

With respect to the embodiments where method action 3220 is utilized proximate in operation in which the implantable component is implanted in a recipient/utilized during the operation in which the implantable component is planted in the recipient, in an exemplary embodiment, the action of unrestraining the transducer (method action 3220) is executed within about an hour (which includes exactly within an hour) of a beginning or in end of the action of attaching the implantable component to the skull of the recipient. In this regard, as noted above, an exemplary embodiment can entail unlocking the shock-proof components so as to enable the transducer to move just prior to implantation of the external component to the recipient (e.g., a surgical aid can bring the implantable component to a surgical shelf/table near the recipient, place the implantable component onto the shelf/table, and execute one of the methods detailed herein utilizing one of the apparatuses detailed herein so as to unlock the shock-proofing and take the external component out of the shock-proof state). This could take place within 5, 10, 15 minutes or so of the action of attaching the implantable component to the skull (maybe longer). Still further as noted above, an exemplary embodiment can entail unlocking the shock-proof components so as to enable the transducer to move as a result of the action of applying torque to the bolt during attachment of the implantable component to the bone fixture implanted in the recipient. Also as noted above, exemplary embodiments can entail unlocking the shock-proof components after the implantable component is implanted in the recipient. This can entail applying a magnetic field to the implantable component 5, 10, 15 minutes or more after the implantable component is attached to the bone fixture, this can entail removing a magnetic component from the implantable component so as to release the shock-proofing apparatus 5, 10, 15 minutes or more after the implantable component is attached to the bone fixture. Other scenarios of implementing the action of unrestraining the transducer within about an hour of a beginning or an end of the action of attaching the implantable component to the skull of the recipient can be included in at least some exemplary embodiments of this teaching.

Consistent with the teachings detailed above associated with applying and/or removing a magnetic field to/from the implantable component, and/or subjecting the implantable component to a temperature change and/or subjecting the implantable component to an ultrasonic signal and/or a ultraviolet light and/or an electrical charge/current, at least some exemplary embodiments of method 3100 further include the action of at least one of subjecting the implantable component to a stimulus or removing a stimulus from the implantable component, wherein the action of subjecting the stimulus or removing the stimulus unrestrained the transducer.

It is further noted that some exemplary embodiments of the implantable component are configured such that movements of the implantable component according to a certain predetermined movement regime results in the activation and/or deactivations of the shock-proofing system. For example, the implantable component can be configured such that if the recipient, starting from a position where the recipient's head is facing forward and not tilted, the recipient tilts his or her head to the left five times, and then tilts his or her head to the right three times without tilting in the other direction in between the five tilts, and then tilts his or her head to the left four times, this activates a mechanical device inside the housing of the implantable component that engages and/or disengages the shock-proofing. In an exemplary embodiment, a device akin to the mechanism utilized in a self-winding watch can be located inside the housing.

As briefly noted above, while some embodiments are directed towards a one-off use of the shock-proofing assembly, where the implantable component is initially shock-proofed, and then a method action according to the teachings detailed herein or a variation thereof is executed to take the implantable component out of the shock-proofing, and the implantable component is never shock-proofed again (with respect to preventing the counterweight from moving). Some other embodiments are directed to a system that enables the implantable component to be re-shock-proofed after the component is taken out of the shock-proofing. By way of example only and not by way of limitation, such as with respect to the embodiments detailed above utilizing the electrically powered actuator, signals can be provided to the implantable component to alternatingly place the implantable component into and out of a shock-proofing configuration. That is, in an exemplary embodiment, there is an implantable component of a bone conduction device that is configured to enable the seismic mass—transducer assembly to be taken out of the shock-proofing configuration while the assembly is hermetically sealed within the housing to enable the assembly to move relative to the housing and configured to subsequently enable the seismic mass—transducer assembly to be placed back into the shock-proofing, wherein the shock-proofing prevents the assembly from moving relative to the housing. In an exemplary embodiment, this can be executed while the implantable component is implanted in the recipient. Thus, with respect to method 3100, that method can further include the action of attaching the implantable component to a skull of a recipient either before or after the action of unrestraining the transducer and subsequent to the action of unrestraining the transducer and the action of attaching the implantable component to the skull, re-restraining the transducer. This can occur multiple times after implantation.

It is noted that unless otherwise specified, any disclosure herein with respect to limiting movement of the counterweight corresponds to a disclosure of preventing movement of the counterweight and vice versa, all of which can correspond to shock-proofing the implantable component in general, and the seismic mass—transducer in particular, in at least some exemplary embodiments.

Figure 32:
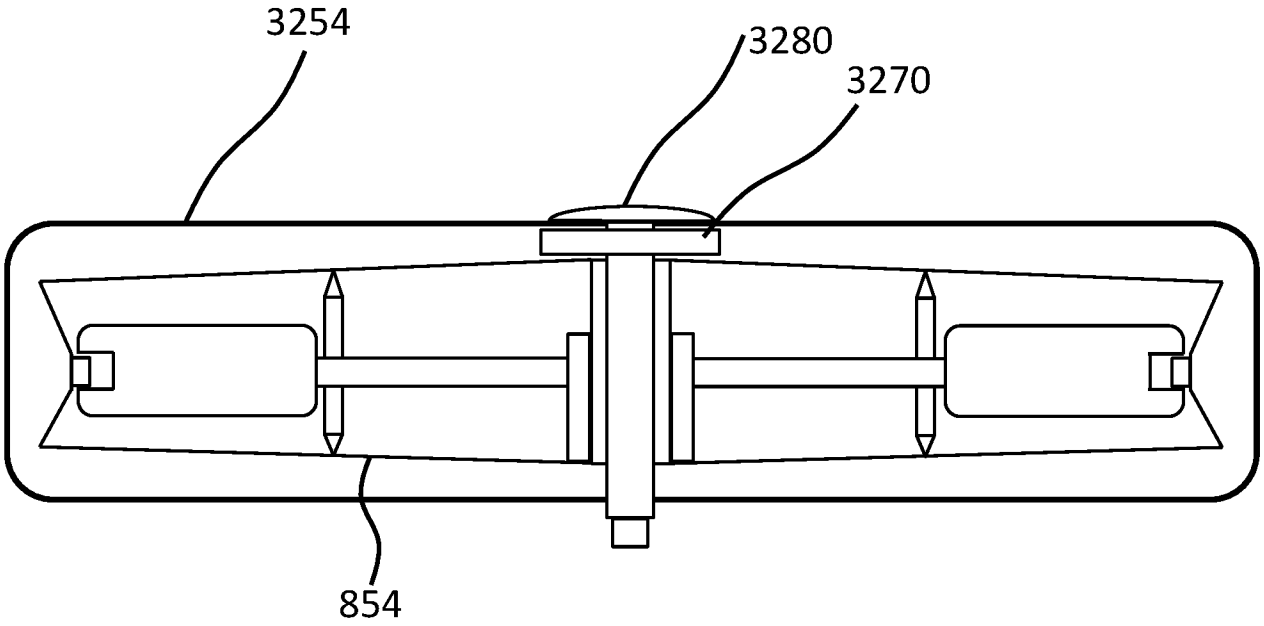
FIG. 32 is a schematic diagram of an exemplary embodiment that prevents the failure mode conceptually represented in FIG. 7.

It is also noted that with respect to the embodiments that utilize a housing that is deformable or otherwise having components that move relative to one another, some exemplary embodiments may not necessarily have impact resistance relative to that which would be the case for a solid or otherwise unmovable housing. Accordingly, a utilitarian embodiment can include placing the deformable housing/a housing having walls that move relative to other housing walls within another housing that has greater impact resistance. FIG. 32 depicts such an exemplary embodiment, where outer housing 3254 is a relatively rigid thick walled housing that provides impact resistance at a greater level than that of the inner housing, which corresponds to the embodiment of FIGS. 8 and 9 detailed above. In an exemplary embodiment, so as to apply the compressive force on to the outside of the inner housing, a compression plate 3270 is located inside the outer housing 3254, which plate includes female threads that engage with threads of the bolt 3280. When the bolt 3280 is rotated, the screw threads on the upper portion of the bolt moved the compression plate 3270 downwards, resulting in the configuration that can be seen in FIG. 33. That is, the compression plate 3270 provides a compressive force on the outside of the inner housing so as to achieve the functionality detailed above with respect to the embodiments of FIGS. 8 and 9.

Figure 33:
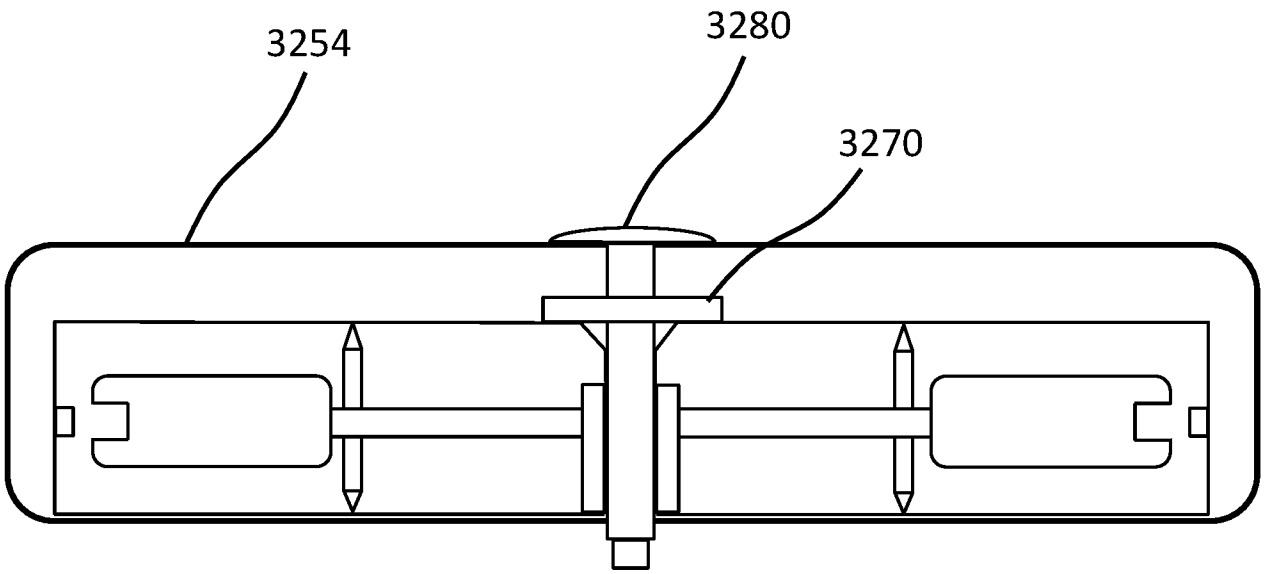
FIG. 33 is a schematic diagram of the embodiment of FIG. 30 where the shock-proofing has been disabled.

It is noted that in an exemplary embodiment of the embodiment of FIGS. 32 and 33, the threads of the bolt 3280 that interface with the compression plate 3270 can be of a different patch than the threads that interface with the female threads of the bone fixture. In this regard, the configuration can be such that the inner housing transitions from the configuration of FIG. 32 to the configuration of FIG. 33 prior to the bolt 3280 being fully threaded into the bone fixture.

Utilizing an inner housing and an outer housing can have utilitarian value with respect to not only increasing an impact resistance of the implantable component overall, but also with respect to enabling or otherwise maintaining a hermetic seal between the inner housing and the outside environment. In this regard, there may be instances where the outer housing 3254 cannot be hermetically sealed. Thus, the inner housing provides a hermetic seal.

Still with reference to FIGS. 32 and 33, it can be seen that in this embodiment, it is the seismic mass—transducer assembly in its entirety that is relocated relative to a housing (here, the outer housing), so as to remove the seismic mass—transducer assembly from the shock-proof configuration. In this regard, it is noted that while the embodiments detailed above have generally focused on relocating other components other than the seismic mass—transducer assembly relative to a static seismic mass—transducer and housing assembly (i.e., the seismic mass—transducer assembly is fixed to the housing), other embodiments can be configured such that the seismic mass—transducer assembly in its entirety is relocated relative to the housing so as to variously disable and/or enable shock-proofing.

Figure 34:
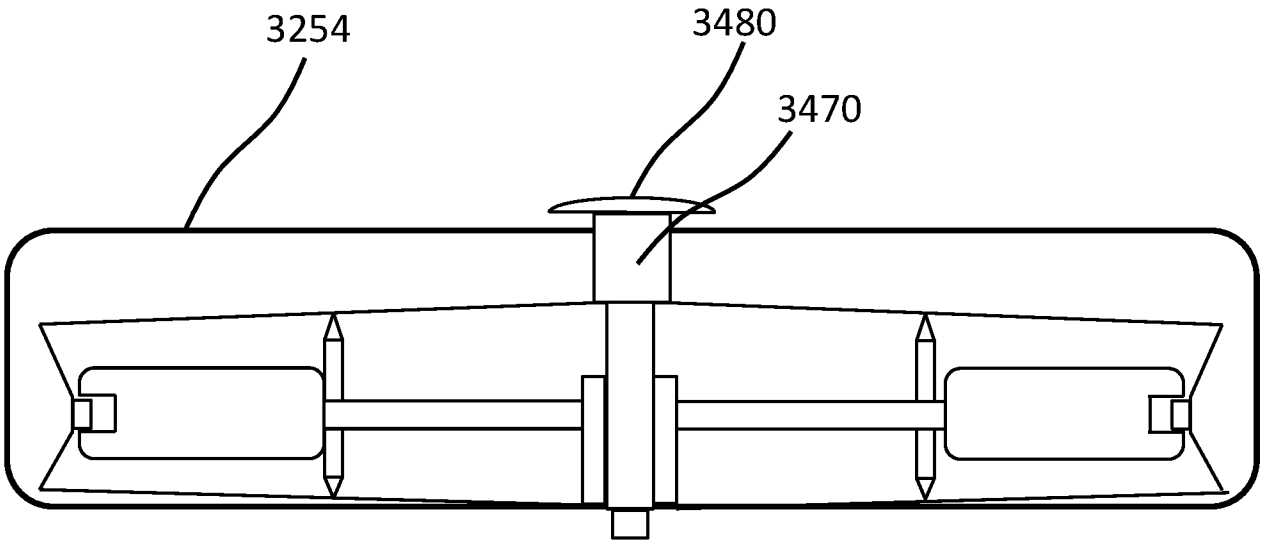
FIG. 34 is a schematic diagram of an exemplary embodiment that prevents the failure mode conceptually represented in FIG. 7.
Figure 35:
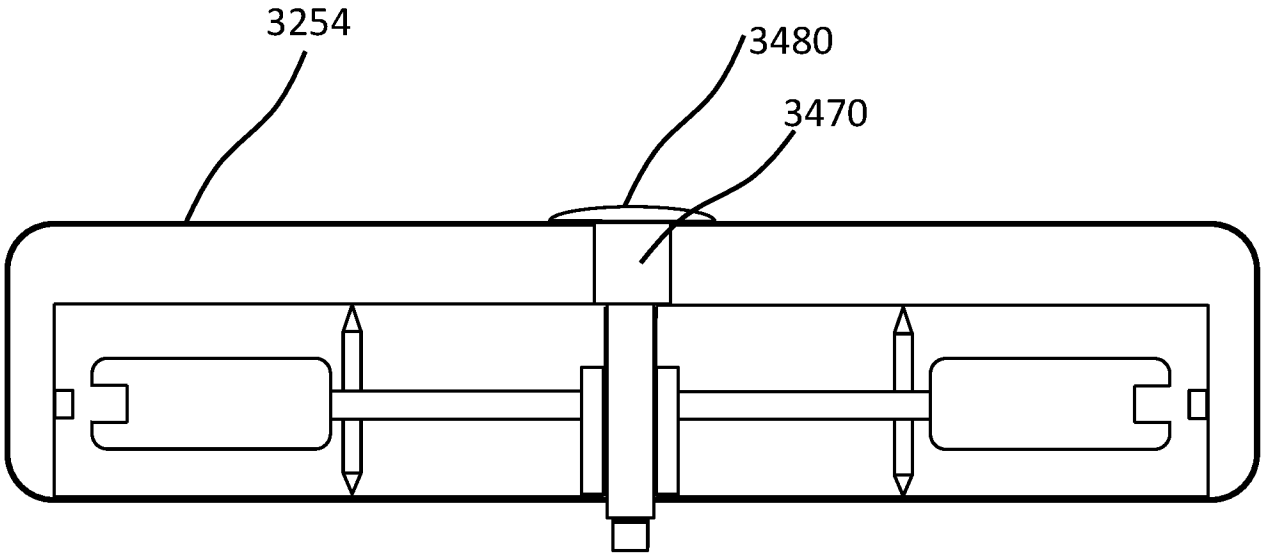
FIG. 35 is a schematic diagram of the embodiment of FIG. 34 where the shock-proofing has been disabled.

FIG. 34 depicts an alternate embodiment where a bolt 3480 having a relatively wide collar 3470 is utilized to provide the compressive force on to the housing of the embodiments of FIGS. 8 and 9 when those embodiments are located in an outer housing 3254. For example, as can be seen in FIG. 35, pushing the bolt 3480 downward applies a force onto the inner housing that compresses the inner housing to achieve the functionality detailed above.

Figure 36:
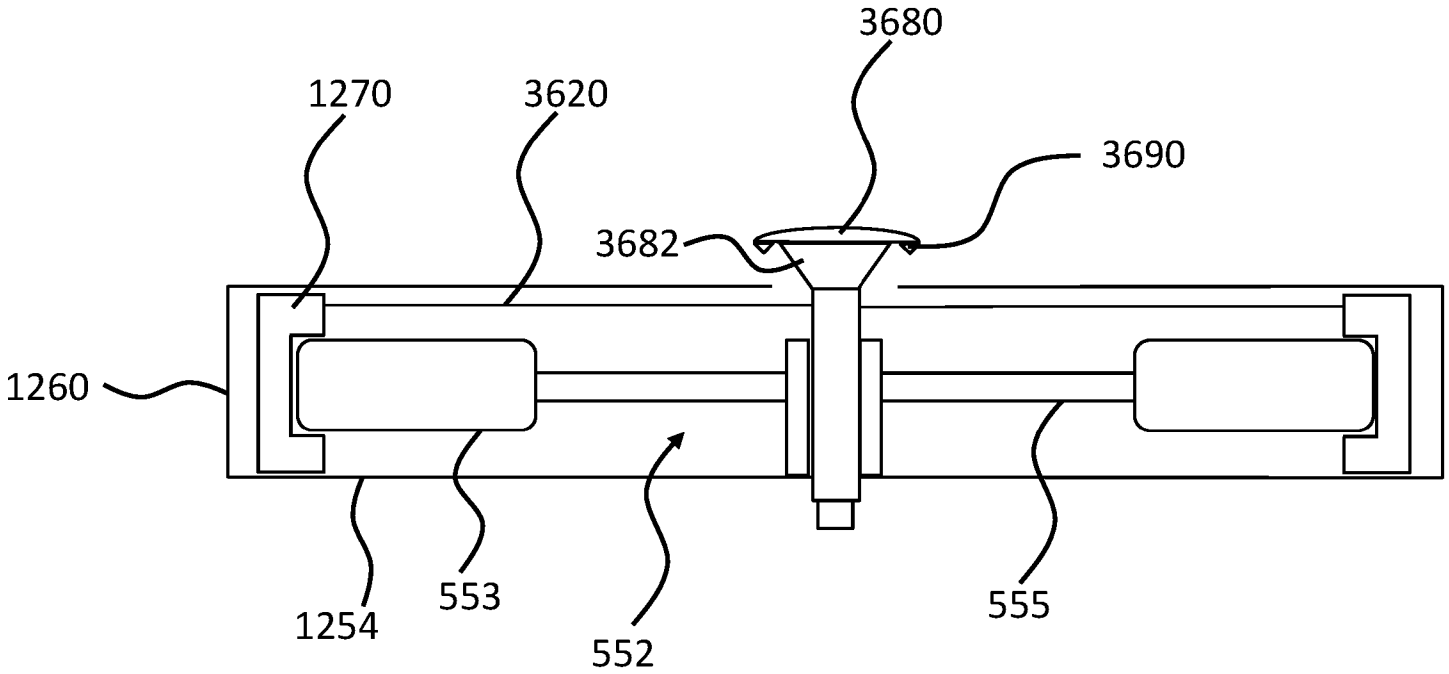
FIG. 36 is a schematic diagram of an exemplary embodiment that prevents the failure mode conceptually represented in FIG. 7.

FIG. 36 depicts another exemplary embodiment where an interior apparatus 3620 located inside housing 1254 is configured to push the locking apparatuses 1270 towards the outboard location when the bolt 3680 is pushed through the hole through the housing 1254. As can be seen, the color of the bolt 3680 includes a conical portion 3682. As the bolt is pushed downward, the relative outer diameter of the bolt increases at the location where the arms of the apparatus 3620 interface with the bolt, and thus the arms of the apparatus 3620 are pushed outward, which also pushes the locking apparatuses 1270 outward, the results of which can be seen in FIG. 37.

Figure 37:
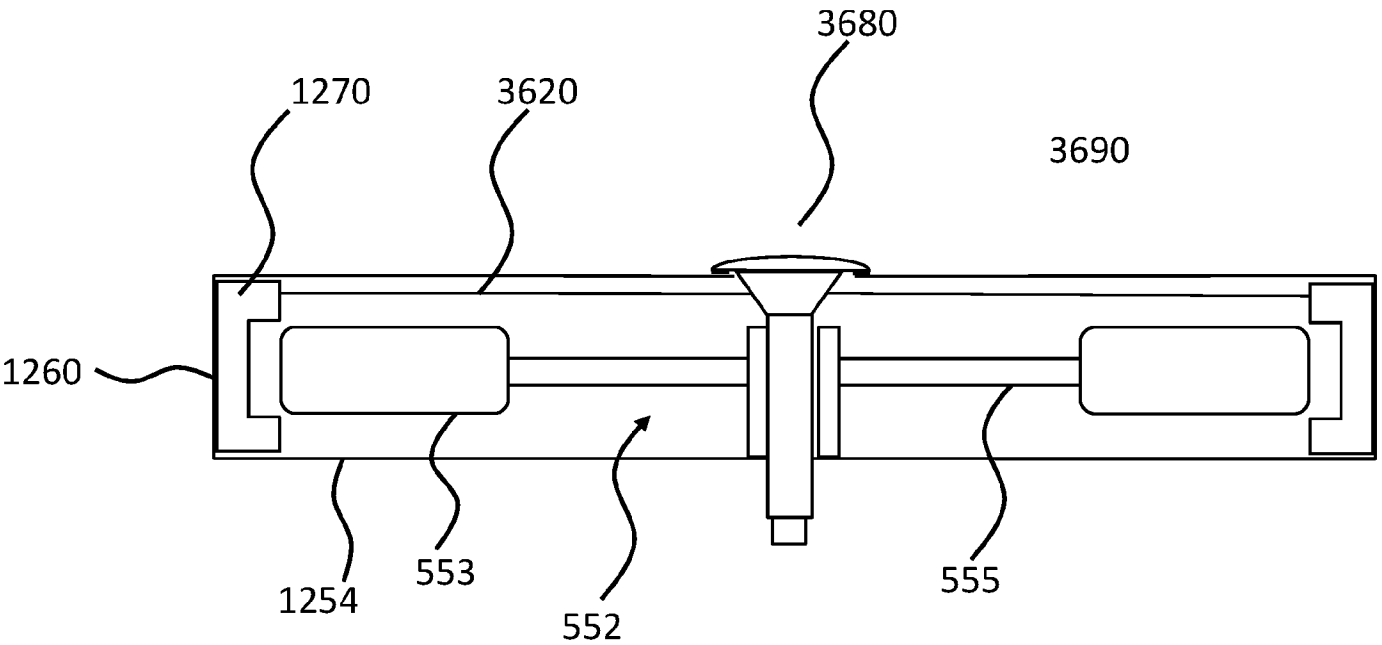
FIG. 37 is a schematic diagram of the embodiment of FIG. 36 where the shock-proofing has been disabled.

Note also that the embodiment of FIGS. 36 and 37 include a deformable element 3690 in an exemplary embodiment, this deformable element extends radially about the underside of the bolt head of bolt 3680. Upon tightening of the bolt 3680, the compression forces against the deformable element 3690 and the outside of the housing wall 1254 to form the deformable element so as to establish a hermetic seal and/or an antimicrobial seal between the outside of the housing 1254 and the inside of the housing 1254. In a similar vein, deformable elements can be located on the outside of the housing 1254 facing the bolt head. Also, deformable elements can be located on the bottom of the housing 1254 so as to deform against the bone fixture. In this regard, the deformable elements utilized in such embodiments can correspond to that described in U.S. Pat. No. 9,271,092. Specifically, the embodiments related to the deformable element being located on the bone fixture screw as disclosed in the '092 patent can be applied to the bolt, the embodiments related to the deformable element being located on the top surface of the abutment can be applied to the top and/or the bottom of the housing 1254, the embodiments related to the deformable element being located on the bone fixture can be applied to the bone fixture is utilized herein. It is noted that in at least some exemplary embodiments, the various geometries of the components detailed herein can be modified so as to accommodate or otherwise reflect the geometries disclosed in the '092 patent so as to achieve the utilitarian value of those embodiments. For example, with respect to the housing interfacing with the bone fixture, the bottom of the housing can be shaped like the bottom of the abutment as disclosed in the '092 patent (along with the respective deformable elements) and interiors of the bone fixture is utilized herein can be shaped like the interiors of the bone fixtures disclosed in the '092 patent (along with the respective deformable elements). In this regard, all teachings relating to the deformable elements of the '092 patent can be applied in at least some embodiments to the housing, the bone fixture, and/or the bolts detailed herein and/or variations thereof.

Figure 38:
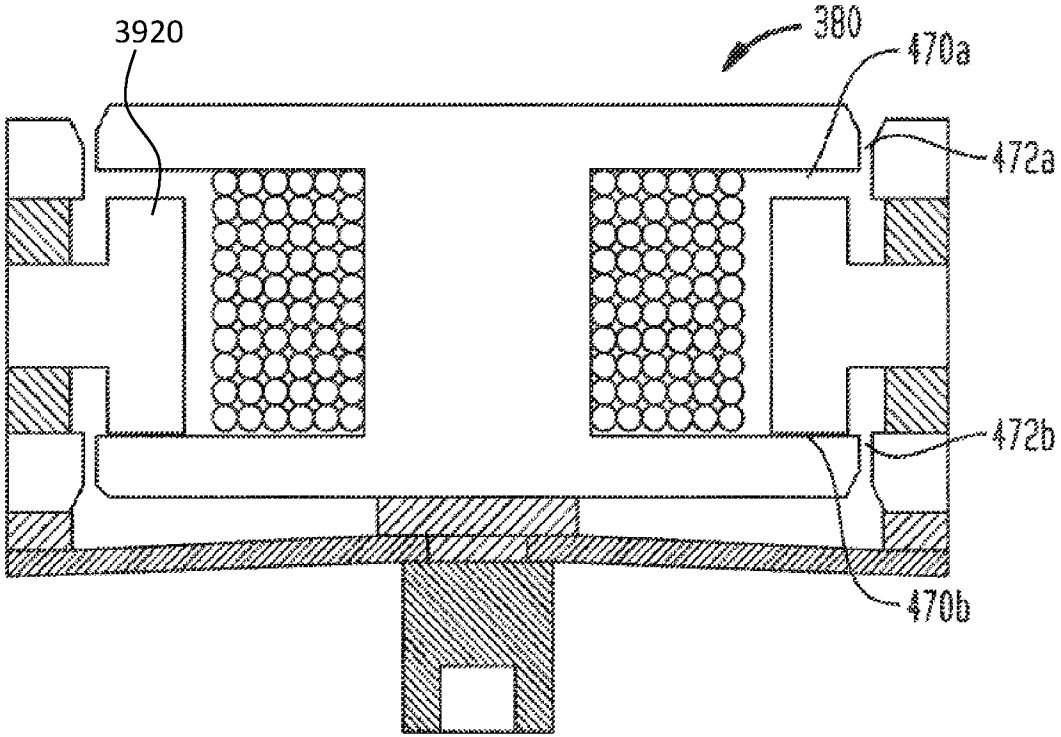
FIGS. 38-40 are schematic diagrams of an exemplary electromagnetic actuator to which the teachings detailed herein have been applied according to an exemplary embodiment.
Figure 39:
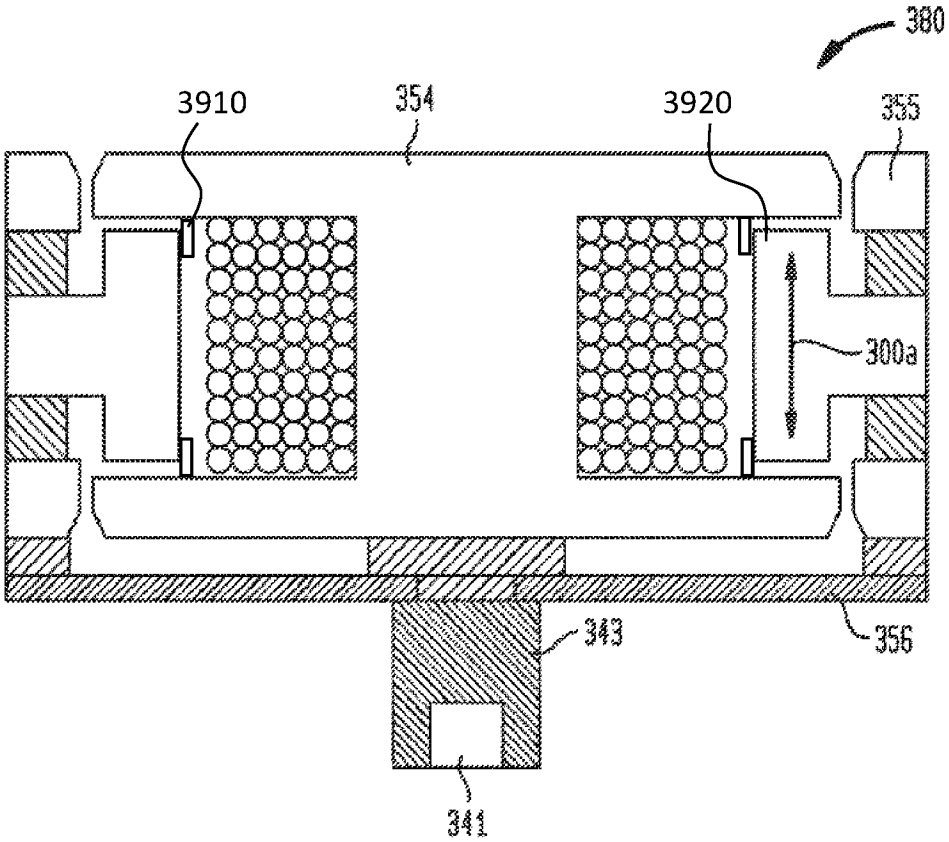
Figure 40:
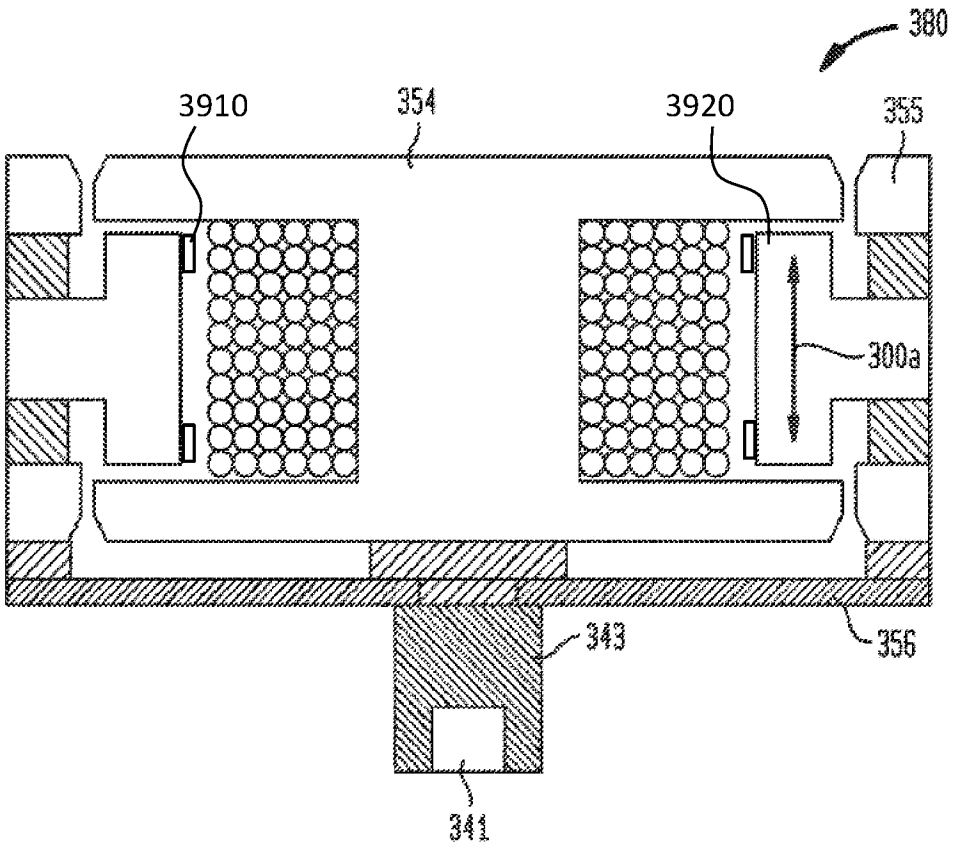

As noted above, embodiments utilizing some of the teachings detailed herein can also be applied to other types of actuators/transducers, such as electromagnetic transducers. In this regard, FIGS. 38-40 depict an exemplary electromagnetic transducer 380 having a bobbin assembly 354 that includes a bobbin and a coil wound thereabout. As can be seen, a yoke is located in between the arms of the bobbin, which conducts a static magnetic flux generated by the magnets located on either side of the side component of the bobbin, which static magnetic flux flows and the circuit that travels through the arms of the bobbin by way of the yokes 355 located above and below the permanent magnets. When energized, the yokes 3920 move in the direction of arrow 300*a* (the yokes being the seismic mass) via flexing of spring 356, which is supported by support 343, which, in some embodiments, is configured to be connected to an abutment of a percutaneous bone conduction device and/or an abutment of a transcutaneous bone conduction device by a coupling 341.

FIG. 38 depicts an exemplary scenario where the yoke 3920 comes into contact with the bottom arm of the bobbin upon the complete closure of the airgap 470*b* (the device of FIG. 38 also includes airgaps 472*a* and 472*b*, which, in some exemplary scenarios, could also completely close—also, in another exemplary scenario, airgap 470*a* could close).

FIG. 39 depicts an exemplary embodiment where stop bocks 3910 are located between the yokes 3920 and the arms of the bobbin, thus shock-proofing the actuator. In an exemplary embodiment, the stop blocks 3910 could slide or rotate along the inside surfaces of the bobbins 3920 to enable and disable the shock-proofing, as is functionally depicted in FIG. 40.

In an exemplary embodiment, there is an implantable component, comprising: a housing; and a piezoelectric transducer, wherein the implantable component is configured to prevent the piezoelectric transducer from moving inside the housing, wherein: the housing is configured to be bolted to a bone fixture via the application of a torque to a bolt extending from a top side of the hosing to a bottom side of the housing; the housing is configured to be driven inward from a relaxed state upon the application of the torque during bolting to the bone fixture, wherein the implantable component is configured such that when the housing is in the relaxed state, the housing applies a force onto the transducer to prevent the transducer from moving inside the housing; and the implantable component is configured such that when the housing is driven inward from the relaxed state, a force is relieved from the transducer to enable the transducer to subsequently move. In an exemplary embodiment, there is an implantable component, comprising: a housing; and a piezoelectric transducer, wherein the implantable component is configured to prevent the piezoelectric transducer from moving inside the housing, wherein the implantable component includes a shape-memory material that prevents the piezoelectric transducer from moving inside the housing when at a first state and releases the piezoelectric transducer to move when in a second state.

In an exemplary embodiment, there is a component of a bone conduction device, comprising: a housing; and a transducer-seismic mass assembly, wherein the component is configured to temporarily shock-proof the assembly, and wherein the housing includes at least one housing wall section that moves relative to another housing wall section, wherein when the at least one housing wall section is in a first position relative to the another housing wall section, the at least one housing wall section applies a force directly or indirectly to the assembly to temporarily shock-proof the assembly, and wherein the component is configured such that the housing is configured to oil can and/or reverse oil can so as to move a portion thereof out of contact with the assembly so as to disable the shock-proofing.

In an exemplary embodiment, there is a component of a bone conduction device, comprising: a housing; and a transducer-seismic mass assembly, wherein the component is configured to temporarily shock-proof the assembly, and wherein the housing includes at least one housing wall section that moves relative to another housing wall section, wherein the component includes a ferromagnetic material that at least indirectly prevents the assembly from moving inside the housing; and the component is configured such that exposure of the ferromagnetic material to a magnetic field locates the ferromagnetic material at a location where the assembly cannot move relative to the housing; and the component is configured such that removal of the ferromagnetic material from the magnetic field locates the ferromagnetic material at a location where the assembly can move relative to the housing.

In an exemplary embodiment, there is a method, comprising: obtaining an implantable component of an active transcutaneous bone conduction device including a transducer hermetically sealed within a housing, wherein the transducer is restrained from movement within the housing; and unrestraining the transducer while the transducer is hermetically sealed within the housing so that the transducer can move, further comprising: attaching implantable component to a skull of a recipient either before or after the action of unrestraining the transducer; and subsequent to the action of unrestraining the transducer and the action of attaching the implantable component to the skull, re-restraining the transducer.

In an exemplary embodiment, there is a method, comprising: obtaining an implantable component of an active transcutaneous bone conduction device including a transducer hermetically sealed within a housing, wherein the transducer is restrained from movement within the housing; and unrestraining the transducer while the transducer is hermetically sealed within the housing so that the transducer can move, further comprising imparting a force onto the housing while the transducer is restrained from movement within the housing, wherein the action of imparting the force results in the action of undertraining the transducer.

In an exemplary embodiment, there is a method, comprising: obtaining an implantable component of an active transcutaneous bone conduction device including a transducer hermetically sealed within a housing, wherein the transducer is restrained from movement within the housing; and unrestraining the transducer while the transducer is hermetically sealed within the housing so that the transducer can move, further comprising imparting a force onto the housing while the transducer is restrained from movement within the housing so as to deform the housing, wherein the action of deforming the housing results in the action of undertraining the transducer.

It is noted that any disclosure of a device and/or system herein corresponds to a disclosure of a method of utilizing such device and/or system. It is further noted that any disclosure of a device and/or system herein corresponds to a disclosure of a method of manufacturing such device and/or system. It is further noted that any disclosure of a method action detailed herein corresponds to a disclosure of a device and/or system for executing that method action/a device and/or system having such functionality corresponding to the method action. It is also noted that any disclosure of a functionality of a device herein corresponds to a method including a method action corresponding to such functionality. Also, any disclosure of any manufacturing methods detailed herein corresponds to a disclosure of a device and/or system resulting from such manufacturing methods and/or a disclosure of a method of utilizing the resulting device and/or system.

Unless otherwise specified or otherwise not enabled by the art, any one or more teachings detailed herein with respect to one embodiment can be combined with one or more teachings of any other teaching detailed herein with respect to other embodiments.

While various embodiments have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. A component of a bone conduction device, comprising:
a housing; and
a transducer-seismic mass assembly, wherein
the component is configured to temporarily shock-proof the assembly such that the transducer-seismic mass assembly is protected from shock when temporarily shock-proofed and is unprotected from shock when not temporarily shock-proofed.

2. The component of claim 1, wherein:
the assembly includes a piezoelectric transducer.

3. The component of claim 1, wherein:
the housing includes at least one housing wall section that moves relative to another housing wall section, wherein when the at least one housing wall section is in a first position relative to the another housing wall section, the at least one housing wall section applies a force directly or indirectly to the transducer-seismic mass assembly so as to prevent the transducer-seismic mass assembly from moving inside the housing.

4. The component of claim 1, wherein:
the component includes a movable brace that prevents the transducer-seismic mass assembly from moving inside the housing, wherein the movable brace is movable from outside the housing when the housing is completely sealed with the transducer-seismic mass assembly and the brace therein to enable the transducer-seismic mass assembly to move relative to the housing.

5. The component of claim 1, wherein:
the component includes a ferromagnetic material that at least indirectly prevents the transducer-seismic mass assembly from moving inside the housing, wherein the component is configured such that exposure of the ferromagnetic material to a magnetic field moves the ferromagnetic material to enable the transducer-seismic mass assembly to move relative to the housing.

6. The component of claim 1, wherein:
the component includes a spring-loaded device that prevents the transducer-seismic mass assembly from moving inside the housing when at a first position and enables the transducer-seismic mass assembly to move relative to the housing when at a second position.

7. The component of claim 1, wherein:

the housing is configured to be bolted to a bone fixture via the application of a torque to a bolt extending from a top side of the hosing to a bottom side of the housing;

the housing is configured to be driven inward from a relaxed state upon the application of the torque during bolting to the bone fixture, wherein the component is configured such that when the housing is driven inward from the relaxed state, a force is relieved from the transducer-seismic mass assembly to enable the transducer-seismic mass assembly to subsequently move.

8. The component of claim 1, wherein:

the component includes a movable component that is movable relative to the assembly from a first position to a second position, the first position being a position in which the assembly is shock-proofed, the second position being a position in which the assembly is no longer shock-proofed.

9. The component of claim 1, wherein:

the component is configured to enable the assembly to be taken out of the shock-proofing while the assembly is hermetically sealed within the housing to enable the assembly to move relative to the housing and configured to subsequently enable the assembly to be placed back into the shock-proofing, wherein the shock-proofing prevents the assembly from moving relative to the housing.

10. The component of claim 1, wherein:

the housing includes at least one housing wall section that moves relative to another housing wall section, wherein when the at least one housing wall section is in a first position relative to the another housing wall section, the at least one housing wall section applies a force directly or indirectly to the assembly to temporarily shock-proof the assembly.

11. The component of claim 1, wherein:

the housing includes at least one housing wall section that moves relative to another housing wall section, wherein when the at least one housing wall section is in a first position relative to the another housing wall section, the at least one housing wall section applies a force directly or indirectly to the assembly to temporarily shock-proof the assembly, and wherein when the at least one housing wall section is in a second position relative to the another housing wall section, the at least one housing wall section relieves the force from the assembly to permit the assembly to move from within the housing.

12. The implantable component of claim 1, wherein:

the housing is configured to be bolted to a bone fixture.

13. The component of claim 1, wherein:

the component is configured to temporarily shock-proof the assembly such that the transducer-seismic mass assembly is restrained from movement when temporarily shock-proofed and is unrestrained from movement when not temporarily shock-proofed.

14. A component of a bone conduction device, comprising:

a housing; and a transducer-seismic mass assembly, wherein the component is configured to temporarily shock-proof the assembly, wherein the component includes a movable component that is movable relative to the assembly that prevents the assembly from moving inside the housing when at a first position and enables the assembly to move inside the housing when at a second position, the first position being a position in which the assembly is shock-proofed.

15. A component of a bone conduction device, comprising:

a housing; and a transducer-seismic mass assembly, wherein the component is configured to temporarily shock-proof the assembly, wherein the component is configured to enable the assembly to be taken out of the shock-proofing while the assembly is hermetically sealed within the housing to enable the assembly to vibrate.

* * * * *